US008023364B2

(12) United States Patent
Kojima

(10) Patent No.: US 8,023,364 B2
(45) Date of Patent: Sep. 20, 2011

(54) HAND POSITION DETECTING DEVICE AND HAND POSITION CONTROL METHOD

(75) Inventor: Tadashi Kojima, Musashino (JP)

(73) Assignee: Casio Computer Co., Ltd., Tokyo (JP)

( * ) Notice: Subject to any disclaimer, the term of this patent is extended or adjusted under 35 U.S.C. 154(b) by 303 days.

(21) Appl. No.: 12/472,515

(22) Filed: May 27, 2009

(65) Prior Publication Data

US 2009/0296533 A1 Dec. 3, 2009

(30) Foreign Application Priority Data

May 28, 2008 (JP) ..... 2008-139127

(51) Int. Cl.
*G04B 19/02* (2006.01)

(52) U.S. Cl. ..... 368/220; 368/80; 368/223; 368/11; 368/228

(58) Field of Classification Search ..... 368/11, 368/80, 220, 223, 228, 238
See application file for complete search history.

(56) References Cited

U.S. PATENT DOCUMENTS

| | | | | |
|---|---|---|---|---|
| 4,358,753 | A | 11/1982 | Cascini | |
| 4,645,357 | A | 2/1987 | Allgaier | |
| 5,457,664 | A | 10/1995 | Izukawa et al. | |
| 5,640,007 | A | 6/1997 | Talbott et al. | |
| 5,734,474 | A | 3/1998 | Haecker et al. | |
| 5,999,495 | A | 12/1999 | Hashizume et al. | |
| 6,288,977 | B1 | 9/2001 | Yoshida | |
| 6,367,967 | B1 * | 4/2002 | Kojima et al. | 368/185 |
| 6,424,600 | B1 * | 7/2002 | Okeya et al. | 368/204 |
| 6,731,571 | B2 | 5/2004 | Yiu | |
| 6,804,173 | B2 | 10/2004 | Yiu | |
| 6,807,128 | B2 | 10/2004 | Yiu | |
| 7,154,818 | B2 | 12/2006 | Liu | |
| 2002/0167869 | A1 * | 11/2002 | Masuda et al. | 368/238 |
| 2004/0120220 | A1 * | 6/2004 | Ogasawara | 368/80 |
| 2009/0016172 | A1 | 1/2009 | Fujii et al. | |
| 2009/0086580 | A1 | 4/2009 | Aoki et al. | |
| 2009/0086581 | A1 | 4/2009 | Suizu et al. | |

FOREIGN PATENT DOCUMENTS

| | | | |
|---|---|---|---|
| EP | 2042947 | A1 | 4/2009 |
| GB | 2 270 398 | A | 3/1994 |
| JP | 6-222164 | A | 8/1994 |
| JP | 2000-162336 | A | 6/2000 |
| JP | 2002-71847 | A | 3/2002 |
| JP | 2002-107465 | A | 4/2002 |
| JP | 2002-116270 | A | 4/2002 |
| JP | 2002-357678 | A | 12/2002 |
| JP | 2003-194971 | A | 7/2003 |
| JP | 2004-184088 | A | 7/2004 |
| JP | 2004-257816 | A | 9/2004 |
| JP | 2006-046924 | A | 2/2006 |
| JP | 2006-153652 | A | 6/2006 |
| JP | 2006-275803 | A | 10/2006 |
| JP | 3872688 | B2 | 10/2006 |
| WO | WO 2007/102412 | A1 | 9/2007 |

OTHER PUBLICATIONS

Japanese Office Action dated Nov. 10, 2009 and English translation thereof issued in a counterpart Japanese Application No. 2007-253830 of related U.S. Appl. No. 12/238,090.

(Continued)

*Primary Examiner* — Renee S Luebke
*Assistant Examiner* — Jason Collins
(74) *Attorney, Agent, or Firm* — Holtz, Holtz, Goodman & Chick, PC

(57) ABSTRACT

A solar panel determines whether or not a wristwatch is in darkness. When the darkness has continued for a predetermined time period, e.g., for 61-70 minutes, it is determined that the wristwatch is not in use and set in a sleep state. Out of seconds, center and hour hands, at least the seconds hand is rotated to a reference position (00-second position) and stopped, and positions of the center and hour hands are detected. Therefore, power consumption during can be reduced when the wristwatch is not in use.

12 Claims, 33 Drawing Sheets

OTHER PUBLICATIONS

Japanese Office Action dated Jun. 1, 2010, issued in counterpart Japanese Application No. 2008-139127, and English translation of the Japanese Office Action.

Japanese Office Action dated Mar. 16, 2010 and English translation thereof issued in Japanese Application No. 2007-331355, which is a counterpart of related U.S. Appl. No. 12/341,470.

Related U.S. Applications: U.S. Appl. No. 12/235,916, filed Sep. 23, 2008 (U.S. Publ. No. 2009/0086580); U.S. Appl. No. 12/238,090, filed Sep. 25, 2008 (U.S. Publ. No. 2009/0086581); U.S. Appl. No. 12/341,470, filed Dec. 22, 2008; U.S. Appl. No. 12/473,750, filed May 28, 2009.

Extended European Search Report dated Jul. 7, 2010 (in English) issued in European Application No. 09161225.9, which is an European counterpart of related U.S. Appl. No. 12/473,750.

Extended European Search Report dated Oct. 6, 2010 (in English) in counterpart European Application No. 09161183.0.

* cited by examiner

FIG.6

| FIRST DRIVING SYSTEM: SECONDS HAND TRAIN WHEEL | | | | | |
|---|---|---|---|---|---|
| WHEEL TYPE | WHEEL: PINION | NUMBER OF TEETH (Z) | ROTATIONAL ANGLE | PULSES PER ONE ROTATION | DETECTION APERTURE |
| ROTOR | PINION | 10 | 180 | 2 | |
| FIFTH WHEEL | WHEEL | 50 | 36 | 10 | |
| | PINION | 10 | | | |
| SECONDS WHEEL | WHEEL | 60 | 6 | 60 | ● |

| SECOND DRIVING SYSTEM: CENTER AND HOUR HANDS TRAIN WHEEL | | | | | |
|---|---|---|---|---|---|
| WHEEL TYPE | WHEEL: PINION | NUMBER OF TEETH (Z) | ROTATIONAL ANGLE | PULSES PER ONE ROTATION | DETECTION APERTURE |
| ROTOR | PINION | 10 | 180 | 2 | |
| INTERMEDIATE WHEEL | WHEEL | 60 | 30 | 12 | ● |
| | PINION | 8 | | | |
| THIRD WHEEL | WHEEL | 60 | 4 | 90 | |
| | PINION | 16 | | | |
| CENTER WHEEL | WHEEL | 64 | 1 | 360 | ● |
| | PINION | 20 | | | |
| MINUTE WHEEL | WHEEL | 60 | 1/3 | 1080 | |
| | PINION | 16 | | | |
| HOUR WHEEL | WHEEL | 64 | 1/12 | 4320 | ● |

DETECTION PATTERN FOR SECONDS WHEEL

FIG.27

| HAND POSITION DETECTION ERROR DISPLAY | |
|---|---|
| TYPE OF ERROR | STOP POSITION OF SECONDS HAND |
| ERROR NO. 0 (HANDS POSITIONED CORRECTLY) | 55-SECOND POSITION |
| ERROR NO. 1 | 3-SECOND POSITION |
| ERROR NO. 2 | 6-SECOND POSITION |
| ERROR NO. 3 | 9-SECOND POSITION |
| ERROR NO. 4 | 12-SECOND POSITION |
| ERROR NO. 5 | 15-SECOND POSITION |
| ERROR NO. 6 | 18-SECOND POSITION |
| ERROR NO. 7 | 21-SECOND POSITION |
| ERROR NO. 8 | 24-SECOND POSITION |
| ERROR NO. D | 39-SECOND POSITION |
| ERROR NO. E | 42-SECOND POSITION |

HAND POSITION DETECTING DEVICE AND HAND POSITION CONTROL METHOD

CROSS-REFERENCE TO RELATED APPLICATIONS

This application is based upon and claims the benefit of priority from prior Japanese Patent Application No. 2008-139127, filed May 28, 2008, the entire contents of which are incorporated herein by reference.

BACKGROUND OF THE INVENTION

1. Field of the Invention

The present invention relates to a hand position detecting device and a hand position control method which detects rotational positions of seconds, center and hour hands.

2. Description of the Related Art

Conventionally, a hand position detecting device which detects the rotational positions of hands of a timepiece is known, as disclosed in Jpn. Pat. Appln. KOKAI Publication No. 2000-162336.

The hand position detecting device comprises a first drive system in which a first drive motor transmits its rotation to a seconds wheel which in turn causes a seconds hand to sweep around a dial, a second drive system in which a second drive motor transmits its rotations to the center and hour wheels to cause the center and hour hands, respectively, to sweep around the dial. The hand position detecting device also comprises a photosensor including a light emission element and a photo detection element. The photosensor optically detects a first, a second and a third light-passing apertures provided respectively in the seconds, center and hour wheels with the aid of the light emission element and the photo detection element when the seconds, center and hour wheels of the first and second drive systems rotate after pointing to the same direct on on the same axis. The hand position detecting device detects respective rotational positions of the seconds, center and hour wheels based on detected signals from the photosensor and hence rotational positions of the seconds, center and hour hands are determined.

However, the conventional hand detecting device only determines the rotational positions of the seconds, center and hour hands. Thus, when it is determined that these hands rotate around the dial correctly, normal rotations are continued. However, when the hand detecting device is left in darkness for long periods, detection of the hands is repeated many times, thereby consuming a significant amount of battery power.

BRIEF SUMMARY OF THE INVENTION

According to an embodiment of the present invention, a hand position detecting device comprises:

an optical detection unit configured to detect whether or not light passes through light-passing apertures provided in hand wheels having hands;

a hand position detecting unit configured to detect positions of the hands based on passage or non-passage of light detected by the optical detection unit;

a darkness detector configured to detect whether or not the hand position detecting device is in darkness;

a dark state determining unit configured to determine, when the darkness detector detects that the hand position detecting device is in darkness, whether or not the hand position detecting device has been in darkness for a predetermined time period; and a hand rotation controlling unit configured to, when the dark state determining section determines that the hand position detecting device has been in darkness for the predetermined time period, rotate at least one of the hands to a reference position, stop the one of the hands, and control the hand position detection unit to detect positions of remaining hands at predetermined time intervals.

According to another embodiment of the present invention, a hand position control method used in a hand position detecting device, comprises:

detecting whether or not light passes through light-passing apertures provided in hand wheels having hands;

detecting positions of the hands based on detected passage or non-passage of light;

detecting whether or not the hand position detecting device is in darkness;

determining whether or not the hand position detecting device has been in darkness for a predetermined time period when it is detected that the hand position detecting device is in darkness; and when it is determined that the hand position detecting device has been in darkness for the predetermined time period, rotating at least one of the hands to a reference position, stopping the one of the hands, and controlling positions of remaining hands to be detected at predetermined time intervals.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the present invention and, together with the general description given above and the detailed description of the embodiments given below, serve to explain the principles of the present invention in which:

FIG. 6 shows details of components of each of first and second driving systems of FIG. 2, including the operational conditions of the components;

FIGS. 11A, 11B, 11C, 11D, 11E, 11F, 11G, 11H, 11I, 11J, 11K, 11L, 11M, 11N, 11O and 11P show a basic position detecting operation of the seconds, hour and intermediate wheels of FIG. 5, wherein FIGS. 11A-11M illustrate respective states of the wheels obtained when the center wheel rotates sequentially one step (12 degrees) at a time, FIG. 11N shows a state of the wheels when the center wheel rotates 360 steps (one hour) from the state of FIG. 11M, FIG. 11O shows a state of the wheels obtained when the center wheel rotates 9 hours from the state of FIG. 11N, and FIG. 11P shows a state of the wheels at an "11-o'clock 00-minute position" obtained when the center wheel rotates one hour from the state of FIG. 11O;

FIG. 27 shows a table of hand position detection errors;

DETAILED DESCRIPTION OF THE INVENTION

Referring to FIGS. 1 to 30, description will be made on a hand type wristwatch according to one embodiment of the present invention.

Figure 1:
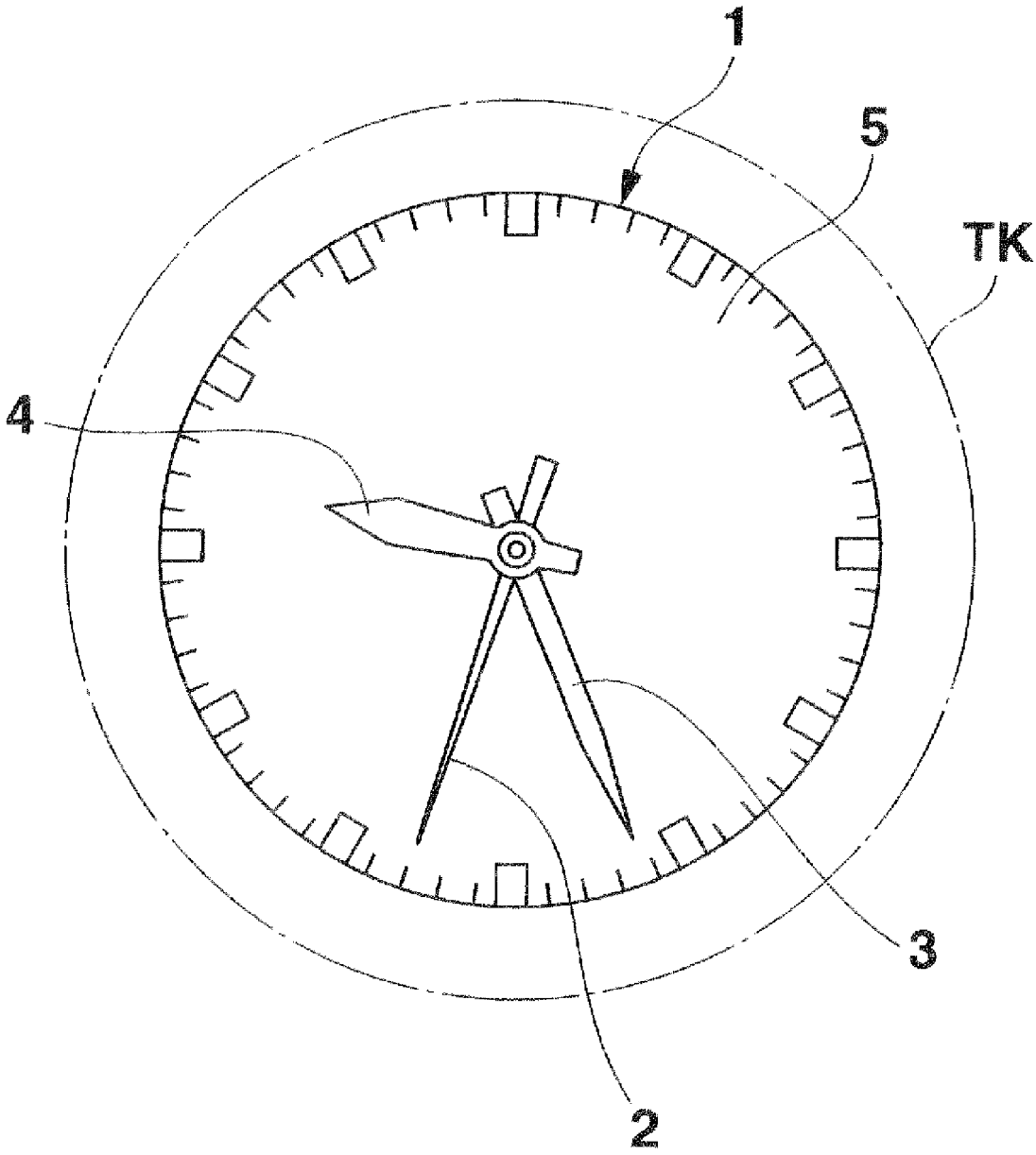
FIG. 1 is a plan view of a hand type wristwatch according to one embodiment of the present invention.
Figure 2:
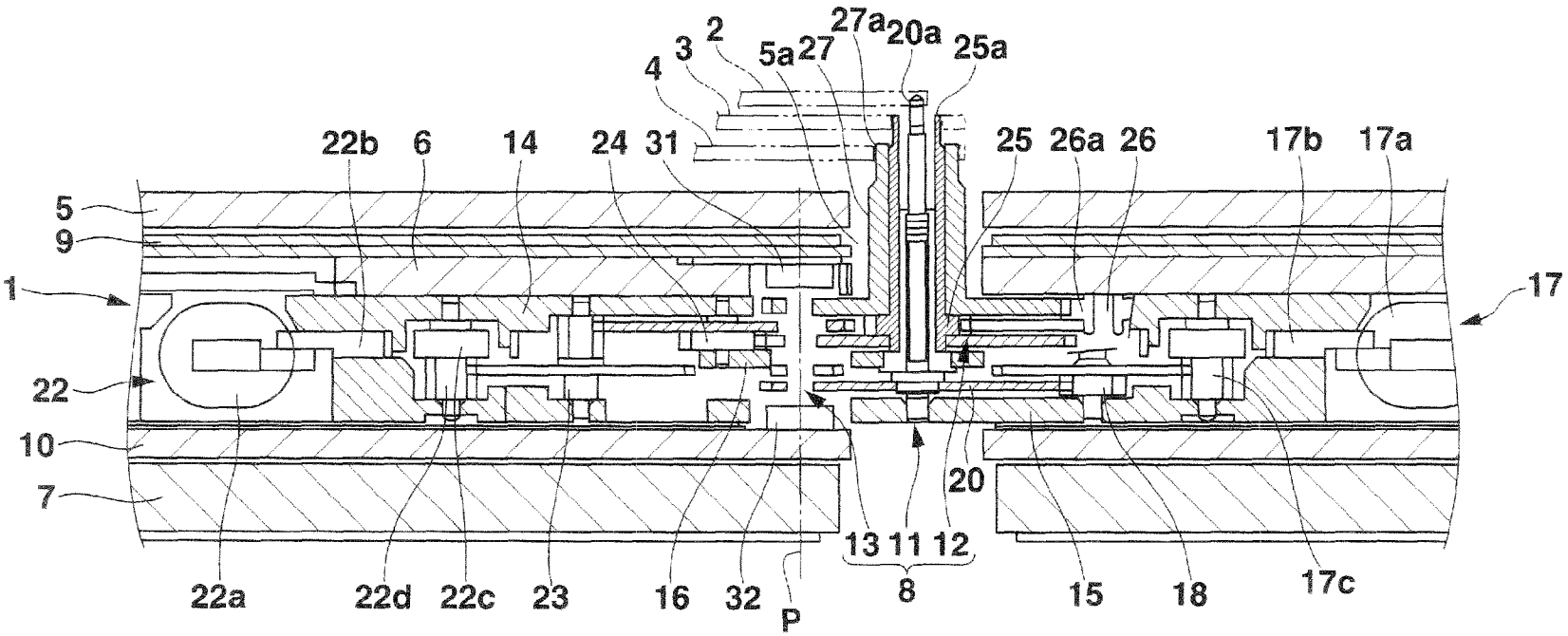
FIG. 2 is an enlarged cross-sectional view of an essential portion of the wristwatch of FIG. 1.

As shown in FIGS. 1 and 2, a hand type wristwatch 1 comprises a seconds hand 2, a center hand 3 and an hour hand 4 which rotate over a dial 5 to indicate time. A glass cover (not shown) covers a case TK of the wristwatch 1, and a back cover (not shown) covers the bottom of the case TK.

As shown in FIG. 2, a watch module within the case TK includes an upper housing 6 and a lower housing 7 between which a watch movement 8 is provided. The dial 5 is provided above the upper housing 6, and a solar panel 9 is provided between the dial 5 and the upper housing 6. A circuit board 10 is provided within the lower housing 7 (on an upper surface of the lower housing 7 in FIG. 2).

As shown in FIG. 2, the watch movement 8 comprises a first driving system 11 which drives the seconds hand 2, a second driving system 12 which drives the center and hour hands 3 and 4, and a detection unit 13 that detects rotational positions of the seconds, center and hour hands 2, 3 and 4. The first and second driving systems 11 and 12 are attached to a main plate 14, a train wheel bridge 15 and a center wheel bridge 16 between the upper and lower housings 6 and 7.

Figure 3:
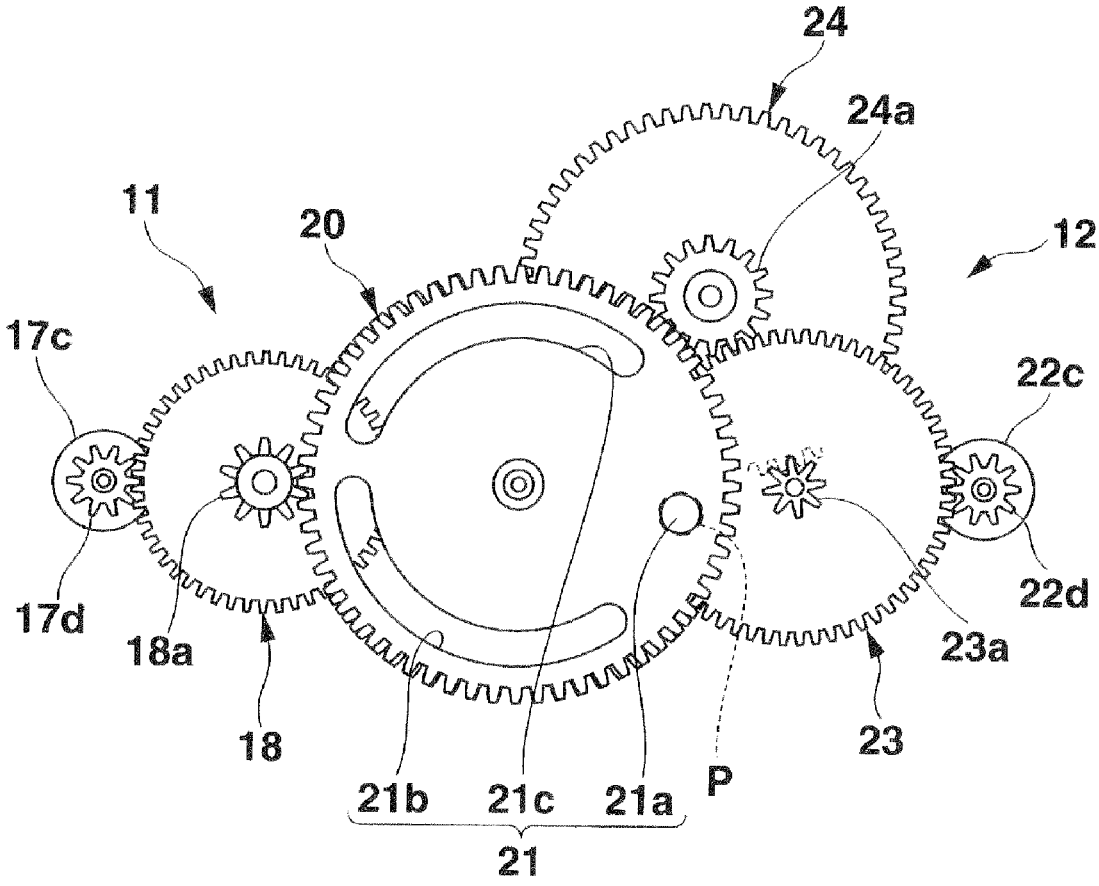
FIG. 3 is an enlarged plan view of an essential portion of a watch movement of FIG. 2.
Figure 4:
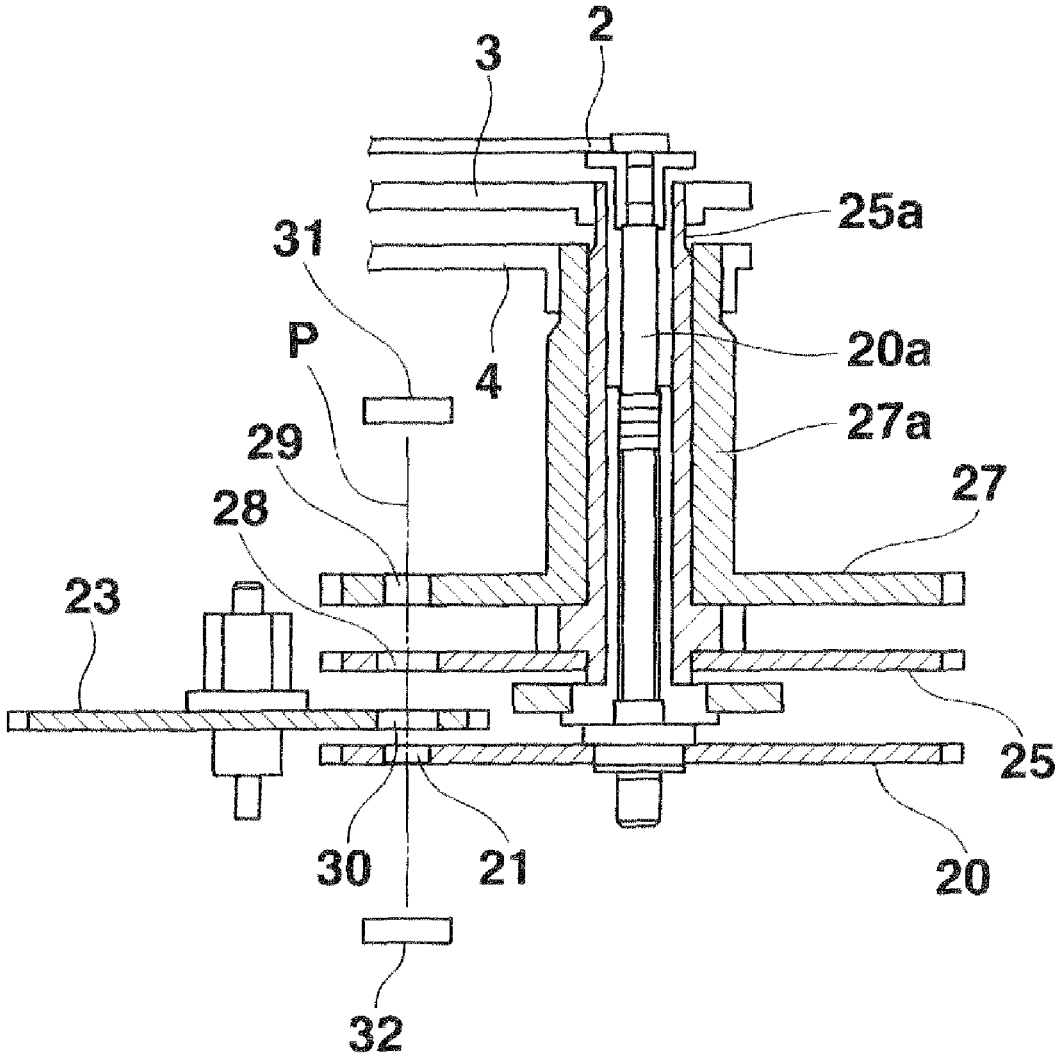
FIG. 4 is an enlarged cross-section view of an essential portion of FIG. 2.

As shown in FIGS. 2 to 4, the first driving system 11 comprises a first stepping motor 17, a fifth wheel 18 rotated by the first stepping motor 17, a fourth wheel or seconds hand wheel (seconds wheel) 20 which is rotated by the fifth wheel 18. The seconds hand 2 is attached to a seconds hand shaft 20*a* of the seconds wheel 20 (see FIG. 4). FIG. The first stepping motor 17 comprises a coil block 17*a*, a stator 17*b* and a rotor 17*c*. When a required current flows through the coil block 17*a*, a magnetic field will be produced, thereby rotating the rotor 17*c* 180 degrees by one step.

Figure 5:
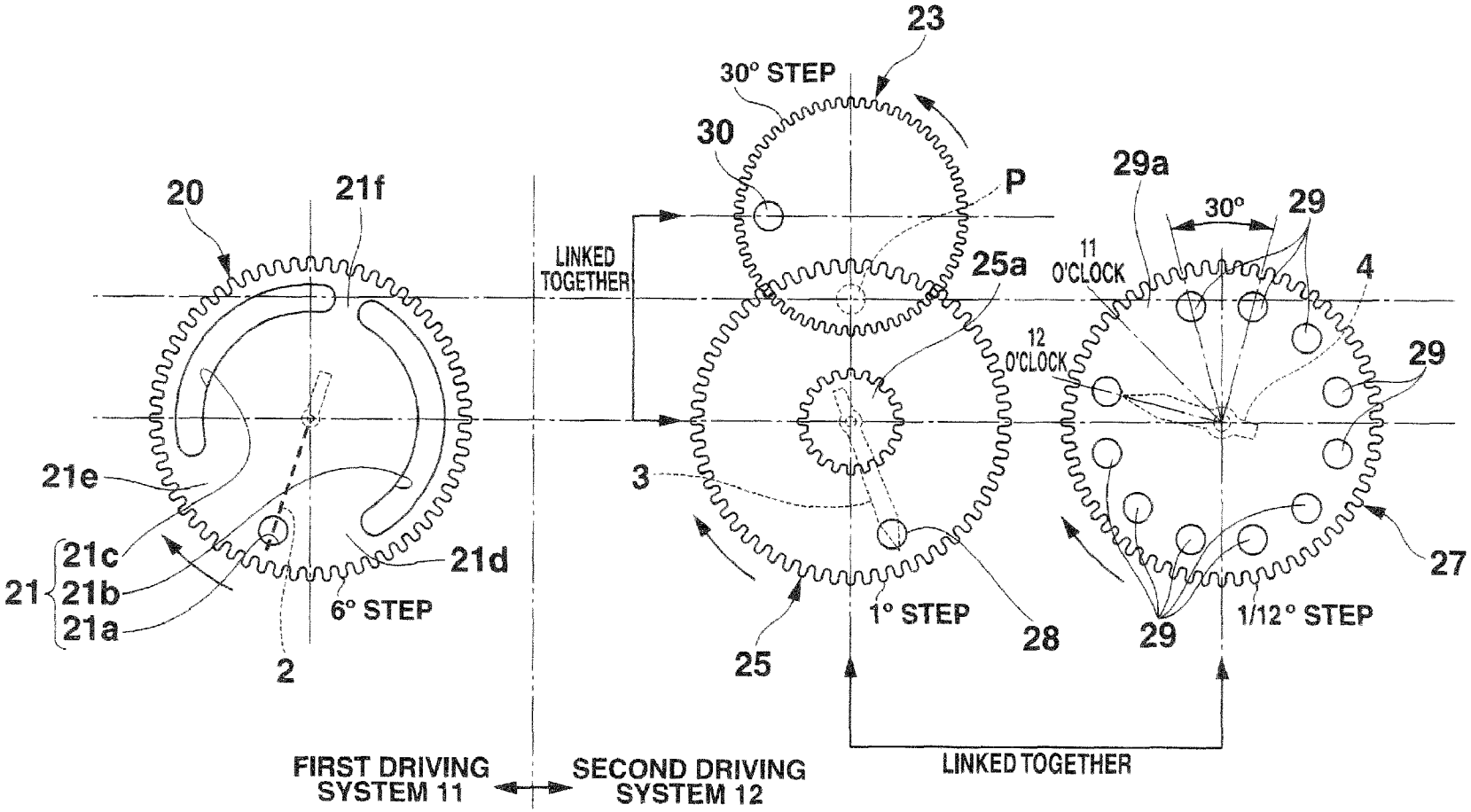
FIG. 5 is an enlarged exploded plan view of an assembly of a seconds wheel, a center wheel and an hour wheel of FIG. 3.
Figure 7:
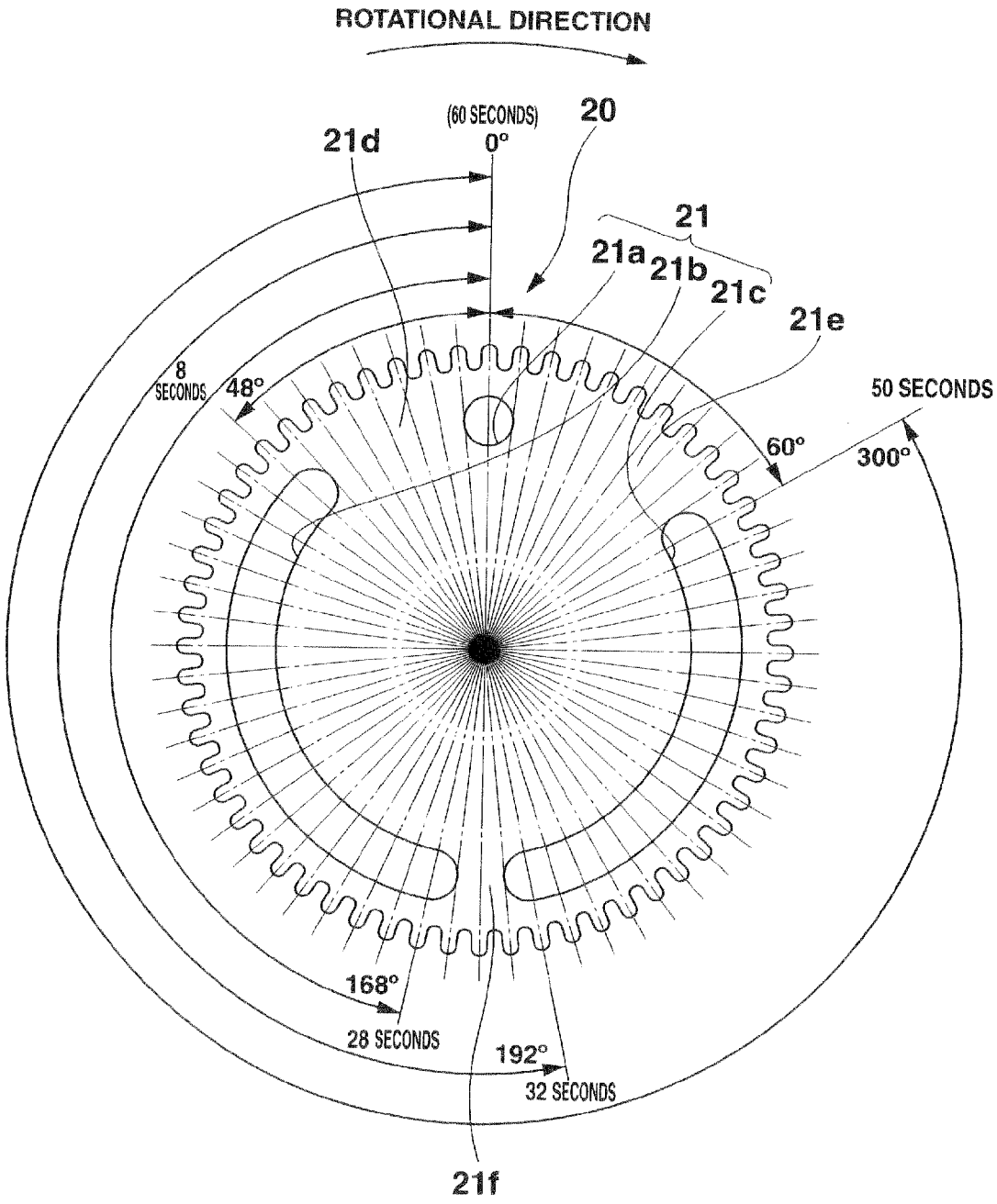
FIG. 7 is an enlarged plan view of the seconds wheel of FIG. 5.
Figure 8:
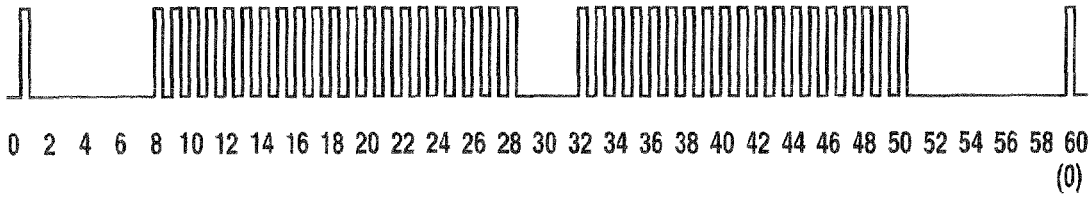
FIG. 8 is a detected pattern of the seconds wheel of FIG. 7 detected by a detection unit.

As shown in FIGS. 2 and 3, the fifth wheel 18 rotates meshing with a pinion 17*d* of the rotor 17*c* of the first stepping motor 17. The seconds wheel 20 rotates meshing with a pinion 18*a* of the fifth wheel 18. The seconds hand shaft 20*a* is attached to a center of the seconds wheel 20. As shown in FIG. 2, the seconds hand shaft 20*a* extends upward through aligned apertures 5*a* which are in the upper housing 6, solar panel 9 and dial 5. As shown in FIG. 4, the seconds hand 2 is attached to a top of the seconds hand shaft 20*a*. As shown in FIGS. 5 and 7, the seconds wheel 20 includes a first light-passing apertures 21 to be described later.

As shown in FIGS. 2 to 5, the second driving system 12 comprises a second stepping motor 22, an intermediate wheel 23 which is rotated by the second stepping motor 22, a third wheel 24 which is rotated by the intermediated wheel 23, a second wheel or center hand wheel (center wheel) 25 rotated by the third wheel 24, a minute wheel 26 which is rotated by the center wheel 25, and an hour hand wheel (hour wheel) 27 which is rotated by the minute wheel 26. The center hand 3 is attached to a center hand shaft 25*a* of the center wheel 25 and the hour hand 4 is attached to an hour hand shaft 27*a* of the hour wheel 27.

As shown in FIG. 2, the second stepping motor 22 comprises a coil block 22*a*, a stator 22*b* and a rotor 22*c*. When a required current flows through the coil block 22*a*, a magnetic field will be produced, thereby rotating the rotor 22*c* by 180 degrees by one step. As shown in FIGS. 2 and 3, the intermediate wheel 23 rotates meshing with a pinion 22*d* of the rotor 22*c* of the second stepping motor 22. As shown in FIG. 5, the intermediate wheel 23 includes a fourth light-passing aperture 30. The third wheel 24 rotates meshing with a pinion 23*a* of the intermediate wheel 23. The center wheel 25 rotates meshing with a pinion 24*a* of the third wheel 24.

As shown in FIGS. 2 and 4, the upwardly protruding center hand shaft 25*a* that is a cylindrical hollow through which the seconds hand shaft 20*a* protrudes rotatably is provided at a center of the center wheel 25. As shown in FIG. 2, the center hand shaft 25*a* extends upward through the apertures 5*a* provided in the upper housing 6, solar panel 9 and dial 5. As shown in FIG. 4, the center hand 3 is attached to a top of the center hand shaft 25*a*. Thus, the center wheel 25 is disposed above the seconds wheel 20 on the same axis as the seconds wheel 20. As shown in FIG. 5, the center wheel 25 includes a second light-passing aperture 28.

As shown in FIG. 2, the minute wheel 26 rotates meshing with a pinion (not shown) of the center wheel 25. The hour wheel 27 rotates meshing with a pinion 26*a* of the minute wheel 26. The upwardly protruding hour hand shaft 27*a* that is a cylindrical hollow through which the center hand shaft 25*a* protrudes rotatably is provided at a center of the hour wheel 27. As shown in FIG. 2, the hour hand shaft 27*a* protrudes upward through the apertures 5*a* provided in the upper housing 6, solar panel 9 and dial 5. As shown in FIG. 4, the hour hand 4 is attached to a top of the hour hand shaft 27*a*. Thus, the hour wheel 27 is disposed above the center wheel 25 on the same axis as the seconds wheel 20 and center wheel 25. As shown in FIG. 5, the hour wheel 27 includes third light-passing apertures 29.

FIG. 6 shows details of components of the first and second driving systems 11 and 12, the details comprising a number of teeth, a rotational angles, pulses per one rotation, a detection aperture, etc. The rotor pinion 17*d* of the rotor 17*c* in the first driving system 11 rotates 180 degrees or one step per pulse. The fifth wheel 18 rotates 36 degrees per pulse (per step of the rotor 17*c* rotation). The seconds wheel 20, i.e., the fourth wheel rotates six degrees per pulse (per step of the rotor 17*c* rotation) thereby rotating 360 degrees by 60 pulses (60 steps of the rotor 17*c* rotation).

The pinion 22*d* of the rotor 22*c* in the second driving system 12 rotates 180 degrees or one step per pulse. The intermediate wheel 23 rotates 30 degrees per pulse (per step of the rotor 22*c* rotation), thereby rotating 360 degrees by 12 pulses (12 steps of the rotor 22*c* rotation). The third wheel 24 rotates four degrees per pulse (per step of the rotor 22*c* rotation). The center wheel 25, i.e., the second wheel rotates one degree per pulse (per step of the rotor 22*c* rotation), thereby rotating 360 degrees by 360 pulses (360 steps of the rotor 22*c* rotation). The minute wheel 26 rotates ⅓ degrees per pulse (per step of the rotor 22*c* rotation). The hour wheel 27 rotates 1/12 degrees per pulse (per step of the rotor 22*c* rotation) and hence rotates 360 degrees by 4320 pulses (4320 steps of the rotor 22*c* rotation).

A hand position detecting device of the wristwatch 1 optically detects positions of the first to fourth light-passing apertures 21, 28, 29 and 30 provided in the seconds wheel 20, center wheel 25, hour wheel 27 and intermediate wheel 23 by a detection unit 13 to determine rotational positions of the seconds wheel 20, center wheel 25, hour wheel 27, and intermediate wheel 23. The detection unit 13, as shown in FIG. 2, includes a light emission element 31 and a photo detection element 32. The light emission element 31 includes a light emitting diode (LED) and is attached to the upper housing 6 at a position where the seconds hand 2, center hand 3 and hour hand 4 overlap together on the same axis and a part of the intermediate wheel 23 also overlaps thereon. The photo detection element 32 includes a phototransistor facing to the light emission element 31 and is provided on the upper surface of the circuit board 10 which is provided in the lower side of the wristwatch 1.

Therefore, when one of the first to fourth light-passing apertures 21, 28, 29 and 30 of the seconds wheel 20 center wheel 25, hour wheel 27 and intermediate wheel 23 overlap together, the photo detection element 32 detects light from the light emission element 31. Thus, the rotational positions of the seconds wheel 20, center wheel 25, and hour wheel 27 are detected. As shown in FIG. 7, the first light-passing apertures 21 include a circular aperture 21*a*, first and second arcuate apertures 21*b* and 21*c* and a third light blocking area 21*f*. The circular aperture 21*a* is provided at a reference point of the seconds wheel 20 (00-second position) between the first and second arcuate apertures 21*b* and 21*c*. The first arcuate aperture 21*b* is spaced from the circular aperture 21*a* by a first light blocking area 21*d* in the opposite direction to which the seconds hand 2 rotates. The second arcuate aperture 21*c* is spaced from the first circular aperture 21 by a second light blocking area 21*e* in the direction to which the seconds hand 2 rotates. The first and second light blocking areas 21*d* and 21*e* have different lengths. A third light blocking area 21*f* is formed between the first and second arcuate apertures 21*b* and 21*c* and opposed to the circular aperture 21*a* on the same diameter.

Figure 16:
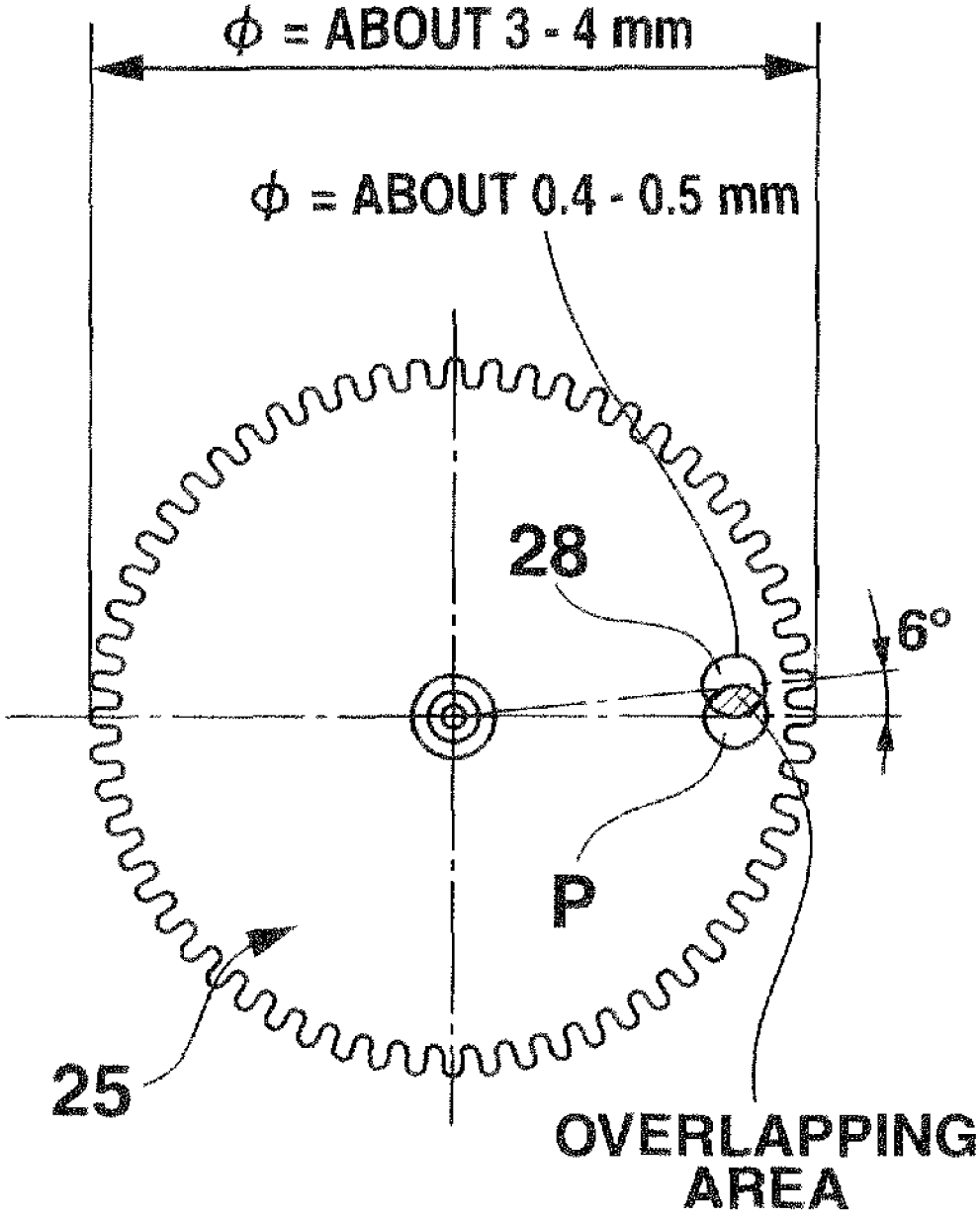
FIG. 16 is an enlarged plan view of a movement quantity of a second light-passing aperture provided in the center wheel relative to a detection position of the detection unit when the center wheel of FIG. 5 rotates by one step (one degree) at a time.

As shown in FIGS. 7 and 16, the seconds wheel 20 has a diameter of approximately 3 to 4 mm, and the circular aperture 21*a* has a diameter of approximately 0.4 to 0.5 mm (about a length of an arc of the seconds wheel 20 with a central angle having 12 degrees). As shown in FIG. 7, the first arcuate aperture 21*b* is formed in an arcuate shape approximately between 48-degree position (8-second position) and 168-degree position (28-second position) from the center of the circular aperture 21*a* (0-degree position) in a counterclockwise direction, to render the same movement locus as the circular aperture 21*a* if rotated. The second arcuate aperture 21*c* is formed in an arcuate shape approximately between 192-degree position (32-second position) and 300-degree position (50-second position) from the center of the circular aperture 21*a* in the counterclockwise direction, to render the same movement locus as the circular aperture 21*a* if rotated.

As shown in FIG. 7, the first light blocking area 21*d* is formed between 0-degree position and 48-degree position from the center of the circular aperture 21*a* in the counterclockwise direction (0-degree position or reference position). Substantially, the first light blocking area 21*d* has a width corresponding to 36 degrees that is three times longer than the diameter of the circular aperture 21*a* (corresponding to 12 degrees).

The second light blocking area 21*e* is formed between 0-degree position and 60-degree position (50-second position) from the center of the circular aperture 21*a* (0-degree position) in the clockwise direction. Substantially, the second light blocking area 21*e* has a width corresponding to 48 degrees that is four times longer than the diameter of the circular aperture 21*a* (corresponding to 12 degrees), namely, longer than the first light blocking area 21*d* by the diameter of the circular aperture 21*a*. The third light blocking area 21*f* is formed in the almost same size as the circular aperture 21*a* between the first and second arcuate apertures 21*b* and 21*c* and opposed to the circular aperture 21*a* on the same diameter.

The first light blocking area 21*d* is diametrically opposed to a part of the second arcuate aperture 21*c*. The second light blocking area 21*e* is diametrically opposed to a part of the first arcuate aperture 21*b*. The third blocking area 21*f* is diametrically opposed to the circular aperture 21*a*. Thus, whenever the seconds wheel 20 rotates 180 degrees (half rotation) from the state in which any one of the first to third light blocking areas 21*d* to 21*f* blocks a detection position P of the detection unit 13 where the light emission element 31 faces the photo detection element 32, any of the circular and the first and second arcuate apertures 21*a*, 21*b* and 21*c* comes to the detection position P.

The seconds wheel 20 rotates by six degrees (one step) at a time (one second). When the detection unit 13 makes light detection at intervals of two seconds until the seconds wheel 20 rotates 60 steps (360 degrees) in 60 seconds, the pattern shown in FIG. 8 will be detected. More particularly, when the seconds wheel 20 is at the position of zero seconds (0 degree), the detection unit 13 detects the circular aperture 21*a*. From two seconds (12 degrees) to six seconds (36 degrees), the first light blocking area 21*d* blocks the detection position P that is a light path in the detection unit 13, and hence the detection unit 13 fails in light detection successively three times.

When the rotation of the seconds wheel 20 is between eight seconds (48 degrees) and 28 seconds (168 degrees), the detection unit 13 continuously detects light through the first arcuate aperture 21*b*. When the seconds wheel 20 rotates 30 seconds (180 degrees), the third light blocking area 21*f* blocks the detection position P, and the detection unit 13 cannot detect light. From 32 seconds (192 degrees) to 50 seconds (300 degrees), the detection unit 13 continuously detects light through the second arcuate aperture 21*c*. From 52 seconds (312 degrees) to 58 seconds (348 degrees), the second light blocking area 21*e* blocks the detection position P, and the detection unit 13 fails in light detection successively four times.

Figure 9:
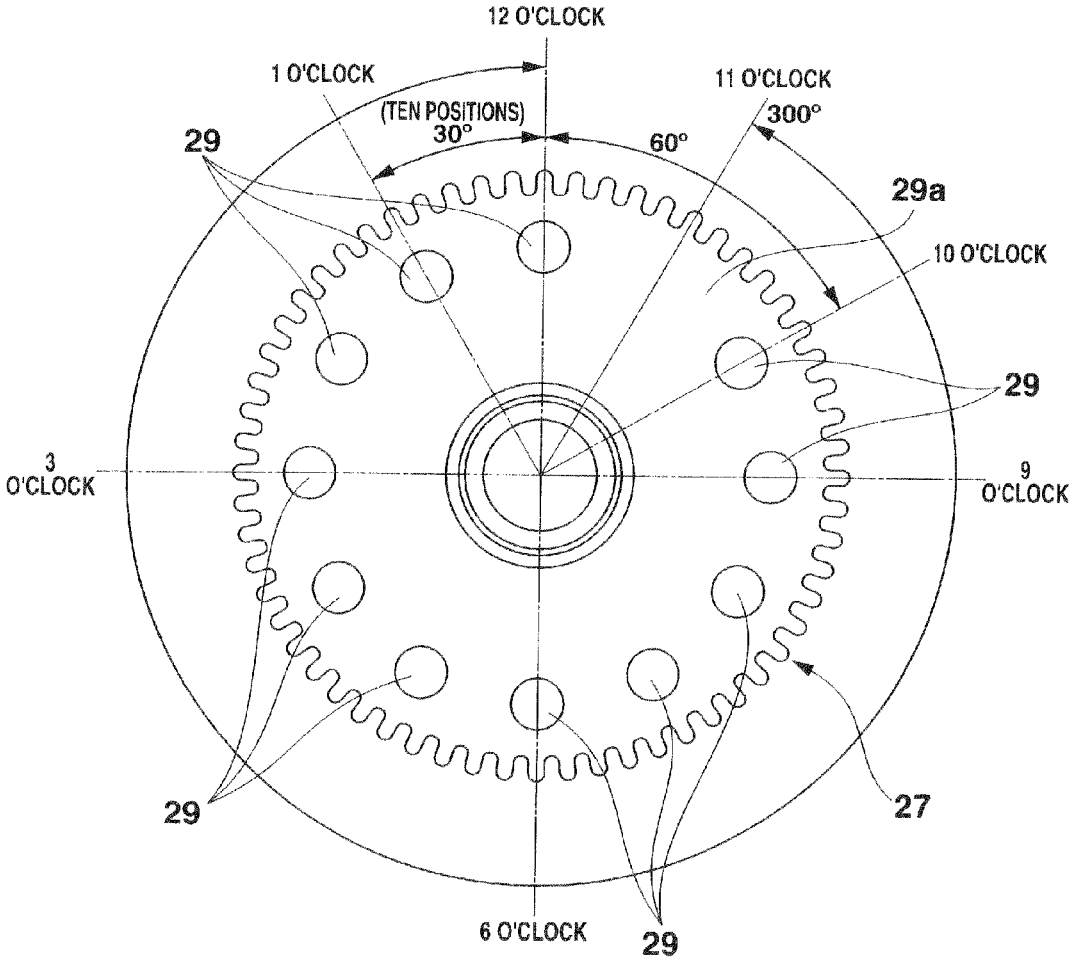
FIG. 9 is an enlarged plan view of the hour wheel of FIG. 5.

As shown by a solid line in FIG. 5, the second light-passing aperture 28 in the center wheel 25 is a circular aperture provided at a reference point (0-degree position) of the center wheel 25. The second light-passing aperture 28 has substantially the same size as the circular aperture 21*a* in the seconds wheel 20 and is provided at a position corresponding to the circular aperture 21*a*. As shown in FIGS. 5 and 9, the third light-passing apertures 29 in the hour wheel 27 includes eleven circular apertures arranged at intervals of 30 degrees from a reference point (0-degree position) of the hour wheel 27 along the periphery. A fourth light blocking area 29*a* is provided at a position of eleven o'clock between the aperture at the reference point and the eleventh aperture (the fourth light blocking area 29*a* is shown at a position of one o'clock in FIG. 9).

As shown in FIG. 9, the third light-passing apertures 29 in the hour wheel 27 are positioned, from the reference point (0-degree position) to the left, at angles of 0 degrees, 30 degrees, 60 degrees, 90 degrees, 120 degrees, 150 degrees, 180 degrees, 210 degrees, 240 degrees, 270 degrees and 300 degrees. That is, the apertures 29 are located at positions of twelve o'clock, one o'clock, two o'clock, three o'clock, four o'clock, five o'clock, six o'clock, seven o'clock, eight o'clock, nine o'clock and ten o'clock in the direction to which the hour hand 4 rotates (in the counterclockwise direction in FIG. 9). The fourth light blocking area 29*a* is provided at the position of eleven o'clock (one o'clock position in FIG. 9). Each of the third light-passing apertures 29 in the hour wheel 27 has substantially the same size as the circular aperture 21*a* in the seconds wheel 20.

As shown in FIG. 5, the fourth light-passing aperture 30 in the intermediate wheel 23 is a circular aperture which can be aligned with the second light-passing aperture 28 in the center wheel 25. The fourth light-passing aperture 30 has substantially the same size as the circular aperture 21*a* of the seconds wheel 20 and the second light-passing aperture 28 of the center wheel 25. The fourth light-passing aperture 30 is provided at a position in the intermediate wheel 23 where the fourth light-passing aperture 30 is aligned with the second light-passing aperture 28 when the aperture 28 comes to the detection position P.

In the second driving system 12, the intermediate wheel 23, center wheel 25 and hour wheel 27 respectively rotate 30 degrees, one degree, and 1/12 degrees per step (half rotation of the rotor 22*c*). Thus, as shown in FIG. 5, one of the third light-passing apertures 29 is aligned with the second light-passing aperture 28 and the fourth light-passing aperture 30 at the detection position P every hour on the hour except eleven o'clock, i.e., at the positions of twelve o'clock, one o'clock, two o'clock, three o'clock, four o'clock, five o'clock, six o'clock, seven o'clock, eight o'clock, nine o'clock and ten o'clock.

The seconds wheel 20 of the first driving system 11 rotates six degrees per step (half rotation of the rotor 17*c*). Every time the seconds wheel 20 rotates 60 steps (60 seconds), the circular aperture 21*a* of the first light-passing aperture 21 comes to the detection position P. Therefore, as shown in FIG. 5, the circular aperture 21*a* is aligned with the second light-passing aperture 28, fourth light-passing aperture 30 and one of the third light-passing apertures 29 every hour on the hour except 11-o'clock.

Hereinafter, description will be made on preconditions for detecting the rotational positions of the seconds, center and hour hands 2, 3 and 4 by the detection unit 13. When the circular aperture 21*a*, the second light-passing aperture 28 and one of the third light-passing apertures 29 are aligned together at twelve o'clock position (in the uppermost position of the wheels 20, 25 and 27 in FIG. 5) and the fourth light-passing aperture 30 is also aligned with the apertures at six o'clock position (in the lowermost position of the wheel 23 in FIG. 5), a light beam from the light emission element 31 is received by the photo detection element 32 through the apertures.

When the light-passing apertures 21*a* and 28 to 30 are aligned together at the detection position P, the photo detection element 32 receives light from the light emission element 31. When any of the light-passing apertures 21*a* and 28 to 30 is offset or away from the detection position P, the light from the light emission element 31 is blocked. Therefore, the photo detection element 32 cannot detect the light.

When rotations of the rotors 17*c* and 22*c* of the first and second stepping motors 17 and 22 are reversed 180 degrees, the first and second stepping motors 17 and 22 rotate the hands by one step. If pulses of opposite polarities are output at every step, the rotors 17*c* and 22*c* rotate. Thus, even when pulses of the same polarity are applied successively to the stepping motors 17 and 22, the rotors 17*c* and 22*c* do not rotate and remain stopped.

For example, in the case where the seconds hand 2 is shifted by one step due to an external factor such as a shock, even when a pulse to rotate the seconds hand 2 is output, the seconds hand 2 does not rotate at that time point, and then, the seconds hand 2 rotates when the subsequent pulse is output. The first stepping motor 17 of the first driving system 11 requires execution of position detection for the seconds wheel 20 at every two steps. Unless the seconds wheel 20 rotates two steps, the circular aperture 21*a* is not completely away from the detection position P due to a relationship between the size of the circular aperture 21*a* and a moving quantity per step of the seconds wheel 20. Thus, execution of the position detection at every two steps (every two seconds) is effective. With the second driving system 12, it is effective that the detection is executed at every step.

Then, referring to FIGS. 10A to 10M, description will be made on a basic operation to detect the reference position (00-second position) of the seconds wheel 20.

Hereinafter, description on the center, hour and intermediate wheels 25, 27 and 23 of the second driving system 12 will be omitted for the sake of simplicity. FIGS. 10A to 10M show a relationship between the detection position P of the detection unit 13 and a rotational position of the seconds wheel 20 when the seconds wheel 20 rotates by two steps (rotational angle of 12 degrees) at a time.

Figure 10A:
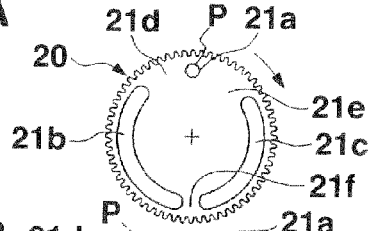
FIGS. 10A, 10B, 10C, 10D, 10E, 10F, 10G, 10H, 10I, 10J, 10K, 10L and 10M show a basic position detecting operation of the seconds wheel of FIG. 7, respectively illustrate states of the seconds wheel which rotates sequentially two steps (12 degrees) at a time.

The reference position of the seconds wheel 20 can be obtained by detecting the reference position (00-second position) of the seconds wheel 20 shown in FIG. 10A, where the circular aperture 21*a* in the seconds wheel 20 comes to the detection position P. At the reference position shown in FIG. 10A, the detection unit 13 can detect light passing through the circular aperture 21*a* located at the detection position P.

Figure 10B:
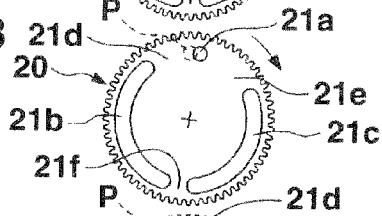
Figure 10C:
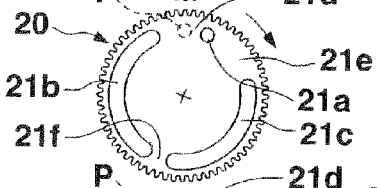
Figure 10D:
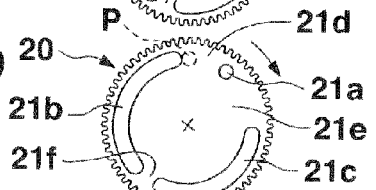

The seconds wheel 20 rotates by two steps in the clockwise direction from the state of FIG. 10A. When the rotational angle of the seconds wheel 20 becomes 12 degrees, the circular aperture 21*a* is shifted away front the detection position P in the clockwise direction and the first light blocking area 21*d* covers the detection position P, as known in FIG. 10B. Thus, the detection unit 13 fails in detecting light, as shown at a point of two seconds in FIG. 8. Likewise, as shown in FIGS. 10C to 10D, until the seconds wheel 20 rotates 36 degrees, the first light blocking area 21*d* continues blocking the detection position P. Thus, the detection unit 13 fails in detecting light successively three times, as shown at points of 3 to 6 seconds in FIG. 8.

Figure 10E:
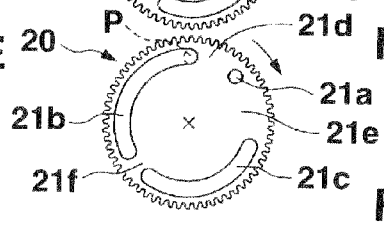
Figure 10F:
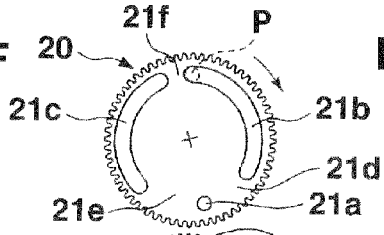

Then, as shown in FIG. 10E, when the seconds wheel 20 further rotates two steps and the rotational angle thereof comes to 48 degrees, a part of the first arcuate aperture 21*b* crosses the detection position P. Thus, as shown at a point of eight seconds in FIG. 8, the detection unit 13 can detect light passing through the second arcuate aperture 12*b*. Until the seconds wheel 20 rotates 168 degrees as shown in FIG. 10F, a part of the first arcuate aperture 21*b* covers the detection position P. Thus, the detection unit 13 continuously detects light passing through the first arcuate aperture 21*b* as shown at points of 10 to 28 seconds in FIG. 8.

Figure 10G:
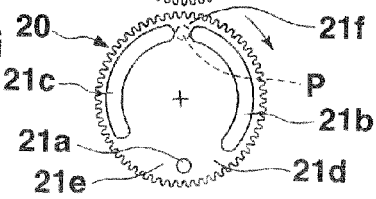
Figure 10H:
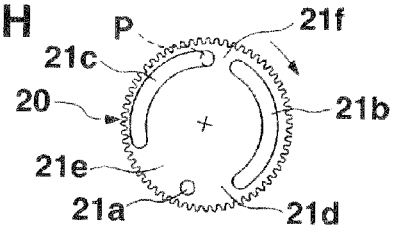

When the seconds wheel 20 rotates further two steps and the rotational angle thereof comes to 180 degree as shown FIG. 10G, the first arcuate aperture 21*b* is moved clockwise away from the detection position P and the third light blocking area 21*f* covers the detection position P. Thus, the detection unit 13 fails in detecting light as shown at a point of 30 seconds in FIG. 8. Then, when the seconds wheel 20 rotates further two steps and the rotational angle thereof comes to 192 degrees as shown in FIG. 10H, a part of the second arcuate aperture 21*c* crosses the detection position P. Thus, as shown at a point of 32 seconds in FIG. 8, the detection unit 13 can detect light passing through the second arcuate aperture 21*c*.

Figure 10I:
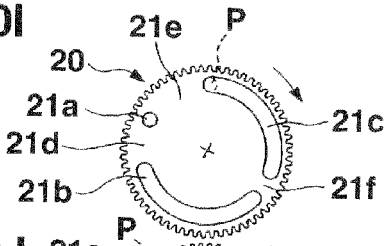
Figure 10J:
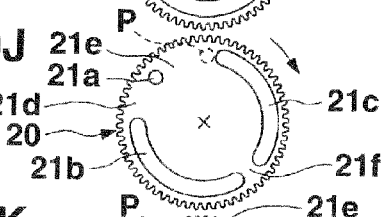

Until the rotational angle of the seconds wheel 20 becomes 300 degrees as shown in FIG. 10I, a part of the second arcuate aperture 21*c* covers the detection position P. Thus, as shown at points of 34 to 50 seconds in FIG. 8, the detection unit 13 continuously detects light passing through the second arcuate aperture 21*c*. When the second arcuate aperture 21*c* is moved clockwise from the detection position P and a part of the second light blocking area 21*e* blocks the detection position P as shown in FIG. 10J, the detection unit 13 cannot detect light, as shown at a point of 52 seconds in FIG. 8.

Figure 10K:
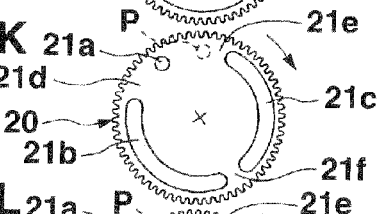
Figure 10L:
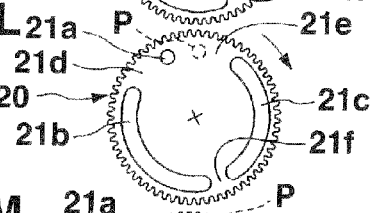
Figure 10M:
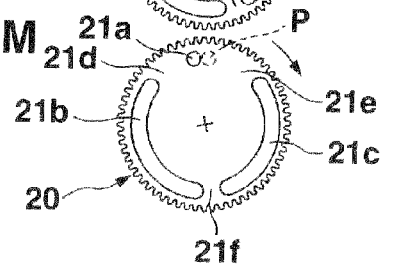

Until the rotational angle of the seconds wheel 20 becomes 348 degrees, a part of the second light blocking area 21*e* covers the detection position P as shown in FIGS. 10K to 10M and the detection unit 13 fails in detecting light. Thus, as shown at points of 5458 seconds in FIG. 8, the detection unit 13 fails in light detection successively four times. When the seconds wheel 20 rotates further two steps from this state and the rotational angle of the seconds wheel comes to 360 degrees, the circular aperture 21*a* is aligned with the detection position P, as shown in FIG. 10A. Thus, as shown at a point of 0 seconds in FIG. 8, the detection unit 13 can detect light passing through the circular aperture 21*a*.

As described above, in the state of FIG. 10A, the detection unit 13 succeeds in light detection. In the states of FIGS. 10B-10D, the detection unit 13 can not detect light successively three times. In the states of FIGS. 10E to 10F, the detection unit 13 can detect light successively. In the state of FIG. 10G, the detection unit 13 fails in light detection. In the states of FIGS. 10H to 10I, the detection unit 13 can detect light successively. In the states of FIGS. 10J to 10M, the detection unit 13 cannot detect light successively four times.

The detection unit 13 fails in light detection in the states of FIGS. 10B to 10D and FIGS. 10J to 10M. When the detection unit 13 performs light detection at intervals of two steps of the seconds wheel rotation, failure of light detection occurs successively three times in the states of FIG. 10B to 10D, whereas failure of light detection occur successively four times in the states of FIG. 10J to 10M. It will be seen that the former and latter cases are different in the number of successive light detection failures. By counting the number of times of successive light detection failure, the reference position of the seconds wheel 20 can be specified as follows.

That is, the detection unit 13 makes the position detection each time the seconds wheel 20 rotates two steps (two seconds). A position, where the detection unit 13 succeeds in light detection after four times of successive detection failure, is determined to be the reference position (00-second position). If detection failure starting from the state of FIG. 10B is observed, three times of detection failure is detected until the state of FIG. 10D, and then the detection unit 13 succeeds in light detection in the state of FIG. 10E. Accordingly, the condition to determine the reference position, i.e., continuous four times of detection failure, is not met, and it will be understood that the current position is not the reference position. This process is the basic operation to detect the reference position of the seconds wheel 20.

Next, referring to FIGS. 11A to 11P, description will be given on a basic operation to detect the reference position of center and hour wheels 25 and 27.

Hereinafter, description of the seconds wheel 20 in the first driving system 11 will be omitted for the sake of simplicity. FIGS. 11A to 11M illustrate one rotation of the intermediate wheel 23 caused by rotation of the center wheel 25, which rotates one step (one degree) at a time. FIGS. 11M to 11N illustrate rotation of 30-degree of the hour wheel 27 caused by 360 steps (360 degrees) of rotation of the center wheel 25. FIGS. 11N to 11O show rotation of the hour wheel 27 for nine hours (ten hours in total). FIGS. 11O to 11P show further one hour of rotation of the hour wheel 27 (eleven hours in total).

Figure 11A:
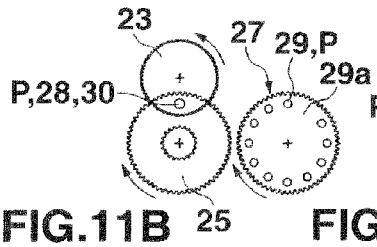

The reference position (0-o'clock 00-minute position) of the center and hour wheels 25 and 27 can be obtained by detecting the reference position P shown in FIG. 11A. That is, a position where the second light-passing aperture 28 in the center wheel 25, one of the light-passing apertures 29 which is at the reference point (0-degree position) (hereinafter, referred to as "reference aperture") in the minute wheel 27, and the fourth light-passing aperture 30 in the intermediate wheel 23 are aligned together at the detection position P is detected as the reference position. FIG. 11A shows the reference position of the wheels.

Figure 11B:
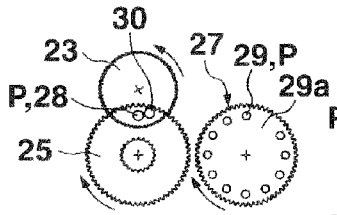
Figure 11C:
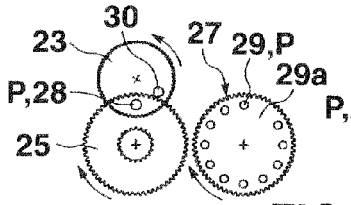
Figure 11D:
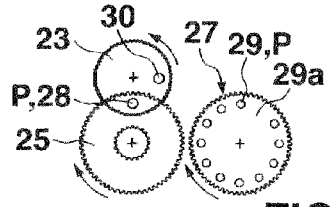
Figure 11E:
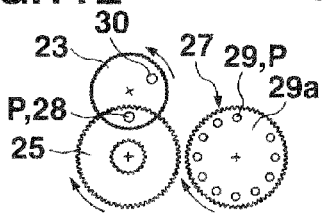
Figure 11F:
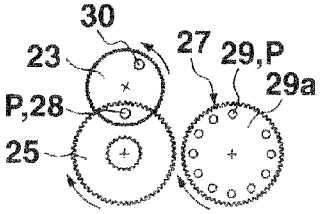

When the center wheel 25 rotates one step (one degree) from the state shown in FIG. 11A, the intermediate wheel 23 rotates 30 degrees and the fourth light-passing aperture 30 of the intermediate wheel 23 is moved away from the detection position P, and the intermediate wheel 23 covers the detection position P of the detection unit 13, as shown in FIG. 11B. The center wheel 25 rotates only one degree in the clockwise direction; therefore, the second light-passing aperture 28 is moved slightly, but not completely away from the detection position P of the detection unit 13. The second light-passing aperture 28 remains in a detectable range of the detection unit 13.

Figure 11G:
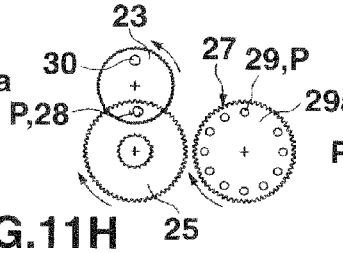
Figure 11H:
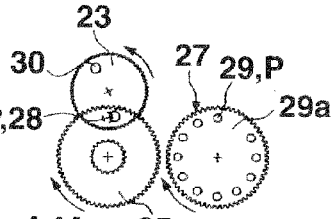
Figure 11I:
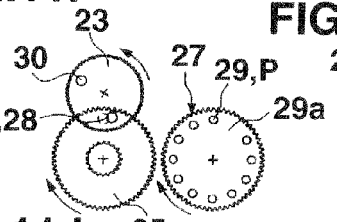
Figure 11J:
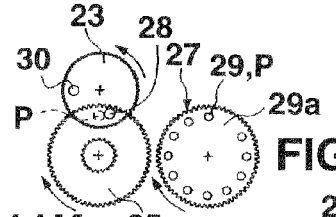
Figure 11K:
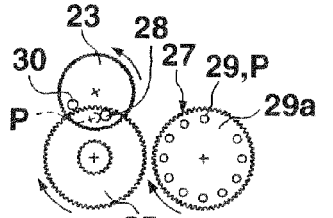
Figure 11L:
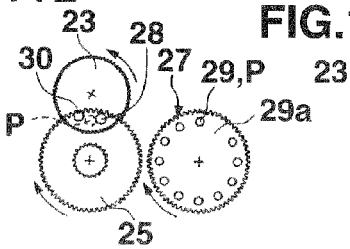
Figure 11M:
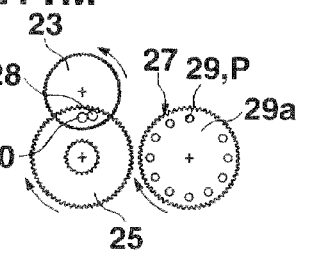
Figure 11N:
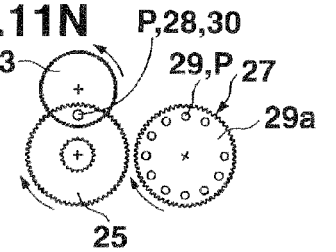
Figure 11O:
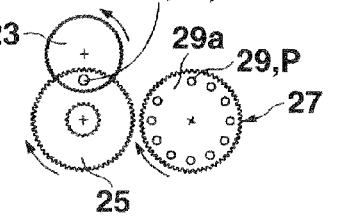

Then, when the center wheel 25 rotates six steps (six degrees) in total, the rotation angle of the intermediate wheel 23 becomes 180 degrees and the fourth light-passing aperture 30 is moved 180 degrees away from the detection position P as shown in FIG. 11G. The intermediate wheel 23 continues covering the detection position P. The center wheel 25 rotates six degrees in the clockwise direction to move the second light-passing aperture 28 from the detection position P by the half of the size of the second light-passing aperture 28. However, the second light-passing aperture 28 remains in the detectable range (see FIG. 16).

Then, when the center wheel 25 rotates 12 steps (12 degrees) in total, the rotation angle of the intermediate wheel 23 becomes 360 degrees and the fourth light-passing aperture 30 comes to the detection position P, as shown in FIG. 11M. The second light-passing aperture 28 in the center wheel 25 is almost completely away from the detection position P. The second light-passing aperture 28 hardly overlaps with the detection position P and the center wheel 25 covers the detection position P; therefore, the detection unit 13 fails in detecting light. The hour wheel 27 rotates only one degree, and the reference circular aperture which one of the third light-passing apertures 29 is only slightly moved from the detection position P and remains in the detectable range of the detection unit 13.

When the center wheel 25 is rotates 360 steps (one rotation) in total, the second and fourth light-passing apertures 28 and 30 in the center and intermediate wheel 25 and 23 are aligned together at the detection position P, as shown in FIG. 11N. The rotational angle of the hour wheel 27 becomes 30 degrees, and the reference aperture is moved away from the detection position P. Therefore, a second circular aperture on the left of the reference circular aperture comes to the detection position P, and the detection unit 13 can detect light passing through the apertures. When the center wheel 25 rotates further 9 hours from the state of FIG. 11N (10 hours in total), the second and fourth light-passing apertures 28 and 30 are aligned together at the detection position P as shown in FIG. 11O, and the rotational angle of the hour wheel 27 becomes 300 degrees. Thus, an eleventh circular aperture from the reference circular aperture comes to the detection position P and the detection unit 13 can detect light passing through the apertures.

Figure 11P:
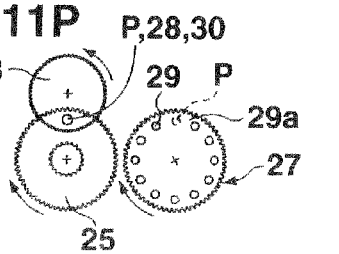

Then, when the center wheel 25 rotates further one hour (11 hours in total), the second and forth light-passing apertures 28 and 30 are aligned together at the detection position P, as shown in FIG. 11P. The hour wheel 27 rotates until 330 degrees and the eleventh circular aperture from the reference circular aperture is moved away from the detection position P. Accordingly, the forth light blocking area 29*a* in the hour wheel 27 covers the detection position P. Thus, the detection unit 13 fails in detecting light. This position of detection failure can be determined as a "11-o'clock 00-minute" position.

When the center wheel 25 rotates further one hour (12 hours in total), the second and fourth apertures 28 and 30 are aligned at the detection position P, as shown in FIG. 11A. The rotation angle of the hour wheel 27 becomes 360 degrees and the fourth light blocking area 29*a* of the hour wheel 27 is moved away from the detection position P. Therefore, a reference circular aperture at the reference position (0-o'clock position), i.e., the third light-passing aperture 29 comes to the detection position P. The center and hour wheels 25 and 27 are returned to the reference position (0-o'clock 00-minute position).

As described above, since the rotational angle of the center wheel 25 per step is quite small, i.e., one degree, one step of the rotation of the center wheel 25 is not enough to move the second light-passing aperture 28 completely away from the detection position P. Therefore, the reference position of the center wheel 25 may not be detected accurately. However, the intermediate wheel 23 rotates 30 degrees per step and this rotational angle per step is large enough to cover the detection position P even if the rotational angle of the center wheel 25 per step is small.

As shown in FIG. 11M, when the intermediate wheel 23 rotates 360 degrees (one rotation) in 12 steps, the center wheel 25 rotates 12 degrees. Thus, the second light-passing aperture 28 in the center wheel 25 is moved completely away from the detection position P and the center wheel 25 covers the detection position P. Even when the fourth light-passing aperture 30 in the intermediate wheel 23 comes to the detection position P, the detection unit 13 fails in detecting light.

Each time the center wheel rotates 360 degrees (one rotation) in 360 steps, the second and fourth light-passing apertures 28 and 30 and any of the third light-passing apertures 29 (aside from the fourth light blocking area 29*a* at 11-o'clock position) come to the detection point P, and the detection unit 13 can detect light passing through the apertures. That is, the detection unit 13 can detect light at a "00-minute position" or the reference position (0-degree position), to which the center wheel 25 returns every time the center wheel 25 rotates 360 degrees (360 steps) regardless of the rotational position of the hour wheel 27 (except 11-o'clock position).

After the reference position (0-degree position) of the center wheel 25 is detected, the center wheel 25 rotates 360 steps (one rotation) at a time, and the hour wheel 27 rotates 30 degrees at a time. Thus, light detection by the detection unit 13 is not required to be executed at each step of the rotation of the center wheel 25. The detection unit 13 may perform light detection only when the center wheel 25 rotates 360 degrees to detect the rotational position of the hour wheel 27. In the case where the center wheel 25 rotates 360 steps at a time from the state of FIG. 11N, when the detection unit 13 fails in light detection at the position where the fourth light blocking area 29*a* covers the detection position P as shown in FIG. 11P, this position is determined as a "11-o'clock 00-minute" position.

When the center wheel 25 rotates further 360 degrees from the "11-o'clock 00-minute" position, the reference circular aperture which is one of the third light-passing apertures 29 in the hour wheel 27 comes to the detection position P and the detection unit 13 can detect light passing through the reference aperture. This position of the center and hour wheels 25 and 27 is determined as the reference position, i.e., "0-o'clock 00-minute" position. Thus, the detection unit 13 performs light detection each time the center wheel 25 rotates 360 degrees (one rotation) after the state in which light detection by the detection unit 13 is possible. After the detection unit 13 fails in detecting light (state in FIG. 11P), when the center wheel 25 rotates 360 degrees (one rotation) and the detection unit 13 succeeds in light detection (state in FIG. 11A), this position of the hour wheel 27 is determined as the reference position, that is, a position of "0-o'clock 00 minute".

Referring to FIGS. 12A to 14F, description will be given on a basic three-hand position detection operation for detecting the positions of the seconds, center and hour hands 2, 3 and 4.

The three-hand position detection operation comprises a combination of the operation to detect the position of the seconds wheel 20 and the operation to detect the position of the center and hour wheels 25 and 27. The three-hand position detection operation can be applied to the following three cases wherein the detecting condition is not satisfied. In the first case, the first light passing apertures 21 in the seconds wheel 20 are out of the detection position P. In the second case, the second light-passing aperture 28 in the center wheel 25 and/or any of the third light-passing apertures 29 in the hour wheel 27 are out of the detection position P. In the third case, the first light-passing apertures 21 are out of the detection position P and the second light-passing aperture 28 and/or the third light-passing apertures 29 are out of the detection position P.

First, referring to FIGS. 12A to 12F, description will be given on the three-hand position detecting process to be applied to the first case, that is, when the first light-passing apertures 21 in the seconds wheel 20 are out of the detection position P.

It is assumed that the state of the seconds wheel 20 is unknown and that the center wheel 25 and the hour wheel 27 are set at the reference position (0-o'clock 00-minute position). The basic operation to detect the reference position of the seconds hand 20 is performed firstly. That is, as described above, the second wheel 20 rotates two steps, and the detection unit 13 performs light detection at every two steps of the rotation.

Figure 12A:
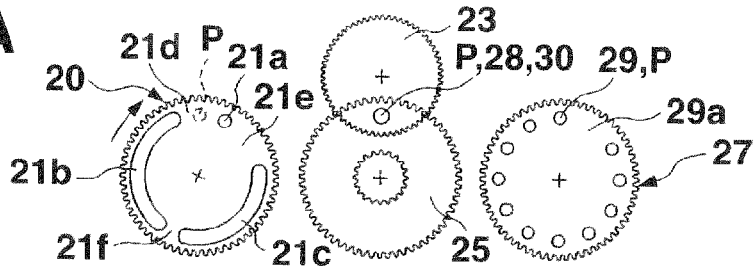
FIGS. 12A, 12B, 12C, 12D, 12E and 12F show a position detecting operation for the seconds wheel of FIG. 5, and illustrate states of the seconds wheel obtained when the seconds wheel which is offset from a reference position is moved to the reference position.

When the seconds wheel 20 rotates two steps and the state shown in FIG. 12A is obtained, the detection unit 13 fails in detecting light. Thus, counting the number of times of detection failure is started. When the detection failure is occurred successively, the number of times of detection failure is sequentially counted up. When the detection unit 13 continuously fails in light detection, the number of times of detection failure is counted up. When the detection unit 13 succeeds in light detection, the counted number is cleared.

Figure 12B:
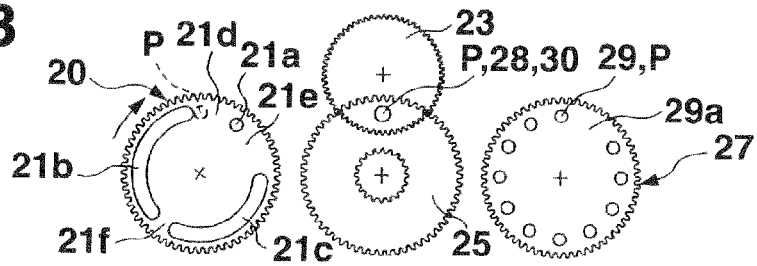
Figure 12C:
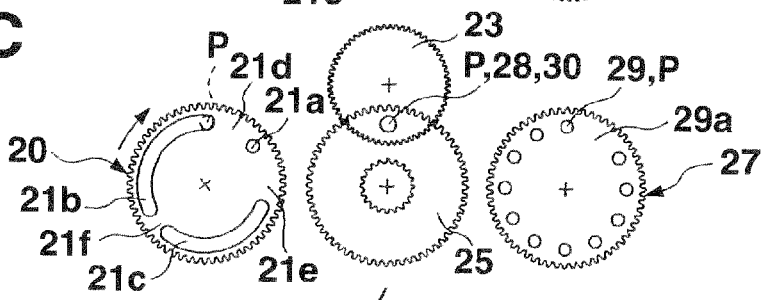
Figure 12D:
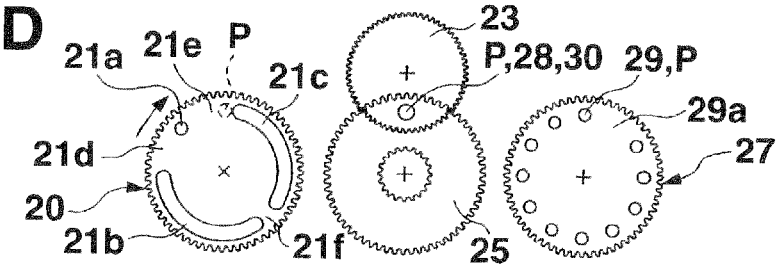

When the seconds wheel 20 rotates further two steps as shown in FIG. 12B, the detection unit 13 fails in detecting light and it is determined that another detection failure is occurred successively. Therefore, the number of times of detection failure is incremented. Then, the seconds wheel 20 rotates further two steps from this state and the detection unit 13 performs light detection. When the detection unit 13 succeeds in detecting light as shown in FIG. 12C, the number of times of detection failure counted so far is cleared.

Figure 12E:
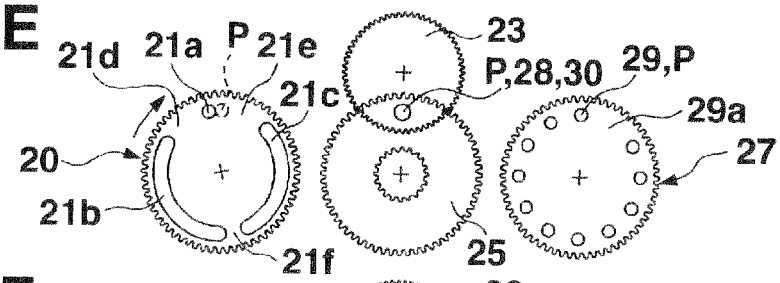

Subsequently, the detection unit 13 tries to detect light every time the seconds wheel 20 rotates two steps. As shown FIG. 12D, when the detection result is changed from the continuous success to detection failure, counting the number of times of detection failure is started again. Thereafter, the detection unit 13 performs light detection each time the seconds wheel 20 rotates two steps to detect four times of successive detection failure as shown in FIG. 12E.

Figure 12F:
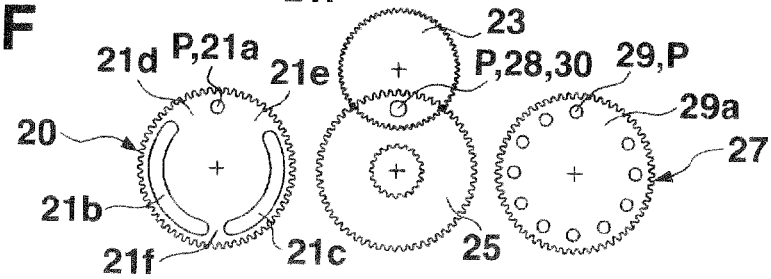

Two steps later, the detection unit 13 detects light and it is determined that the seconds wheel 20 is located at the reference position (00-second position). As shown in FIG. 12F, when the detection unit 13 succeeds in light detection, the circular aperture 21*a* of the first light-passing apertures 21 in the seconds wheel 20 is aligned with the detection position P. As described, the reference position of the seconds wheel 20, i.e., "00-second position" is thus detected.

Then, referring to FIGS. 13A to 13F, description will be given on the three-hand position detecting process to be applied to the second case, that is, when the second light-passing aperture 28 and/or the third light-passing apertures 29 are out of the detection position P.

Even in the case where one of the first light-passing apertures 21 in the seconds wheel 20 is located at the detection position P, when the light-passing apertures in the center and hour wheels 25 and 27 are out of the detection position P, the detection unit 13 fails in detecting light. Therefore, firstly, the basic operation to detect the reference position of the seconds wheel 20 is performed.

The detection unit 13 performs light detection every time the seconds wheel 20 rotates two steps. When the detection result changes from the state shown in FIG. 13A to the state shown in FIG. 13B, the arcuate aperture 21*a* in the seconds wheel 20 comes to the detection position P, and the second light-passing aperture 28 in the center wheel 25 and third light-passing apertures 29 in the hour wheel 30 are off the detection position P. Therefore, the detection unit 13 fails in detecting light. Between the states of FIGS. 13A and 13B, detection failure is occurred sequentially four times.

Figure 13A:
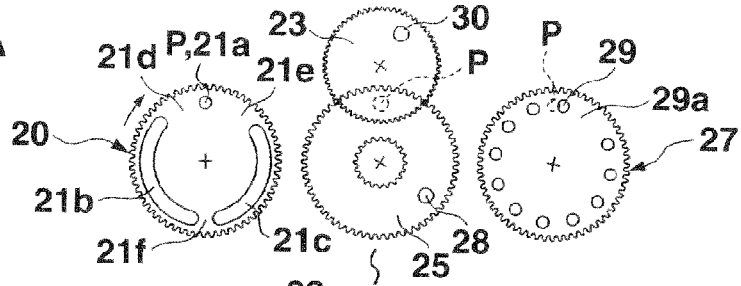
FIGS. 13A, 13B, 13C, 13D, 13E and 13F show a position detecting operation for the center and hour wheels of FIG. 5, and illustrate states of the center and hour wheels obtained when the center and hour wheels which are offset from the reference position are moved to the reference position.
Figure 13B:
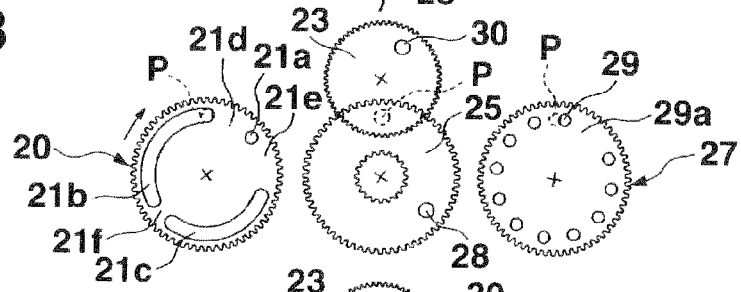
Figure 13C:
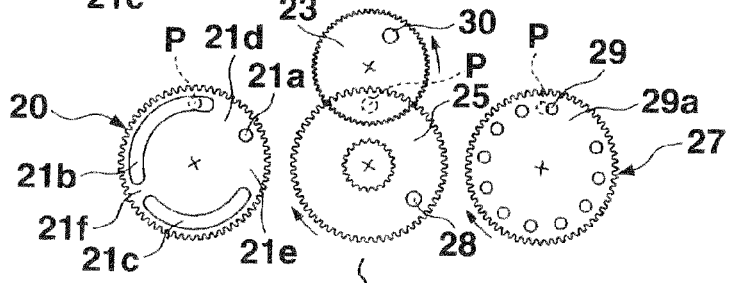
Figure 13D:
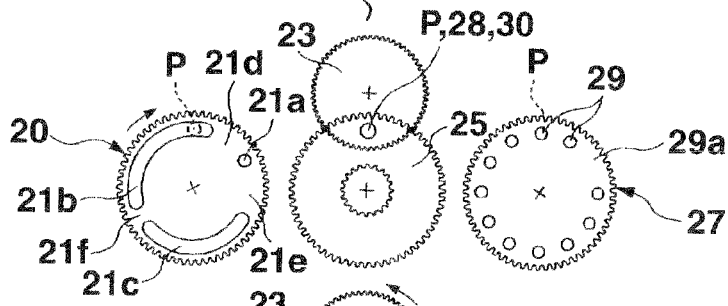

Basically, the reference position of the seconds wheel 20 is detected when the light detection is successful two steps after four times of continuous detection failure, as described above. However, as shown in FIG. 13C, the second light-passing aperture 28 and the third light-passing apertures 29 are out of the detection position P after the seconds wheel 20 rotates two steps; therefore, the detection unit 13 cannot detect light.

As a result, the detection unit 13 fails 1*n* light detection successively five times. The five times of continuous detection failure is not assumed in the operation to detect the reference position of the seconds wheel 20. Accordingly, it can be recognized that the second light-passing aperture 28 in the center wheel 25 is away from the detection position P and/or the third light-passing apertures 29 in the hour wheel 27 are away from the detection position P. In this state, it is uncertain whether or not one of the first light-passing apertures 21 is aligned with the detection position P.

However, it can be recognized that the second light-passing aperture 28 is away from the detection position P and/or the third light-passing apertures 29 are away from the detection position P; accordingly the basic operation to detect the reference position of the center and hour wheels 25 and 27 is performed. The detection unit 13 performs light detection every time the center wheel 25 rotates one step. When the state of the center and hour wheels 25 and 27 changes from that of FIG. 13C to that of FIG. 13D, the second light-passing aperture 28 in the center wheel 25 and the fourth light-passing aperture 30 in the intermediate wheel 23 are aligned together at the detection position P and one of the third light-passing apertures 29 in the hour wheel 27 is also aligned with the detection position P. Thus, the detection unit 13 can detect light passing through the apertures.

Figure 13E:
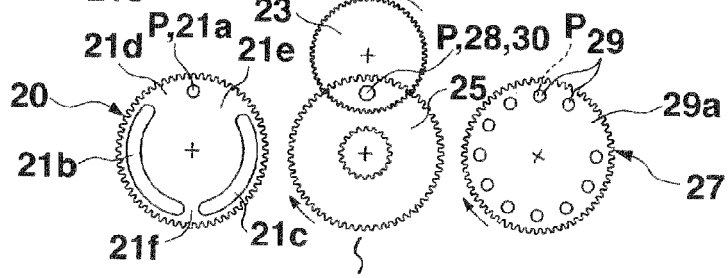
Figure 13F:
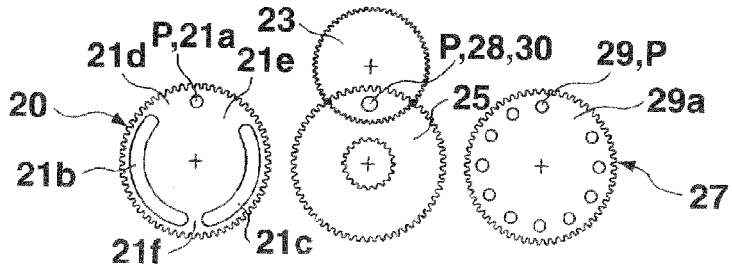

As a result, it can be understood that the center wheel 25 is set at the reference position (00-minute position). However, positions at which the seconds and hour wheels 20 and 27 are set are unknown. As the detection unit 13 can detect light passing through the apertures, the basic operation to detect the reference position of the seconds wheel 20 is performed. The seconds wheel 20 is moved to the reference position (00-minute position) as shown in FIG. 13E. Thus, it is seen that the seconds and center wheels 20 and 25 are set at the reference position (00-minute 00-second position).

Then, the center wheel 25 rotates 360 degrees (one rotation) at a time. Every time the center wheel 25 rotates 360 degrees, the third light-passing apertures 29 in the hour wheel 27 come to the detection position P in turn, and the detection unit 13 detects light passing through the apertures 29. When the center wheel 25 is further rotated 360 degrees from the state (or 11-o'clock position) where the detection unit 13 cannot detect light, the hour wheel 27 is set at the reference position (0-o'clock position). All of the seconds, center and hour wheels 20, 25 and 27 are disposed at the reference position (0-o'clock 00-minute 00-second position).

Next, referring to FIGS. 14A to 14F, description will be given on the three-hand position detecting process to be applied to the third case, that is, when the first light-passing apertures 21 are out of the detection position P and the second light-passing aperture 28 and/or the third light-passing apertures 29 are out of the detection position P.

Figure 14A:
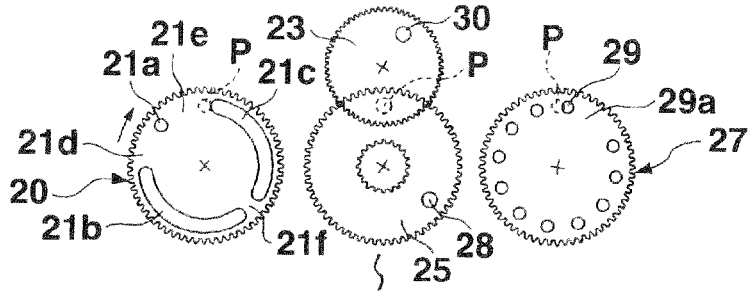
FIGS. 14A, 14B, 14C, 14D, 14E and 14F show a basic position detecting operation for the seconds, center and hour wheels of FIG. 5, and illustrate states of the wheels obtained when the wheels offset from the reference position are moved to the reference position.
Figure 14B:
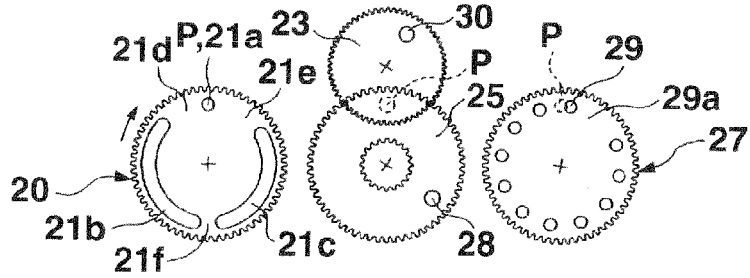

In this case, rotational positions of the seconds, center and hour wheels 20, 25 and 27 are unknown. Thus, the basic operation to detect the reference position of the seconds wheel 20 is firstly performed. That is, starting from the state shown in FIG. 14A, the seconds wheel 20 rotates two steps and the detection unit 13 performs light detection. Even in the case where any of the first light-passing apertures 21 comes to the detection position P, when the second light-passing aperture 28 and/or the third light-passing apertures 29 are out of the detection position P as shown in FIG. 14B, the detection unit 13 fails in detecting light.

Figure 14C:
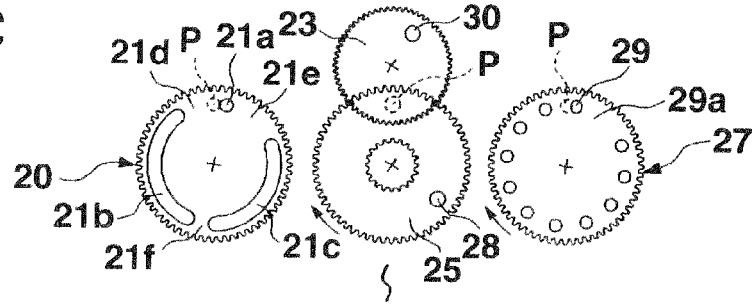

Therefore, the basic operation to detect the reference position of the seconds wheel 20 is further performed. Basically, to detect the reference position of the seconds wheel 20, the seconds wheel 20 rotates two steps and the detection unit 13 performs light detection at every two steps, and when the light detection is successful two steps after four times of continuous detection failure, the reference position of the seconds wheel 20 is detected, as described above. As shown in FIG. 14C, when the detection unit 13 fails in detecting light two steps after four times of continuous detection failure, it is considered that the second light-passing aperture 28 is out of the detection position P and/or the third light-passing apertures 29 are offset from the detection position P. In addition, it is also unknown whether or not one of the first light-passing apertures 21 in the seconds wheel 20 covers the detection position P.

Figure 14D:
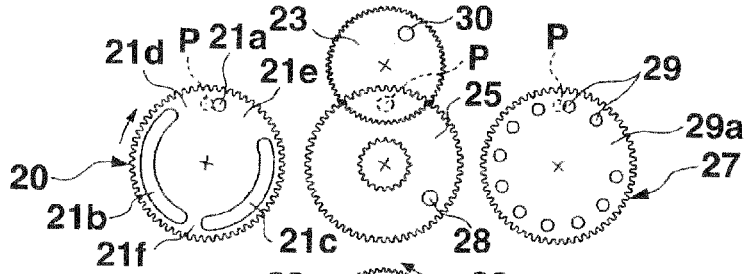

Here, the second light-passing aperture 28 in the seconds wheel 25 is considered being away from the detection position P. The basic operation to detect the reference position of the center and hour wheels 25 and 27 is performed. The center wheel 25 rotates one step at a time and the detection unit 13 performs light detection at every step. When the detection unit 13 fails in detecting light in the case where the center wheel 25 rotates 360 degrees from the state shown in FIG. 14C, the first light-passing apertures 21 in the seconds wheel 20 are considered being out of the detection position P as shown in FIG. 14D. The seconds wheel 20 rotates further 30 steps (180 degrees).

Figure 14E:
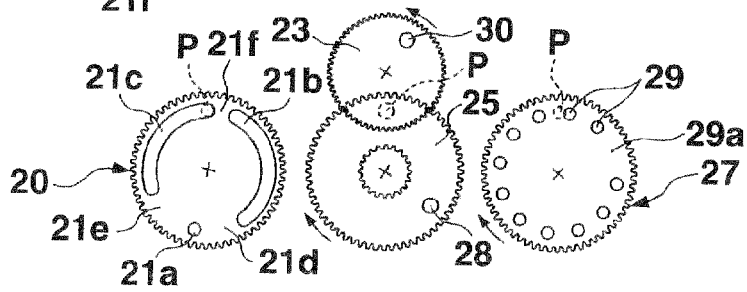
Figure 14F:
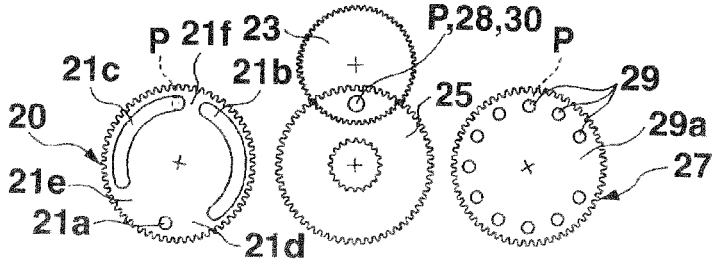

In the case where the first light-passing apertures 21 in the seconds wheel 20 are away from the detection position P, when the seconds wheel 20 rotates 180 degrees (half rotation), one of the first light-passing apertures 21 surely comes to the detection position P as shown in FIG. 14E. Then, the center wheel 25 rotates again one step at a time and the detection unit 13 performs light detection at every step. When the detection unit 13 succeeds in detecting light, the second light-passing aperture 28 in the center wheel 25 is set at the detection position P and the center wheel 25 is positioned at the reference position (00-minute position) as shown in FIG. 14F. The state shown in FIG. 14F is equivalent to the state shown in FIG. 13D; consequently, the above described three-hand position detecting process for the second case described with reference to FIG. 13D and thereafter can be applied to the state of FIG. 14F. The seconds, center and hour wheels 20, 25 and 27 are thus disposed at the reference position.

Referring to FIGS. 15A to 15F, description will be made on a basic hand-position confirming operation to confirm whether or not the seconds, center and hour hands 2, 3 and 4 are set correctly at every hour on the hour in the normal hand rotating operation.

The basic hand-position confirming operation includes confirming whether the seconds hand 2 is correctly located every hour on the hour excluding 11 o'clock and 23 o'clock and it is required to confirm deviation of the seconds hand 2 within 10 seconds. This is because, when ten seconds has elapsed from the hour, the center wheel 25 rotates one step (one degree) by the second stepping motor 22 of the second driving system 12, and as a result, the intermediate wheel 23 rotates 30 degrees to block the detection position P of the detection unit 13.

Figure 15A:
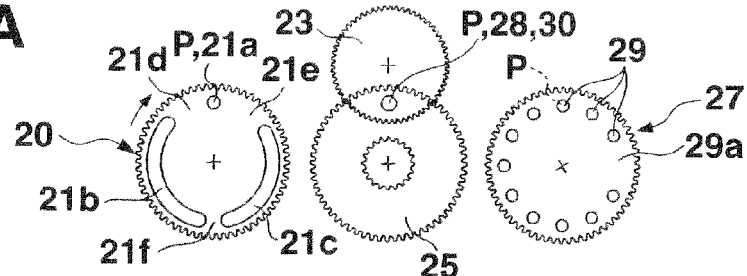
FIGS. 15A, 15B, 15C, 15D, 15E and 15F show a hand position confirming process for confirming every hour on the hour whether the seconds, center and hour hands are positioned correctly or not in normal hand rotating operation, and illustrate operational positions of the seconds, center and hour wheels at every two seconds.

In FIG. 15A, the circular aperture 21*a* of the first light-passing apertures 21 in the seconds wheel 20, the second light-passing aperture 28 in the center wheel 25, one of the third light-passing apertures 29 in the hour wheel 27 (third circular aperture, for example) and the fourth light-passing aperture 30 in the intermediate wheel 23 are aligned together at the detection position P, on the particular hour (2-o'clock, for example) in the normal hand rotating operation. In the normal hand rotating operation, the seconds wheel 20 rotates one step (six degrees) at a time from the state of FIG. 15A. When the seconds wheel 20 rotates one step from the state of FIG. 15A, the circular aperture 21*a* in the seconds wheel 20 is not completely moved away from the detection position P and remains in the detectable range of the detection unit 13.

Figure 15B:
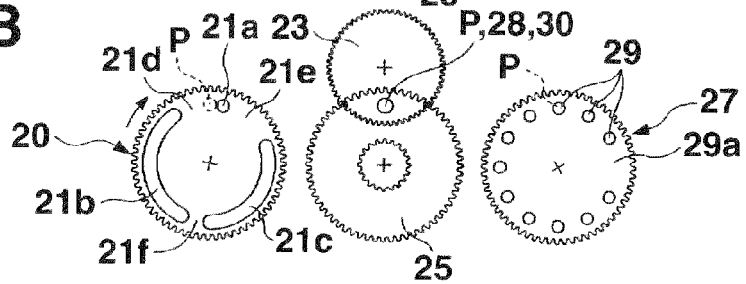

When the seconds wheel 20 rotates further one step (two steps or 12 degrees in total) and comes to a position of 2 seconds (2-second position) shown in FIG. 15B, the circular aperture 21*a* is shifted completely away from the detection position P and the first light blocking area 21*d* covers the detection position P. The detection unit 13 fails to detect light, and counting the number of times of detection failure is started.

Figure 15C:
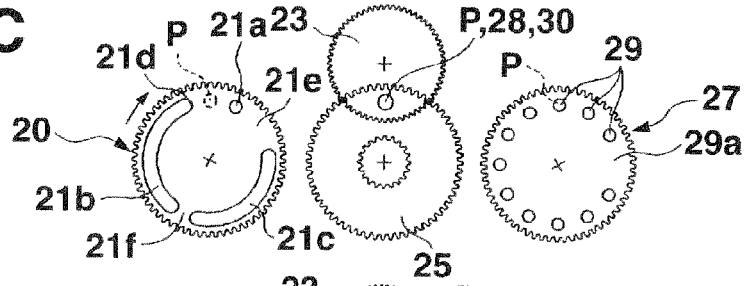
Figure 15D:
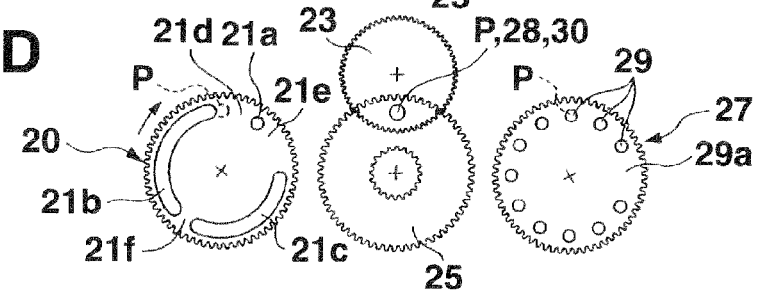

The seconds wheel 20 is further rotated by one step at a time and the detection unit 13 tries to detect light at every two steps. The first light blocking area 21*d* of the seconds wheel 20 continuously covers the detection position P of the detection unit 13 at a 4-second position shown in FIG. 15C and at a 6-second position shown in FIG. 15D. Thus, as shown in FIGS. 15B to 15D, the detection unit 13 fails in detecting light successively three times.

Figure 15E:
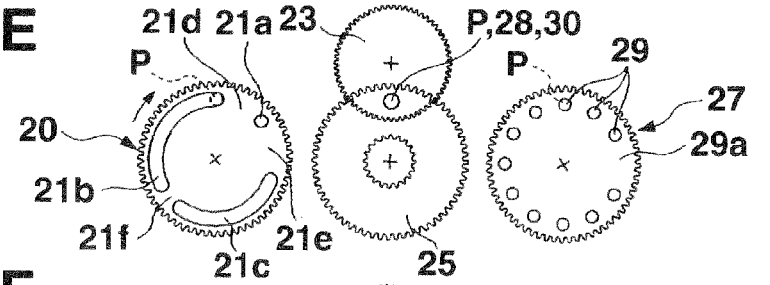

When the seconds wheel 20 rotates further two steps, a part of the first arcuate aperture 21*b* in the seconds wheel 20 covers the detection position P at an 8-second position shown in FIG. 15E. The detection unit 13 succeeds in detecting light and it is determined that the circular aperture 21*a* is positioned at the 8-second position; therefore, it is understood that the seconds wheel 20 rotates correctly and the rotational position of seconds hand 2 is accurate. That is, the detection unit 13 performs light detection at every two steps of the rotation of the seconds wheel 20; when the detection unit 13 succeeds in detecting light after three times of continuous detection failure, it is determined that the seconds hand 2 is located at the 8-second position and the seconds hand 2 rotates correctly.

Figure 15F:
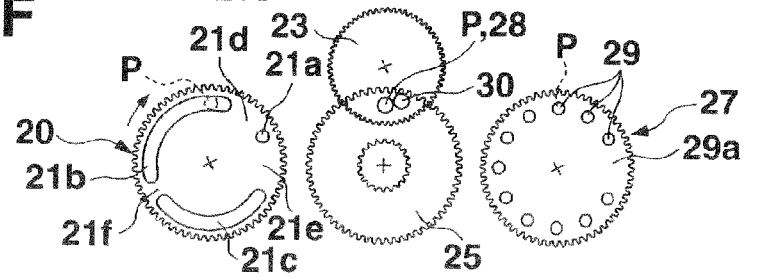

Thereafter, when the seconds wheel 20 rotates further two steps and ten seconds has elapsed, a part of the first arcuate aperture 21*b* in the seconds wheel 20 covers the detection position P through which the light from the light emission element 31 can pass as shown in FIG. 15F. However, since the center wheel 25 rotates one step (one degree) and the intermediate wheel 23 rotates one step (30 degrees), the fourth light-passing aperture 30 in the intermediate wheel 23 is completely away from the detection position P and the intermediate wheel 23 blocks the detection position P even though the second light-passing aperture 28 in the center wheel 25 is not completely away from the detection position P. Accordingly, hand-position adjusting operation is required to be performed within 10 seconds from the hour in the normal hand rotating operation.

Figure 17:
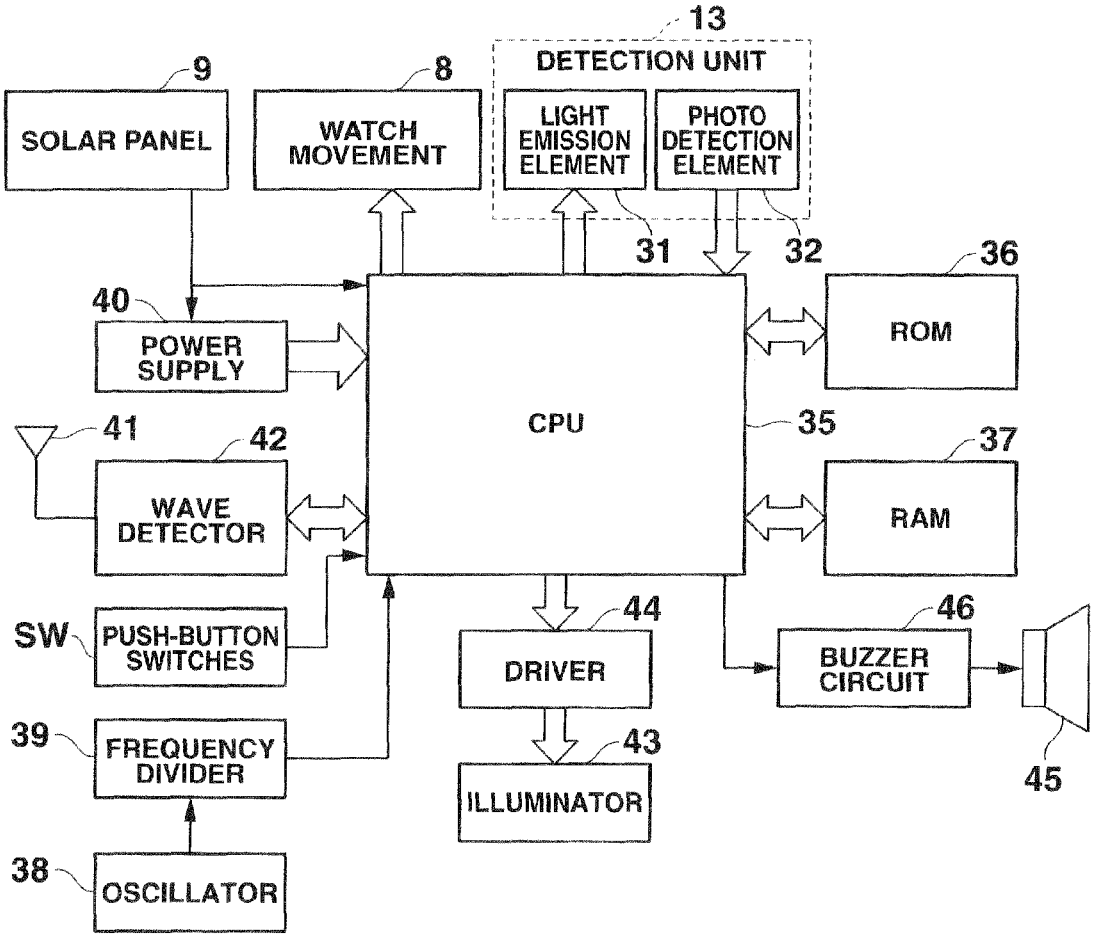
FIG. 17 is a block diagram of a circuit configuration of the wristwatch of this embodiment.

Next, referring to FIG. 17, the circuit configuration of the hand type wristwatch 1 will be described.

The circuit configuration comprises a CPU 35 which controls the whole circuit, a read only memory (ROM) 36 which stores predetermined programs, a random access memory (RAM) 37 which stores data to be processed, an oscillator 38 which generates a pulse signal to operate the CPU 35, a frequency divider 39 which converts a frequency of the pulse occurred by the oscillator 38 to an appropriate frequency to operate the CPU 35, a watch movement 8 which rotates the seconds, center and hour hands 2, 3 and 4 around the dial, and the detection unit 13 which comprises the light emission element 31 and the photo detection element 32 which receives light from the light emission element 31.

The circuit configuration further comprises a power supply 40 which includes a battery to supply power, an antenna 41 which receives the standard radio waves, a wave detector 42 which detects the received standard radio waves, an illuminator 43 which illuminates time indications, a driver 44 which drives the illuminator 43, a speaker 45 which emanates sound, a buzzer circuit 46 which drives the speaker 45, the solar panel 9 which determines whether or not the wristwatch 1 is in darkness, and push-button switches SWs.

Figure 18:
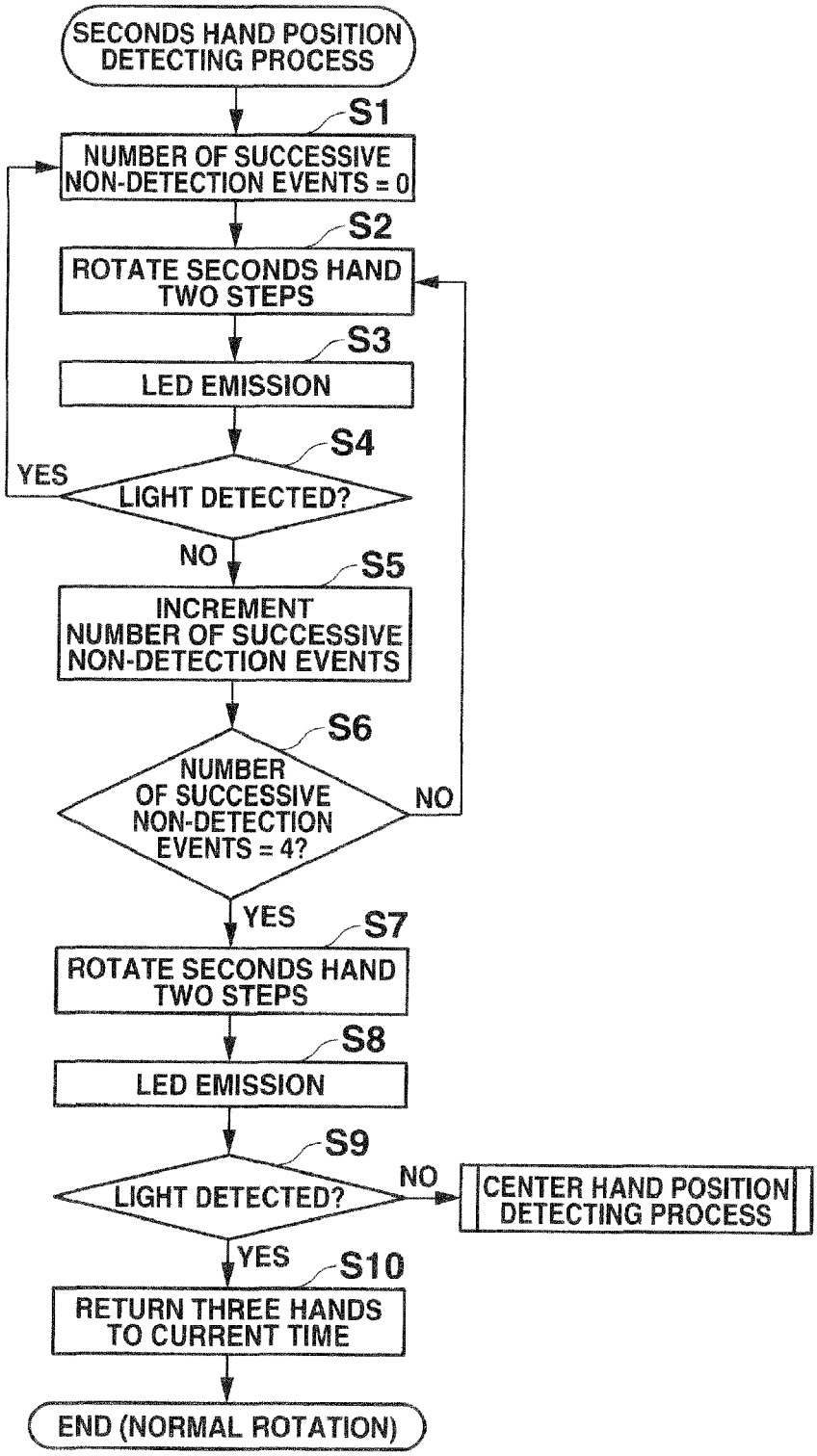
FIG. 18 is a flowchart of a basic seconds hand position detecting process to move the seconds hand to the reference position.

Next, referring to FIG. 18, description will be given on a basic seconds hand position detecting process for detecting the reference position of the seconds hand 2 of the hand type wristwatch 1.

The basic seconds hand position detecting process detects the reference position (00-second position) of the seconds wheel 20 where the circular aperture 21*a* of the first light-passing apertures 21 in the seconds wheel 20 is aligned with the detection position P, as shown in FIG. 10A. It is assumed that in the second driving system 12 the second light-passing aperture 28 in the center wheel 25, the fourth light-passing aperture 30 in the intermediate wheel 23 and one of the third light-passing apertures 29 in the hour wheel 27 are aligned together and stopped at the detection position P.

When the seconds hand position detecting process is started, the number of times of detection failure that is previously counted is cleared and a non-detection flag is to "0" (step S1). The seconds wheel 20 rotates two steps (12 degrees) (step S2). The light emission element 31 of the detection unit 13 is caused to emit light (step S3) and it is determined whether or not the light from the light emission element 31 is received by the photo detection element 32, namely, whether the detection unit 13 succeeds or fails in detecting the light (step S4).

When one of the circular aperture 21*a*, first arcuate aperture 21*b* and second arcuate aperture 21*c* in the seconds wheel 20 covers the detection position P, the photo detection element 32 receives the light from the light emission element 31 through the aperture and it is determined that the detection unit 13 succeeds in light detection. Then, the flow returns to step S1 and the above processing of steps S1 to S4 is repeated until one of the light blocking areas 21*d* to 21*f* in the seconds wheel 20 blocks or covers the detection position P.

As the seconds wheel 20 rotates by two steps at a time, when the apertures 21*a*, 21*b* and 21*c* in the seconds wheel 20 are offset from the detection position P and one of the light blocking areas 21*d* to 21*f* in the seconds wheel 20 covers the detection position P, the photo detection element 32 receives no light from the light emission element 31. That is, the detection unit 13 fails in detecting light, and the non-detection flag is set to "1" and the number of times of detection failure is incremented by one (step S5). Then, it is determined whether or not the detection unit 13 fails in detecting light successively four times (step S6).

As described above, when the detection unit 13 detects light after four times of detection failure as shown in FIGS. 10J to 10M and FIG. 10A, it can be determined that the seconds wheel 20 is positioned at the reference position. For example, in the case where the light blocking area 21*d* of the seconds wheel 20 covers the detection position P in the states of FIGS. 10B to 10D and the detection unit 13 fails in light detection successively three times; when the seconds wheel 20 rotates further two steps; a part of the first arcuate aperture 21*b* in the seconds wheel 20 comes to the detection position P and the detection unit 13 succeeds in detecting light. Then, the flow returns to step S2 to repeat the processing of steps S1 to S6.

In the state shown in FIG. 10G, the third light blocking area 21*f* of the seconds wheel 20 covers the detection position P; therefore, the detection unit 13 detects no light. When the seconds wheel 20 rotates further two steps, a part of the second arcuate aperture 21*c* in the seconds wheel 20 comes to the detection position P, and the detection unit 13 detects light. Thus, the flow returns to step S2 to repeat the above processing. When the seconds wheel 20 rotates from the state of FIG. 10J to that of FIG. 10M, the light blocking area 21*e* of the seconds wheel 20 covers the detection position P, and the detection unit 13 fails in detecting light successively four times.

Thereafter, the seconds wheel 20 rotates further two steps (step S7), and the light emission element 31 emits light (step S8). It is determined whether or not the light from the light emission element 31 is received by the photo detection element 32 (step S9). If yes, it is determined that the circular aperture 21*a* in the seconds wheel 20 is located at the detection position P and the seconds wheel 20 is positioned at the reference position (00-second position). Then, a hand position correction is performed and the positions of the seconds, center and hour hands 2, 3, and 4 are returned to the current time (step S10). Thereafter, operation of the wristwatch 1 is returned to its normal hand rotating operation, and the process is terminated.

In step S9, it is assumed that the second and fourth light-passing apertures 28 and 30 and relevant one of the third light-passing apertures 29 are aligned together and stopped at the detection position P. Thus, the detection unit 13 necessarily can detect light. However, if any of the apertures 28, 29 and 30 is offset or away from the detection position P, the detection unit 13 detects no light and a center hand position detecting process (see FIG. 19) to be described is executed.

Figure 19:
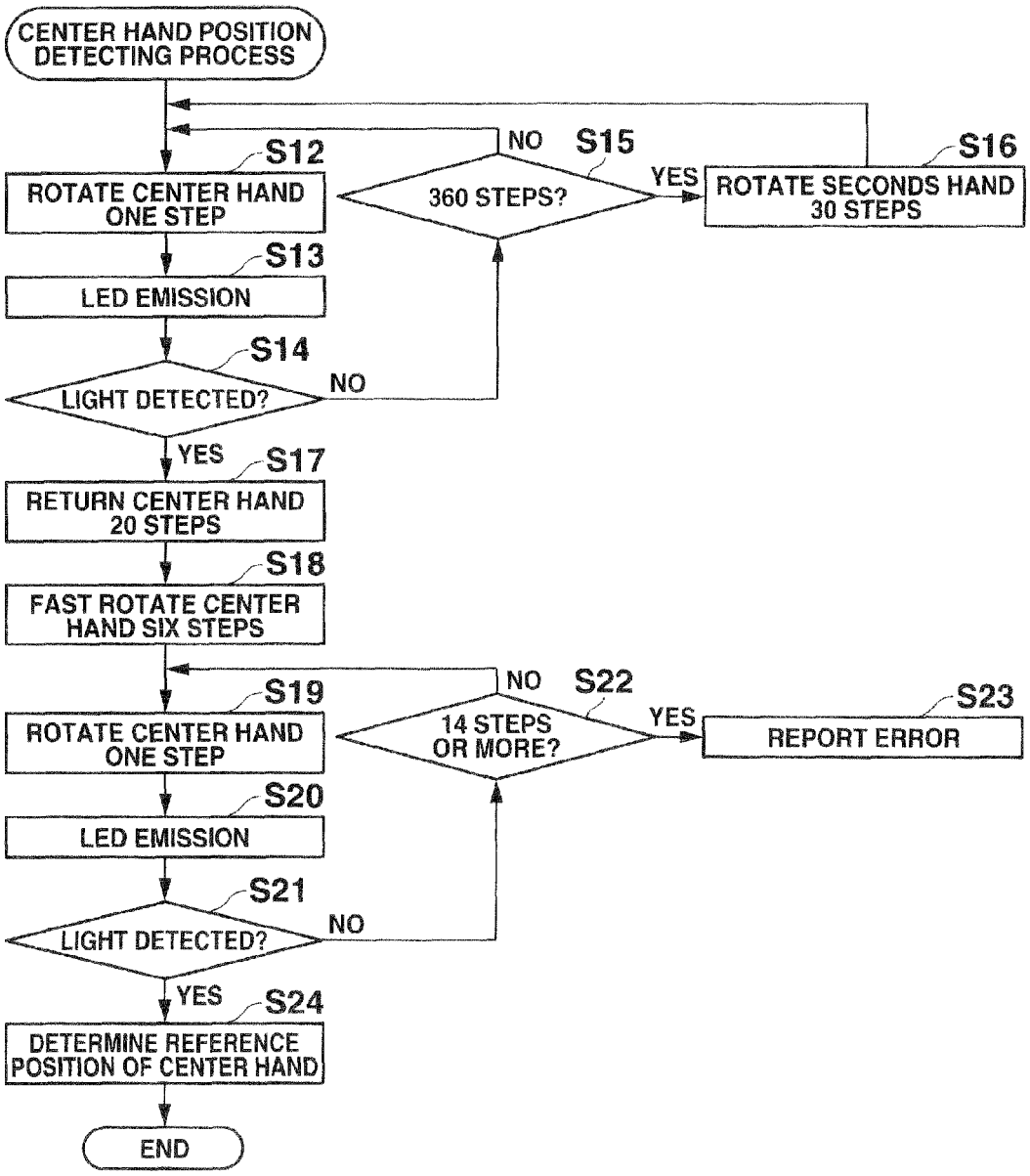
FIG. 19 is a flowchart of a basic center hand position detecting process to move the center hand to the reference position.

Referring to FIG. 19, description will be made on a basic center hand position detecting process for detecting the reference position of the center hand 3 of the hand type wristwatch 1.

The center hand position detecting process detects the reference position (00-minute position) of the center wheel 25 where the second and fourth light-passing apertures 28 and 30 in the center and intermediate wheels 25 and 23 are aligned together at the detection position 2, as shown in FIG. 11A. It is assumed that one of the third light-passing apertures 29 in the hour wheel 27 is also aligned with the detection position P.

When the center hand position detecting process is started, the center wheel 25 rotates clockwise one step or one degree (step S12), the light emission element 31 emits light (step S13), and it is determined whether or not the light from the light emission element 31 is received by the photo detection element 32 (step S14). If no, processing of steps S12 to S14 is repeated until the seconds wheel 25 rotates 360 degrees (one rotation; one hour) (step S15).

Even after the center wheel 25 rotates 360 degrees (one hour), when the detection unit 13 fails in detecting light, it is determined that the first light-passing apertures 21 in the seconds wheel 20 are away from the detection position P. Thus, the seconds wheel 20 rotates 30 steps (180 degrees), to locate one of the first light-passing apertures 21 at the detection position P (step S16). Then, the processing of steps S12 to S15 is repeated until the seconds wheel 25 rotates further 360 degrees.

When the detection unit 13 succeeds in detecting light in step S14, it is determined that the center wheel 25 is set at the reference position (00-minute position). However, it is necessary to confirm whether this determination is correct or not. For example, when the intermediate wheel 23 rotates 360 degrees and returned to the reference position and the center wheel 25 rotates 12 steps to move the second light-passing aperture 28 away 12 degrees from the detection position P as shown in FIG. 11M, the photo detection element 32 may erroneously receive light passing through the second and fourth light-passing apertures 28 and 30 in the center and intermediate wheels 25 and 23 due to a manufacturing error or assembly error present in the second light-passing aperture 28 or fourth light-passing aperture 30.

The center wheel 25 is returned 20 steps counterclockwise from the rotational position where the light passing through the apertures is detected by the detection unit 13 in step S14 (step S17), that is, the center wheel 25 is returned more than 14 degrees for the second light-passing aperture 28 to be moved almost completely away from the detection position P. Then, the center wheel 25 fast rotates six steps in the clockwise direction (step S18). Therefore, any possible backlash between the center and intermediate wheels 25 and 23 is eliminated, and the center wheel 25 is reversed by 14 steps from a position where the successful light detection is brought about.

It is assumed that, when the center wheel 25 is returned 14 steps counterclockwise from the reference position, the second light-passing aperture 28 in the center wheel 25 is completely away from the detection position P of the detection unit 13. The center wheel 25 again rotates clockwise one step from the returned position (step S19). The light emission element 31 of the detection unit 13 emits light (step S20). Then, it is determined whether or not the light from the Light emission element 31 is received by the photo detection element 32, namely, whether the detection unit 13 succeeds or fails in light detection (step S21).

When the detection unit 13 detects no light, the processing of steps S19 to S21 is repeated until the center wheel 25 rotates 14 steps (step S22). It is naturally assumed that the detection unit 13 detects light in step S21 within 14 steps. However, if the detection unit fails in detecting light over 14 steps, a hand position detection error is reported by means of a stop position of the seconds hand 2 or buzzer sound (step S23). When the detection unit 13 detects light in step S21, the position of the center wheel 25 is determined to be the reference position (00-minute position) (step S24). Then, this process is terminated.

Figure 20:
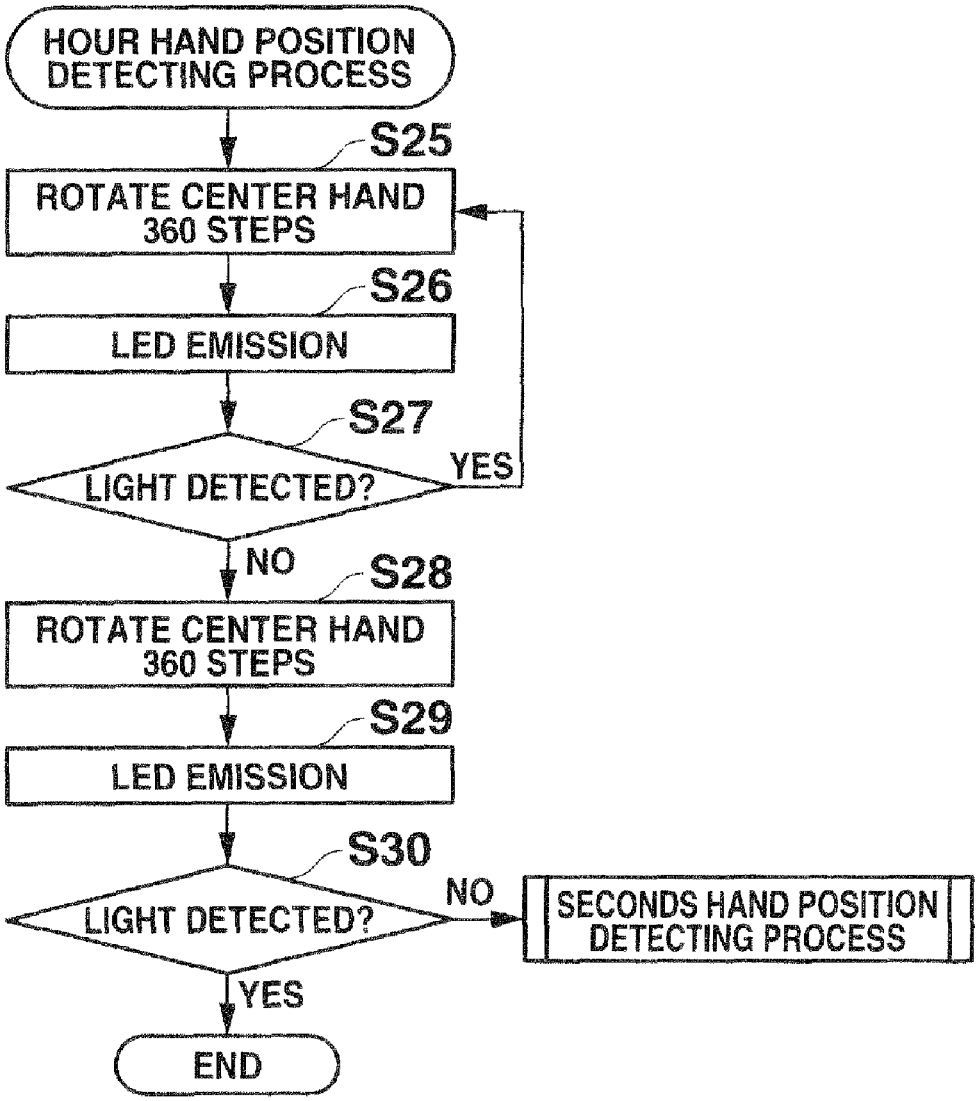
FIG. 20 is a flowchart of a basic hour hand position detecting process to move the hour hand to the reference position.

Next, referring to FIG. 20, description will be made on a basic hour hand position detecting process for detecting the reference position of the hour hand 4 of the hand type wristwatch 1.

The hour hand position detecting process involves detecting the reference position of the hour wheel 27 (0-o'clock position). As shown in FIG. 11A, the position where the reference circular aperture of the third light-passing apertures 29 in the hour hand 27, the second light-passing aperture 28 in the center wheel 25 and the fourth light-passing aperture 30 in the intermediate wheels 23 are aligned together at the detection position P is detected. It is assumed that the center hand 25 is set at the reference position and one of the first light-passing apertures 21 in the seconds wheel 21 of the first driving system is aligned with the detection point P.

When the hour hand position detecting process is started, the center wheel 25 which is set at the reference position (i.e., the second light-passing aperture 28 is positioned at the detection position P) rotates 360 degrees and the hour wheel 27 rotates 30 degrees (step S25). The light emission element 31 of the detection unit 13 emits light (step S26). It is determined whether or not the light from the light emission element 31 is detected by the photo detection element 32 and it is determined whether or not one of the third light-passing apertures 29 in the hour wheel 27 comes to the detection position P to allow the detection unit 13 detecting the light (step S27).

The hour wheel 27 includes the third light-passing apertures 29, which includes eleven circular apertures which are spaced at angular intervals of 30 degrees, and the fourth light blocking area 29*a* at the 11-o'clock position. When the center wheel 25 rotates 360 degrees and the hour wheel 27 rotates 30 degrees, the third light-passing apertures 29, in turn, come to the detection position P except the fourth light blocking area 29*a* as shown in FIGS. 11N to 11O to allow the detection unit 13 detecting light. When the detection unit 13 detects light in step S27, the flow returns to step S25. The processing of steps S25 to S27 is repeated, as the third light-passing apertures 29 successively comes to the detection point P, until the fourth light blocking area 29*a* of the hour wheel 27 covers the detection position P.

As shown in FIG. 11P, when the fourth light blocking area 29*a* of the hour wheel 27 covers the detection position P and the detection unit 13 fails in detecting light, it is determined that the hour wheel 27 is set at the 11-o'clock position. The center wheel 25 rotates further 360 degrees and the hour wheel 27 rotates further 30 degrees (step S28). The light emission element 31 emits light (step S29), and it is determined whether or not the light from the light emission element 31 is detected by the photo detection element 32, namely, whether the detection unit 13 succeeds or fails in detecting light (step S30).

In step S30, the reference circular aperture of the third light-passing apertures 29 in the hour wheel 27 is naturally set at the detection position P as shown in FIG. 11A, and the detection unit 13 detects light. Thus, it is confirmed that the hour wheel 27 is set at the reference position (0-o'clock position), and this process is terminated. It is assumed that one of the first light-passing apertures 21 in the seconds wheel 20 is set at the detection position P in step S30, and the detection unit 13 should succeed in detecting light. However, if the detection unit 13 fails in detecting light, it is determined that the first light-passing apertures 21 are out of the detection position P, and the above-described seconds hand position detecting process is executed.

Referring to FIGS. 21 to 24, description will be made on a basic three-hand position detecting process for detecting the reference position of the seconds, center and hour hands 2, 3 and 4 of the hand type wristwatch 1.

Figure 21:
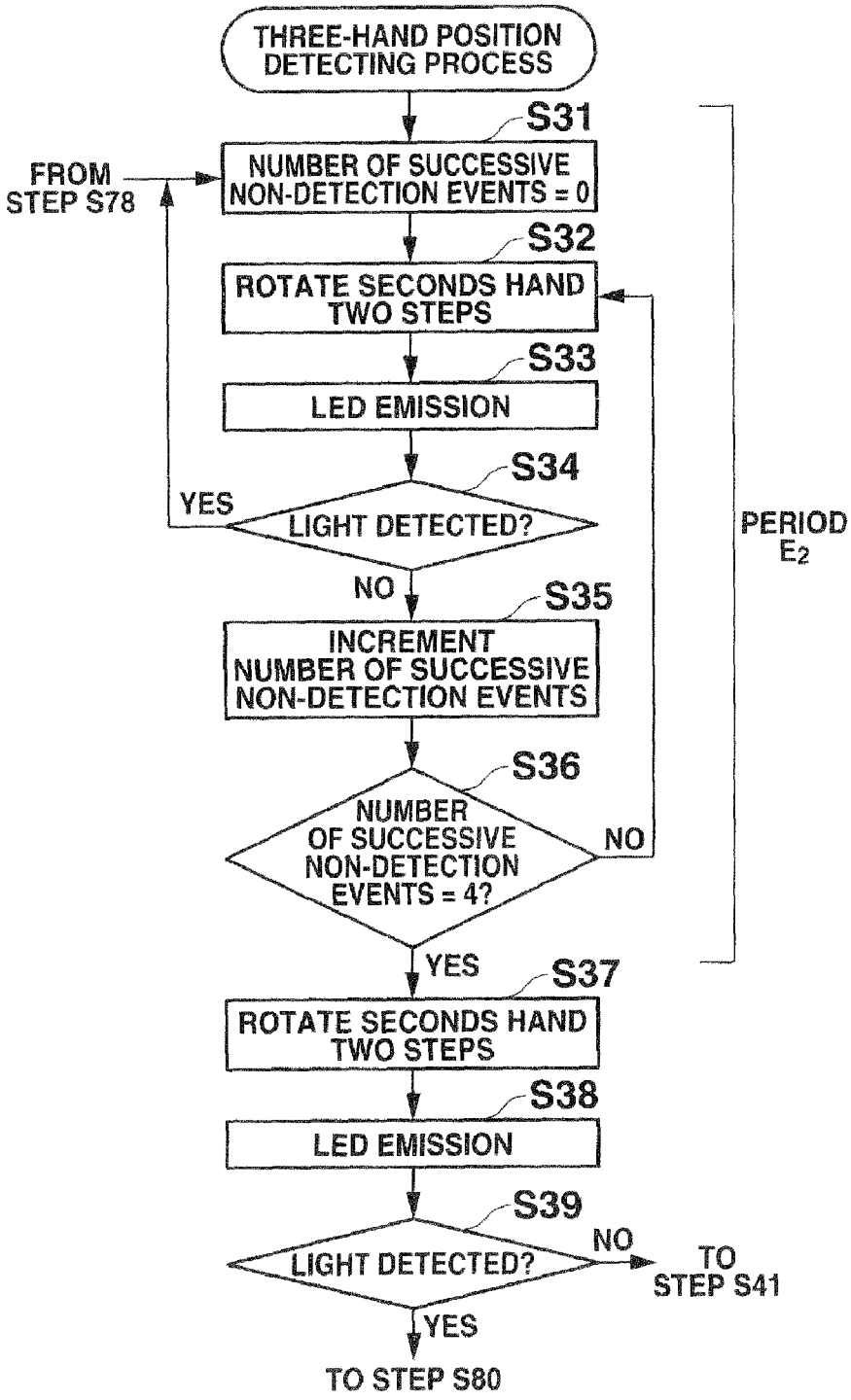
FIG. 21 illustrates a flowchart of a seconds hands position detecting process included in a basic three-hand position detecting process to move the seconds, center and hour hands to the reference position.
Figure 22:
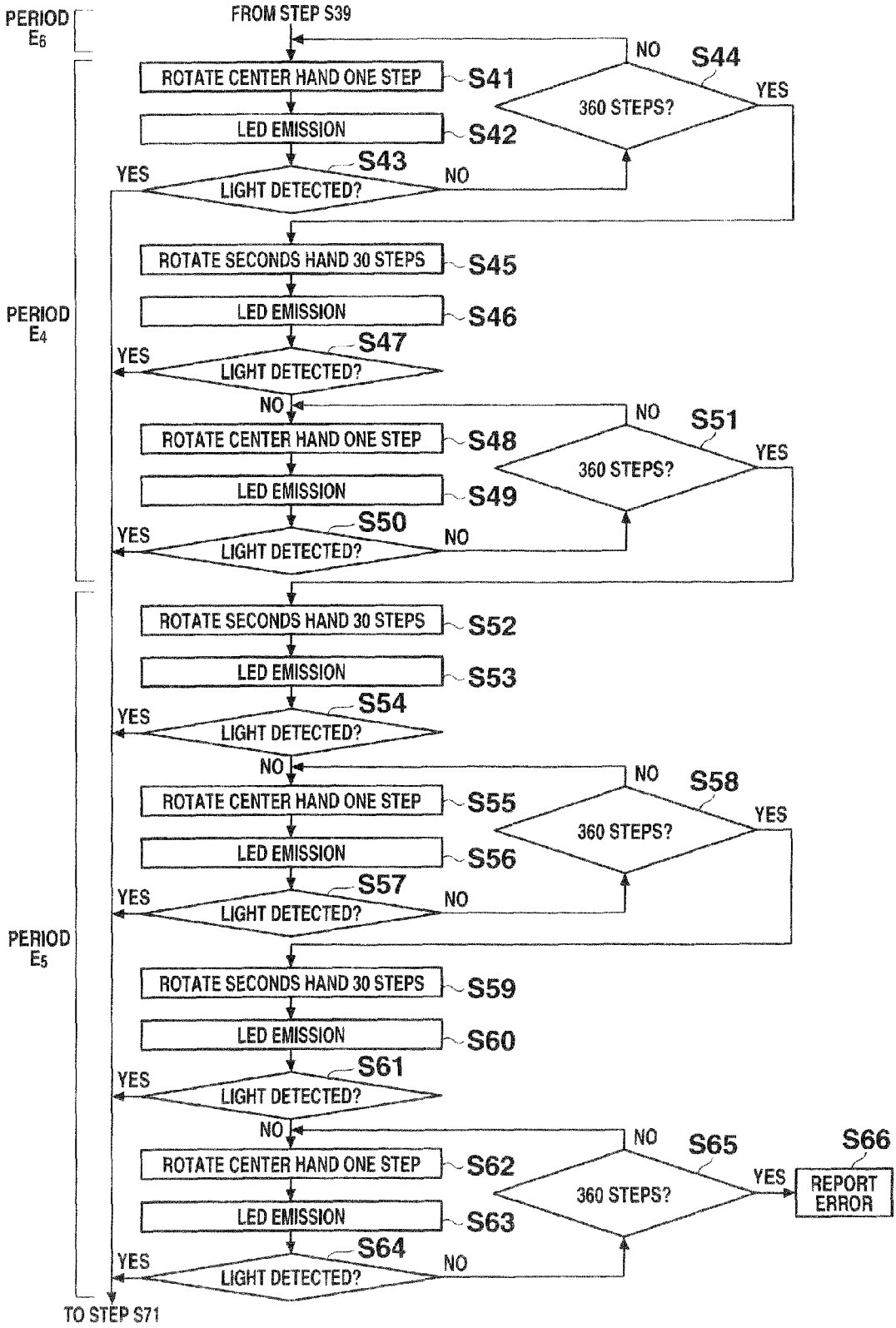
FIG. 22 illustrates a flowchart of a center hand position detecting process included in the basic three-hand position detecting process.
Figure 23:
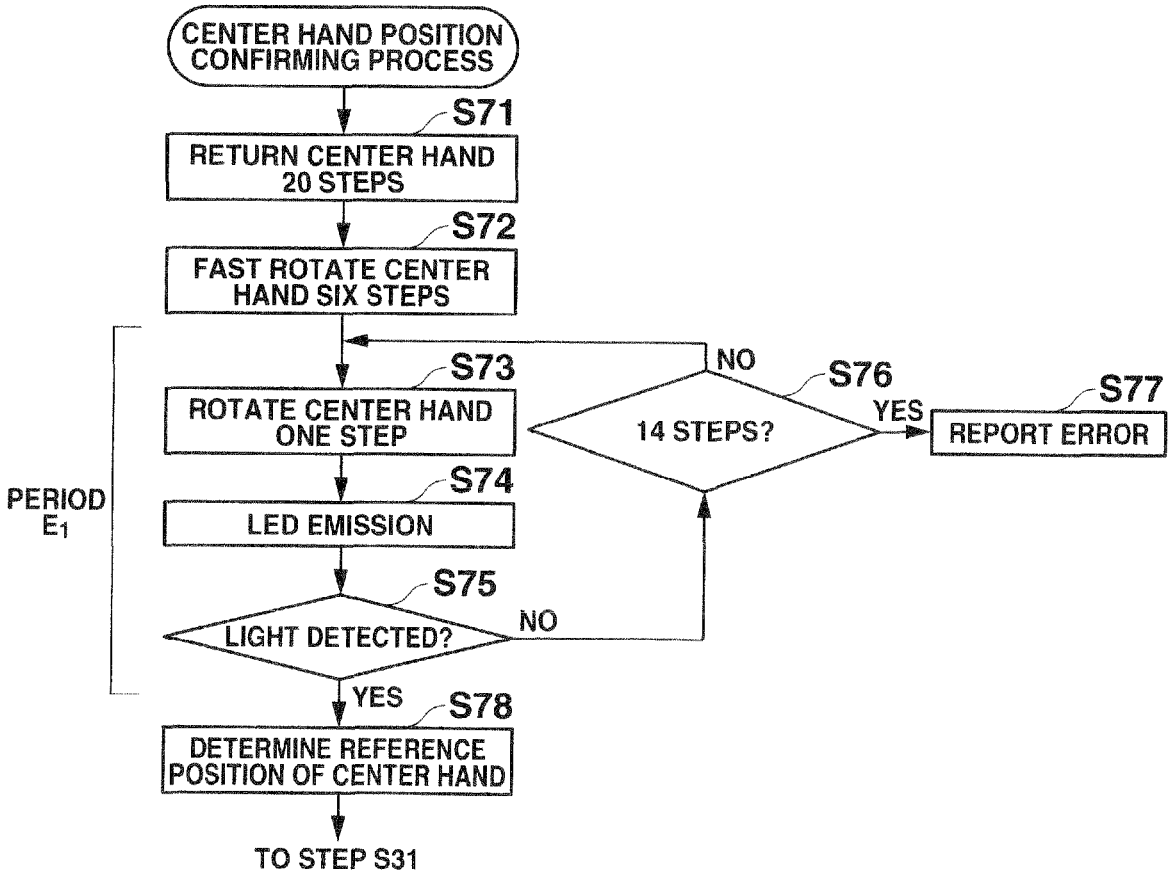
FIG. 23 illustrates a flowchart of a center hand position confirming process included in the basic three-hand position detecting process.
Figure 24:
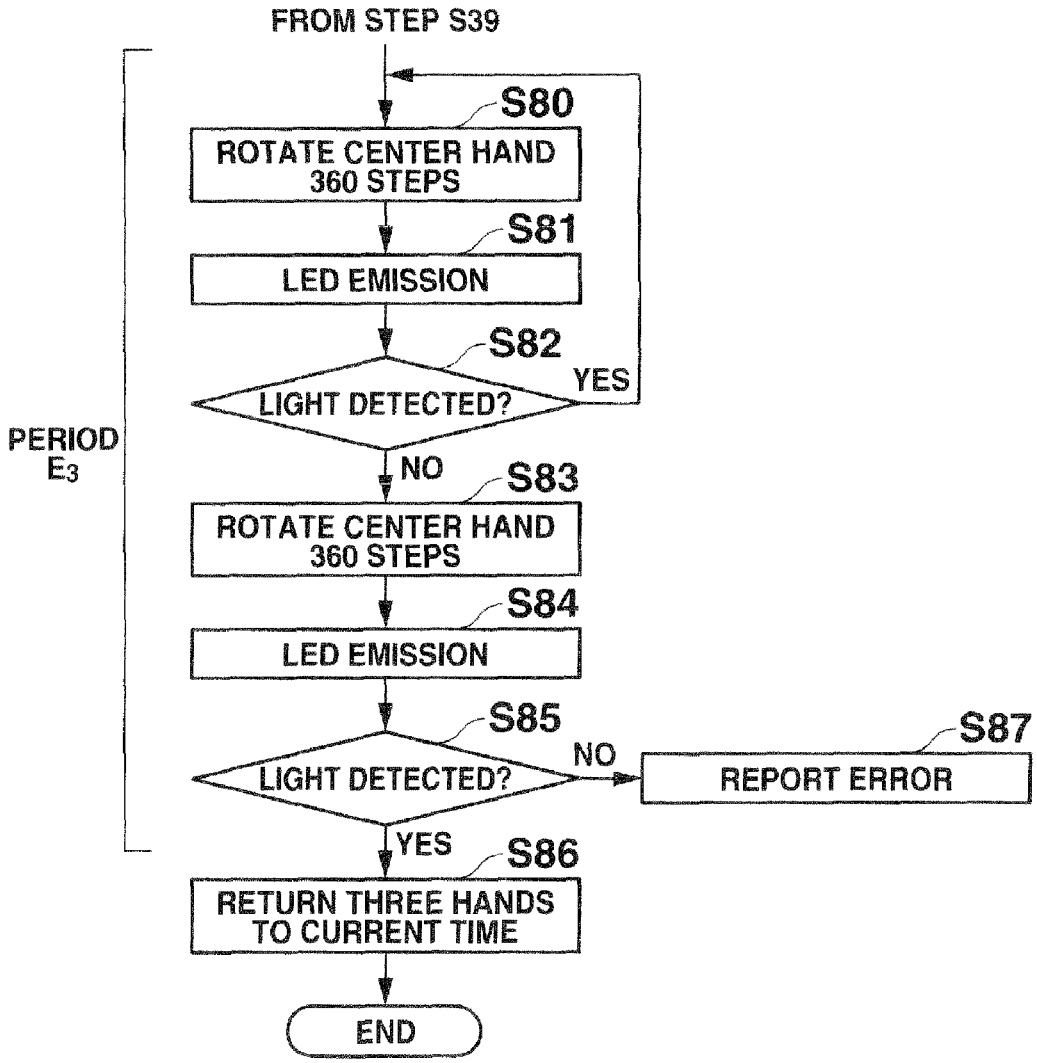
FIG. 24 illustrates a flowchart of an hour hand position detecting process included in the basic three-hand position detecting process.

The three-hand position detecting process is executed when the positions of the seconds, center and hour hands 2, 3 and 4 are unknown. The three-hand position detecting process is a combination of the above-described seconds hand position detecting process and hour and center hand position detecting process. FIG. 21 shows steps S31 to S39 of the seconds hand position detecting process. FIG. 22 shows steps S41 to S66 of the center hand position detecting process. FIG. 23 shows steps S71 to S78 of the center hand position detecting process. FIG. 24 shows steps S80 to S87 of the hour hand position detecting process.

At the time of starting the three-hand position detecting process, because none of the positions of the seconds, center and hour hands 2, 3 and 4 is known, the seconds hand position detecting process of FIG. 21 is performed. That is, the number of times of detection failure in the detection unit 13 counted previously is cleared and the non-detection flag is set to "0" (step S31). Then, the seconds wheel 20 rotates two steps (step S32) and the light emission element 31 emits light (step S33). It is determined whether or not the light from the light emission element 31 is received by the photo detection element 32, namely, whether the detection unit 13 succeeds or fails in detecting the light (step S34).

At this time, none of the rotational positions of the seconds, center and hour wheels 20, 25 and 27 is known. When the photo detection element 32 receives light from the photo-emission element 31 and the detection unit 13 succeeds in light detection, the flow returns to step S31 and the processing of steps S31 to S34 is repeated until one of the first to third light blocking areas 21*d* to 21*f* of the seconds wheel 20 covers the detection position P.

When the detection unit 13 succeeds in detecting light in step S34, one of the light-passing aperture 21*a*, the second light-passing aperture 28, one of the light-passing apertures 29 and light-passing aperture 30 are happens to be aligned together at the detection position P. It can be considered that the center wheel 25 is set at the reference position (00-minute position); however, the rotational positions of the seconds and hour wheels 20 and 27 are unknown. First, the rotational position of the seconds wheel 20 will be detected; therefore, the processing of steps S31 to S34 is repeated until one of the first to third light blocking areas 21*d* to 21*f* in the seconds wheel 20 covers the detection position P and disables the detection unit 13 from detecting light.

When one of the first to third light blocking areas 21*d* to 21*f* in the seconds wheel 20 comes to the detection position P and the detection unit 13 fails in detecting light in step S34, counting the number of times of detection failure is started and the non-detection flag bit is set to "1" (step S35). Then, it is determined whether or not the detection unit 13 fails in detecting light successively four times (step 36).

The processing of steps S32 to S36 is repeated until the second light blocking area 21*e* in the seconds wheel 20 covers the detection position P and the number of times of detection failure in the detection unit 13 arrives at four times. When the detection unit 13 fails in detecting light successively four times, the seconds wheel 20 is rotated two steps (step S37), and the light emission element 31 is caused to emit light (step S38). Then, it is determined whether or not the light from the light emission element 31 is received by the photo detection element 32, that is, whether the detection unit 13 succeeds or fails in light detection (step S39).

When the detection unit 13 succeeds in light detection in step S39, it is determined that the center wheel 25 is located at the reference position (00-minute position) and the second light-passing aperture 28, one of the third light-passing apertures 29, and the circular aperture 21*a* are aligned together at the detection position P. Therefore, it is determined that the seconds wheel 20 and the center wheel 25 are set at the reference position (00-second 00-minute position), and then the flow goes to step S80 in the hour hand position detecting process to be described later.

When the detection unit 13 detects no light in step S39, the number of times of detection failure becomes five even though the circular aperture 21*a* in the seconds wheel 20 is positioned at the detection position P as shown in FIG. 14B. Thus, it is determined that one or more of the second to fourth light-passing apertures 28, 29 and 30 in the center, hour and intermediate wheels 25, 27 and 23 are offset from the detection position P, and the flow goes to step S41 in FIG. 22 to perform the center hand position detecting process.

As shown in FIG. 22, in the center hand position detecting process, the center wheel 25 is rotated one step (one degree) in step S41 and the light emission element 31 is caused to emit light (step S42). Then it is determined whether or not the light from the light emission element 31 is received by the photo detection element 32, that is, whether or not the detection unit 13 succeeds in light detection (step S43). If not, the center wheel 25 is rotated one step at a time, and it is determined whether or not the seconds wheel 25 rotates 360 degrees (step S44). If not, processing of steps S41 to S43 is repeated until the center wheel 25 rotates 360 degrees.

When the detection unit 13 succeeds in detecting light in step S43, it is understood that one of the first light-passing apertures 21, the second and fourth light-passing apertures 28 and 30, and one of the third light-passing apertures 29 are aligned together at the detection position P. It is also understood that, before step S41, the apertures in the center and hour wheels 25 and 27 have been offset from the detection position P. Thus, it is determined that the center wheel 25 is set at the reference position (00-minute position), and the flow goes to step S71 of the center hand position detecting process to confirm whether this determination is correct or not.

However, even though the center wheel 25 rotates 360 degrees, when the detection unit 13 detects no light in step S43, it is considered that the first light-passing apertures 21 are out of the detection position P as shown in FIG. 14D. The seconds wheel 20 rotates 30 steps (180 degrees) (step S45), and the light emission element 31 emits light (step S46).

Then, it is determined whether or not the light from the light emission element 31 is received by the photo detection element 32, i.e., whether or not the detection unit 13 succeeds in light detection (step S47).

When the detection unit 13 succeeds in detecting light in step S47, it is understood that one of the first light-passing apertures 21, the second and fourth light-passing apertures 28 and 30, and one of the third light-passing apertures 29 are aligned together at the detection position P, and that, before step S45, the first, light-passing apertures 21 in the seconds wheel 20 have been away from the detection position P. It is determined that the center wheel 25 is set at the reference position (00-minute position), and then, the flow passes to step S71 of the center hand position confirming process.

After the seconds wheel 20 rotates 30 steps (180 degrees) in step S45, when the detection unit 13 detects no light in step S47, it is determined, as shown in FIG. 14E, that the second light-passing aperture 28 in the center wheel 25 is offset from the detection position P even though one of the first light-passing apertures 21 in the seconds wheel 20 is set at the detection position P. Then, the center wheel 25 rotates one step (step S48).

The light emission element 31 is caused to emit light (step S49), and it is determined whether or not the light from the light emission element 31 is received by the photo detection element 32, and hence whether or not the detection unit 13 succeeds in detecting light (step S50). If not, the center wheel 25 is rotated one step (step S48), and it is determined whether or not the center wheel 25 rotates 360 degrees (step S51). If not, the processing of steps S48 to S51 is repeated until the center wheel 25 rotates 360 degrees (one rotation).

When the detection unit 13 detects light in step S50, it is recognized that one of the first light-passing apertures 21 in the seconds wheel 20, the second and fourth light-passing apertures 28 and 30 in the center and intermediate wheels 25 and 23, and one of the third light-passing apertures 29 in the hour wheel 27 are aligned together at the detection position P. Also it is seen that, before step S50, the second light-passing aperture 28 in the center wheel 25 has been offset from the detection position P. It is determined that the center wheel 25 is set at the reference position (00-minute position). Then, the flow goes to step S71 of the center hand position confirming process.

After the center wheel 25 rotates 360 degrees, when the detection unit 13 detects no light in step S50, it is determined that the third light-passing apertures 29 in the hour wheel 27 are away from the detection position P and that the fourth light blocking area 29*a* in the hour wheel 27 covers the detection position P even though one of the first light-passing apertures 21, and the second and fourth light-passing apertures 28 and 30 are aligned together at the detection position P, as shown in FIG. 11P.

It cannot be known whether any of the first light-passing apertures 21 in the second wheel 20 is located at the detection position P or not. Thus, the seconds wheel 20 rotates 30 steps (180 degrees) (step S52), and the light emission element 31 is caused to emit light (step S53). It is determined whether or not the light from the light emission element 31 is received by the photo detection element 32, that is, whether or not the detection unit 13 succeeds in detecting light (step S54).

When the detection unit 13 succeeds in light detection, one of the first light-passing apertures 21, the second and fourth light-passing aperture 28 and 30, and one of the third light-passing apertures 29 are aligned together at the detection position P. The fourth light blocking area 29*a* of the hour wheel 27 does not cover the detection position P. It can be seen that, before step S52, the first light-passing apertures 21 in the seconds wheel 20 have been offset from the detection position P. It is determined that the center wheel 25 is set at the reference position (00-minute position), and then, the flow goes to step S71 of the center hand position detecting process.

When the detection unit 13 detects no light in step S54, it is determined that the fourth light blocking are 29*a* of the hour wheel 27 covers the detection position P as shown in FIG. 11P. The center wheel 25 rotates one step (step S55), and the light emission element 31 is caused to emit light (step 56). Then, it is determined whether or not the light from the light emission element 31 is detected by the photo detection element 32, that is, whether or not the detection unit 13 succeeds in light detection (step S57). If not, it is determined whether the center wheel 25 rotates 360 degrees in total (step S58). The processing of steps S55 to S57 is repeated until the center wheel 25 rotates 360 degrees (one rotation).

When the detection unit 13 succeeds in detecting light in step S57, one of the first light-passing apertures 21, the second and fourth light-passing apertures 28 and 30, and one of the third light-passing apertures 29 are aligned together at the detection position P. In addition, the light blocking area 29*a* of the hour wheel 27 does not block the detection position P. It is determined that, before step S55, the second light-passing aperture 28 in the center wheel 25 has been away from the detection position P. It is determined that the center wheel 25 is now set at the reference position (00-minute position). Then, the flow goes to step S71 of the center hand position confirming process.

After the center wheel 25 rotates 360 degrees (step S58), when the detection unit 13 detects no light in step S57, it is assumed that the detection position P is blocked by the fourth light blocking area 29*a* in the hour wheel 27, and that the hour wheel 27 is set at the 11-o'clock position. In order to confirm whether this assumption is correct or not, the seconds wheel 20 rotates 30 steps (180 degrees) (step S59) and the light emission element 31 is caused to emit light (step S60). It is determined whether or not the light from the light emission element 31 is received by the photo detection element 32, that is, whether the detection unit 13 succeeds or fails in light detection (step S61).

When the detection unit 13 succeeds in detecting light, one of the first light-passing apertures 21 in the seconds wheel 20, the second and fourth light-passing apertures 28 and 30 in the center and intermediate wheels 25 and 23, and one of the third light-passing apertures 29 in the hour wheel 27 are aligned together at the detection position P. Thus, it is determined, before step S59, that the hour wheel 27 has not been set at the 11-o'clock position and the first light-passing apertures 21 have been away from the detection position P. It is determined that the center wheel 25 is set at the reference position (00-minute position). Then the flow goes to step S71 of the center hand position confirming process.

When the detection unit 13 detects no light in step S61, the fourth light blocking area 29*a* in the hour wheel 27 blocks the detection position P. The center wheel 25 rotates one step (step S62), and the light emission element 31 is caused to emit light (step S63). It is determined whether or not the light from the light emission element 31 is received by the photo detection element 32, that is, whether or not the detection unit 13 succeeds in light detection (step S64).

When the detection unit 13 detects no light in step S64, the center wheel 25 is rotated one step and it is determined whether or not the center wheel 25 rotates 360 degrees in total (step S65). If not, the processing of steps S62 to S64 is repeated until the center wheel 25 rotates 360 degrees. After the processing of steps S62 to S64 is repeated, when the detection unit 13 detects no light in step S64, a hand position detection error is reported by means of a stop position of the seconds hand 2 or buzzer sound (step S66). When the detection unit 13 detects light in step S64, it is determined that the hour wheel 27 is positioned at the reference position (0-o'clock position) and the center wheel 25 is positioned at the reference position (00-minute position). Then, the flow goes to the step S71 for the center hand position confirming process.

As shown in FIG. 23, in the center hand position confirming process, the center wheel 25 is returned 20 steps counterclockwise from the position where the detection unit 13 succeeds in light detection (more than 14 degrees that is necessary for the second light-passing aperture 28 in the seconds wheel 25 to be almost completely away from the detection position P) (step S71). Then, the center wheel 25 is fast rotated six steps clockwise (step S72). Thus, any possible backlash between the center and intermediate wheels 25 and 23 is eliminated, and the center wheel 25 is returned 14 steps counterclockwise from the position where the detection unit 13 succeeds in light detection.

That is, the center wheel 25 is returned 14 steps which are more than 12 degrees that is necessary for the second-light passing aperture 28 in the center wheel 25 to move away substantially completely from the detection position P. Then, the center wheel 25 is again rotated clockwise one step (step S73), and the light emission element 31 is caused to emit light (step S74). It is determined whether or not the light from the light emission element 31 is received by the photo detection element 32, that is, whether or not the detection unit 13 succeeds in light (step S75).

When the detection unit 13 detects no light in step S75, the processing of steps S73 to S75 is repeated until the center wheel 25 rotates 14 steps (step S76). The detection unit 13 is assumed necessarily to detect light in step S75. However, if the detection unit 13 fails in light detection, a hand position detection error is reported by means of a stop position of the seconds hand 2 or buzzer sound (step S77). When the detection unit 13 detects light in step S75, the position at the time of the light detection is determined to be the reference position (00-minute position) of the center wheel 25 (step S78).

Since it is unclear whether seconds wheel 20 is set at the reference position (00-second position) or not, the flow returns to step S31 of the seconds hand position detecting process to perform the processing of steps S31 to S39. The seconds wheel 20 rotates to the reference position (0-minute 00-second position). Then, the flow goes to step S80 of the hour hand position detecting process shown in FIG. 24. Since the seconds and center wheels 20 and 25 are set at the reference position, the center wheel 25 is rotated 360 degrees in step S80, thereby rotating the hour wheel 27 30 degrees. Then, the light emission element 31 is caused to emit light (step S81). It is determined whether or not the light from the light emission element 31 is received by the photo detection element 32, that is, whether the detection unit 13 succeeds or fails in light detection (step S82).

When the detection unit 13 detects light every time the hour wheel 27 rotates 30 degrees, it is determined that the third light-passing apertures 29 in the hour wheel 27 successively comes to the detection position P and the hour wheel 27 is successively positioned at exact hour positions. Thus, the flow returns to step S80 and the processing of steps S80 to S82 is repeated until the fourth light blocking area 29*a* at the 11-o'clock position in the hour wheel 27 covers the detection position P. When the detection unit 13 detects no light, it is determined that the fourth light blocking area 29*a* in the hour wheel 27 covers the detection position P and that the hour wheel 27 is set at the 11-o'clock position.

In order to confirm whether this determination is correct or not, the center wheel 25 is again rotated 360 degrees and the hour wheel 27 is rotated 30 degrees (step S33). Then, the light emission element 31 emits light (step S84). It is then determined whether or not the light from the light emission element 31 is received by the photo detection element 32, that is, whether or not the detection unit 13 succeeds in light detection (step S85).

When the detection unit 13 detects light, the seconds, center and hour wheel 20, 25 and 27 are set at the reference position (0-o'clock 00-minute 00-second position). The seconds, center and hour hands 2, 3 and 4 are set to indicate the exact current time (step S86) and then the normal driving operation is started. Thus, this process is terminated. It is assumed that the detection unit 13 necessarily detects light in step S85; however, when the detection unit 13 fails in light detection, a hand position detection error is reported by means of a stop position of the seconds hand 2 or buzzer sound (step S87).

Then, referring to FIG. 25, description will be made on the hand position confirming process to confirm whether or not the seconds, center and hour hands 2, 3 and 4 are set correctly. The hand position confirming process is executed at every hour five minutes before the hour, that is, every 55 minutes past the hour in the normal hand rotating operation.

In the hand position confirming process, the detection unit 13 makes light detection at every 55 minutes past the hour, excluding ten fifty-five a.m. and ten fifty-five p.m.

The hand position confirming process may be executed at every hour on the hour; however, execution of the process may coincide with generation of a time/alarm signal or other various operations to be performed. Thus, it is preferable that the hand position confirming process is executed several minutes before the hour. The hour wheel 27 rotates one degree per 12 minutes; therefore, even when the execution of the process is made 10 minutes or so offset from the hour, one of the third light-passing apertures 29 is not completely moved away from the detection position P to allow the detection unit to detect light.

When the detection unit 13 detects light in the process at every 55 minutes past the hour, the hour hand 4 is regarded as being set correctly. Then, it is confirmed whether or not the seconds and center hands 2 and 3 are set correctly, and a difference in the position of the center hand 3 less than 60 minutes can be confirmed. When 10 seconds elapses from the start of the process, the center wheel 25 is rotated one step and thus the intermediate wheel 23 is rotated 30 degrees, thereby blocking the detection position P. It is necessary to confirm the difference in the position of the seconds hand 2 in ten seconds from the start of the process.

The hand position confirming process starts at every hour 55 minutes past the hour excluding 11 o'clock and 22 o'clock. The light emission element 31 is caused to emit light (step S90). Then, it is determined whether or not the light from the light emission element 31 is received by the photo detection element 32, that is, whether or not the detection unit 13 succeeds in light detection (step S91). If not, it is determined that at least one of the seconds, center and hour hands 2, 3 and 4 is fast or slow and then the flow goes to the above-described three-hand position detecting process.

When the detection unit 13 succeeds in detecting light, it is determined that one of the first light-passing apertures 21 in the seconds wheel 20 is positioned at the detection position P. The number of times of detection failure counted previously is cleared and the non-detection flag is set to "0" (step S92). Then, the seconds wheel 20 is normally rotated one step (six degrees) and the seconds hand 2 is normally rotates around the dial (step S93). It is determined whether or not the seconds wheel 20 rotates two steps (12 degrees) in total (step S94). Even when the seconds wheel 20 rotates only one step or six degrees, the circular aperture 21*a* in the seconds wheel 20 is not completely moved away from the detection position P; therefore, the detection unit 13 makes light detection each time the seconds wheel 20 rotates two steps.

When it is determined that the seconds wheel 20 does not rotates two steps in step S94, the seconds hand is normally rotated by one step (six degrees) at a time. Every time the seconds wheel 20 rotates two steps, it is determined whether or not the seconds hand 2 is set at any of positions of 2, 4, 6 and 8 seconds (step S95). Since the first stepping motor 17 may not operate correctly due to external factors such as external magnetic field, the seconds hand 2 may not indicate any of the positions of 2, 4, 6 and 8 seconds. In such a case, a hand position detection error is reported by means of a stop position of the seconds hand 2 and/or buzzer sound (step S96).

When it is determined in step S95 that the seconds hand 2 indicates one of the positions of 2, 4, 6 and 8 seconds without being influenced by the external factors, the light emission element 31 of the detection 13 emits light (step S97). It is determined whether or not the light from the light emission element 31 is received by the photo detection element 32, that is, whether or not detection unit 13 succeeds in light detection (step S98). When the detection unit 13 detects light, one of the first light-passing apertures 21, i.e., the circular aperture 21*a*, first arcuate aperture 21*b* and second arcuate aperture 21*c* in the seconds wheel 20 is located at the detection position P. Hence it is determined that, before step S93, the seconds wheel 20 has not been set exactly. The flow goes to the three-hand position detecting process.

When the detection unit 13 detects no light in step S96, it is determined that one of the first to third light blocking areas 21*d* to 21*f* of the seconds wheel 20 covers the detection position P as shown in FIG. 15B. The non-detection flag is set to "1" and counting the number of times of detection failure is started (step S99). Then, it is determined whether or not the detection unit 13 fails in detecting light successively three times (step S100). If not, the flow returns to step S93. The seconds hand 2 is rotated normally and the processing of steps S93 to S100 is repeated.

When it is determined that three times of detection failure are successively occurred six seconds after 55 minutes past the hour as shown by a change from FIG. 15B to FIG. 15D, one of the first and second light blocking areas 21*d* and 21*e* covers the detection position P. The seconds wheel 20 is normally rotated one step (six degrees) and the seconds hand 2 normally sweeps around the dial (step S101). It is then determined whether or not the seconds wheel 20 rotates two steps in total (step S102). If not, the seconds hand 2 is normally rotated until the seconds wheel 20 rotates two steps.

When the seconds wheel 20 rotates two steps, the light emission element 31 is caused to emit light (step S103). It is determined whether or not the light from the light emission element 31 is received by the photo detection element 32, that is, whether or not the detection unit 13 succeeds in light detection at eight seconds after 55 minutes past the hour (step S104). When the detection unit 13 detects no light, it is determined that the second light blocking area 21*e* covers the detection position P and that the seconds wheel 20 is not set at the correct rotational position. Thus, the flow goes to the three-hand position detecting process. When the detection unit 13 detects light in step S104, a part of the first arcuate aperture 21*b* in the seconds wheel 20 covers the detection position P as shown in FIG. 15E. Thus, it is determined that the seconds wheel 20 has been set at its correct rotational position. Then, the operation is switched over to the normal rotating operation. Then, this process is terminated.

Figure 26:
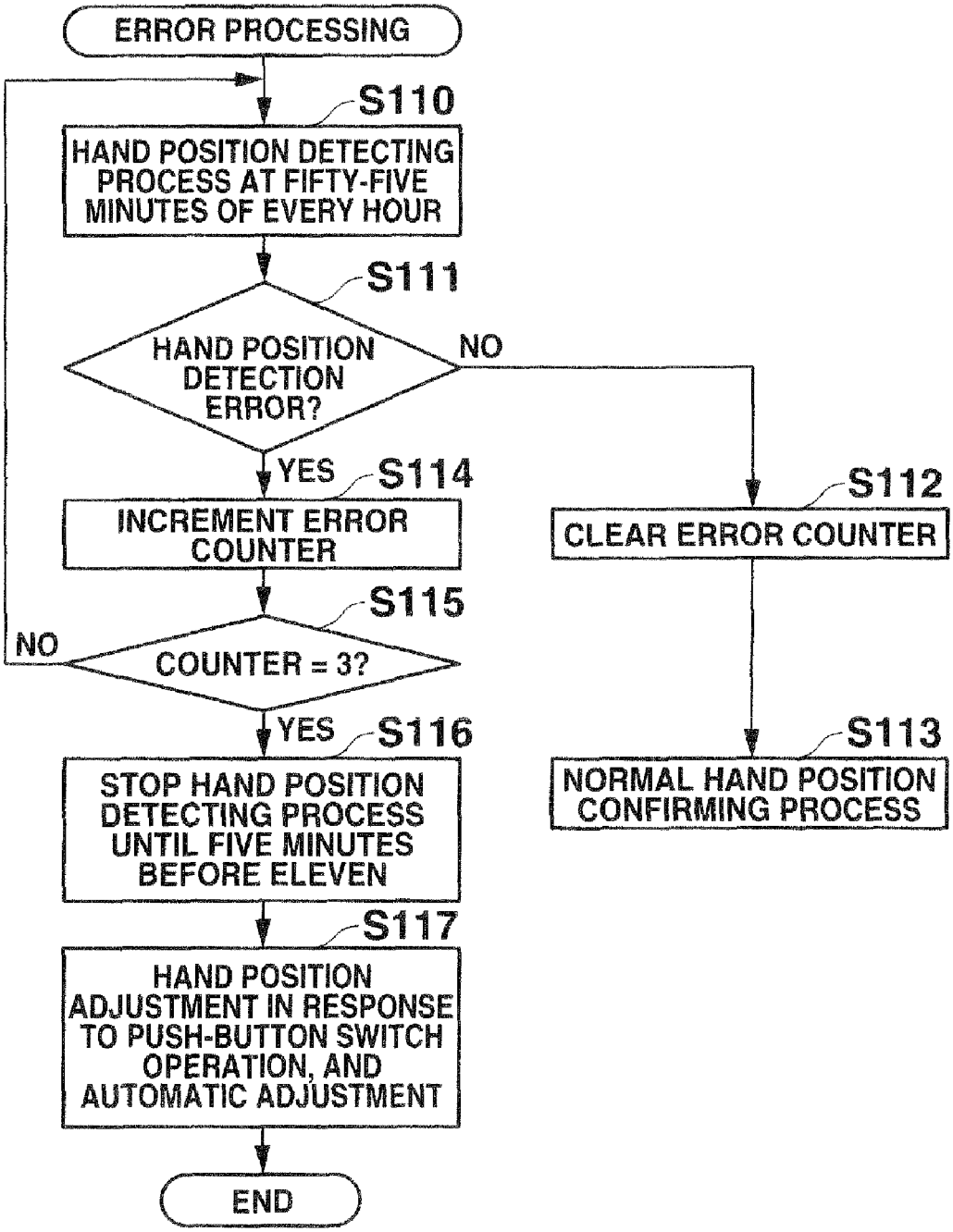
FIG. 26 is a flowchart of error processing which stops the detection of hand positions when hand position detection errors are occurred successively.

Next, referring to FIG. 26, error processing will be described which stops hand position detection when hand position detection errors are occurred successively.

According to the hard position confirming process, the flow goes to the three-hand position detecting process from steps S91, S98 and S104. When a hand position detection error is occurred in the hand position confirming process or in the three-hand position detecting process, hand position detection is stopped until ten fifty-five a.m. or ten fifty-five p.m.

When the error processing is started, the hand position confirming process of steps S90 to S104 is performed (step S110). Then, the flow goes to the three-hand position detection process from step S91, S98 or S104 and it is determined whether or not a hand position detection error is occurred in the three-hand position detection process or the hand position confirming process (step S111). If not, an error counter (not shown) is cleared to be zero (step S112) and then the hand position confirming process is normally performed at every 5 minutes before the hour (step S113).

When it is determined in step S111 that a hand position detection error is occurred, a value of the error counter is incremented (step S114). It is determined whether or not the number of successive errors counted by the error counter comes to a predetermined number (in this embodiment, successive three errors) (step S115). If not, the flow returns to step S110 and the above processing is repeated until three hand position detection errors are successively occurred.

Figure 25:
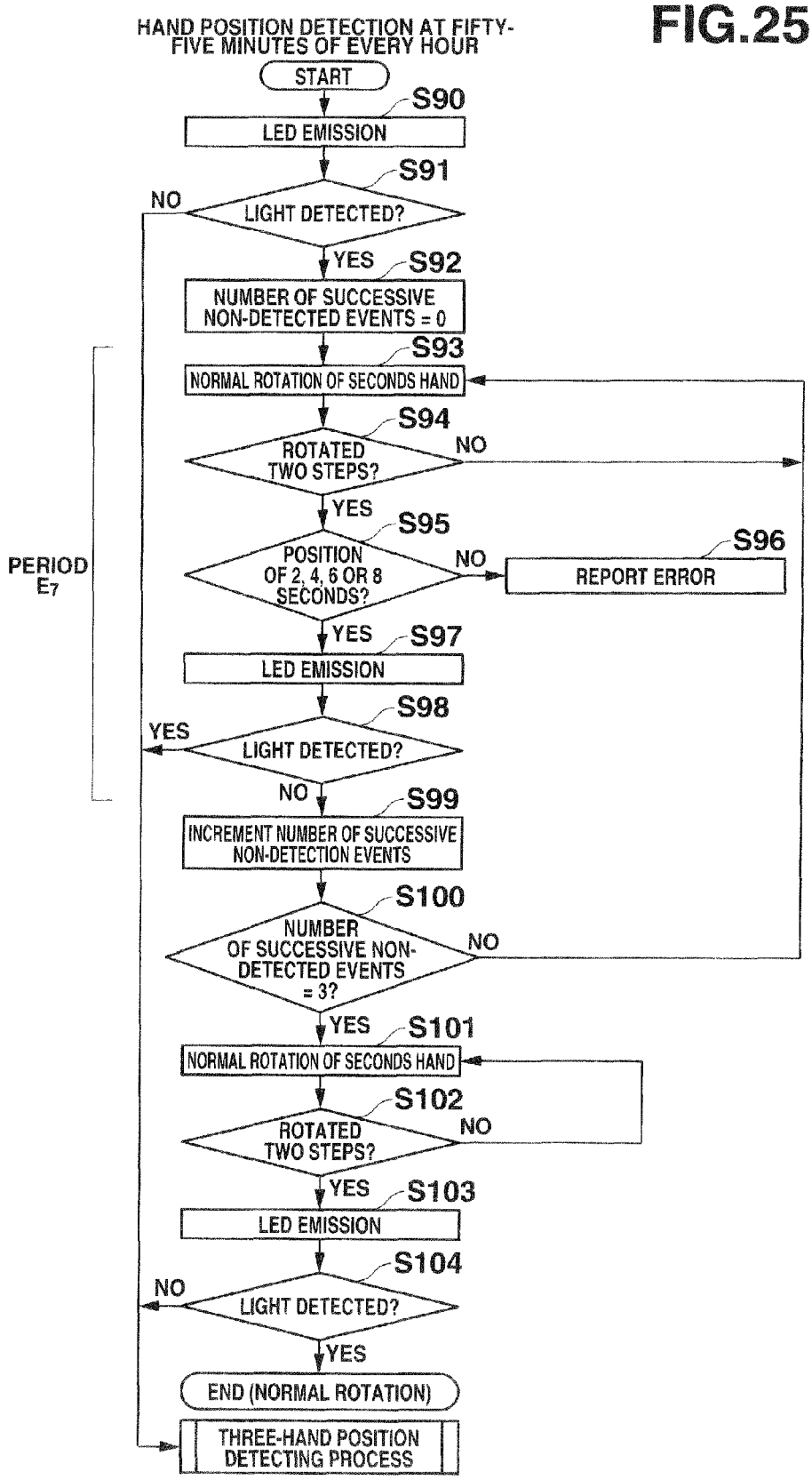
FIG. 25 is a flowchart of a hand position confirming process for confirming the positions of the seconds, center and hour hands every hour five minute before the hour in the normal hand rotating operation.

When it is determined in step S115 that the hand position detection errors are occurred successively three times, the contents of the errors are stored in the RAM 37 and then the hand position confirming process involving steps S90 to S104 of FIG. 25 is stopped until a predetermined time point (ten fifty-five, in this embodiment) (step S116). The hand positions are adjusted in accordance with operations on the push-button switches SWs, and also adjusted automatically (step S117). Then, the error processing is terminated.

Next, referring to FIG. 27, display of the hand position detection errors will be described.

When three of push-button switches SWs (see FIG. 17) provided on a side of the case TK are depressed simultaneously in the normal hand rotating mode, an error display mode is selected. The contents of the hand position detection errors stored In the RAM 37 are displayed in the error display mode. In the error display mode, as shown in FIG. 27, types of errors are numbered (0-8, D and E). The seconds hand 2 is stopped at a position indicative of an error type.

Error No. 0 indicates that the hands are detected at their correct positions. The seconds hand 2 is stopped at a 55 seconds position.

Error No. 1 indicates that the center hand 3 is erroneously determined as being at a correct position 12 steps before its proper position in the center hand position confirming process of FIG. 23. The steps S75 to S77 are performed in a section E1 of FIG. 23 with returning the center hand 3 14 steps from the position where the center hand position erroneously determined and then confirming if light is detected by rotating the center hand 3 reversely one step at a time. If no light is detected even when 14 steps are returned, it is determined that Error No. 1 is occurred and then this error is reported (step S77). The seconds hand 2 is stopped at a 3 seconds position.

Error No. 2 indicates that the steps S31 to S36 are performed in a section E2 of FIG. 21 to confirm that the number of positions, where no light is detected successively four times when the seconds hand 2 rotates 60 steps, 2 steps at a time, is one in the three-hand position detection process of FIG. 21. If no light is detected even when the seconds wheel 2 rotates 60 steps, error No. 2 occurs and the seconds hand 2 is stopped at a 6 seconds position.

Error No. 3 indicates that each time the center hand a rotates 360 degrees, the steps S80 to S85 are performed in a section E3 of FIG. 24 to confirm optical detection of a respective one of the 11 apertures 29 provided at angular intervals of 30 degrees along the periphery of the hour wheel 27 in the three-hard position detection process of FIG. 24. When light is detected successively 12 times, error No. 3 is reported as occurring (step S87). The seconds hand 2 is stopped at a 9 seconds position.

Error No. 4 occurs in a section E6 of FIG. 22 when no light is detected in the step S39 of FIG. 21 and then the control passes to the step S41 of FIG. 22 in the three-hand position detection process in a state where flags A and B are set on the RAM 37 in a section E4 for the steps S41 to S51 and in a section E5 for the steps S52 to S66, respectively, in the three-hand position detection process of FIG. 22. The second hand 2 is stopped at a 12 seconds position.

Error No. 5 indicates that the steps S93 to S98 are performed in a section E7 of FIG. 25 to confirm if the seconds hand 2 has been rotated 2 steps in the hand position confirming process which is performed at the 55 minutes of every hour in the normal hand rotating operation of FIG. 25. This error occurs when the first stepping motor 17 does not work correctly due to an external factor such as external magnetic field applied thereto although the output terminals are set from which pulses are applied to the first stepping motor 17 of the first driving system 11 (step S96). The seconds hand 2 is stopped at a 15 seconds position.

Error No. 6 occurs when light is detected successively 11 times and then not in a next trial in the steps S52 to S66 in a period E5 of the three-hand position detection process of FIG. 22 (step S66). The seconds hand 2 is stopped at a 18 seconds position.

Error No. 7 occurs when no light is detected in the three-hand position detection process of FIGS. 21 to 24 and in the hand position confirming process performed at the 55 minutes of every hour on the hour in FIG. 25 because one or more of the seconds, center and hour hands 2, 3 and 4 cannot be rotated due to being caught in the wristwatch or the device is broken. The seconds hand 2 is stopped at a 21 seconds position.

Error No. 8 occurs after at least one light detection is performed successfully in the three-hand position detecting process of FIGS. 21 to 24 and in the hand position confirming process of FIG. 25 which is performed at the 55 minutes of every hour. The seconds hand 2 is stopped at a 24 seconds position. The above-mentioned errors Nos. 1-8 are hand position detection error due to the wheel system.

Error No. D occurs when no light is detected because any of the light emission element 31 and the photo detection element 32 of the detection unit 13 is broken, thereby making light detection impossible. The seconds hand 2 is stopped at a 39 seconds position.

Error No. E occurs when no light can be detected because the CPU 35 of the wristwatch is broken or some electric parts are badly soldered on the circuit board. The seconds hangs 2 is stopped at a 42 seconds position. The above-mentioned errors Nos. D and E are errors due to the circuit system.

Figure 28:
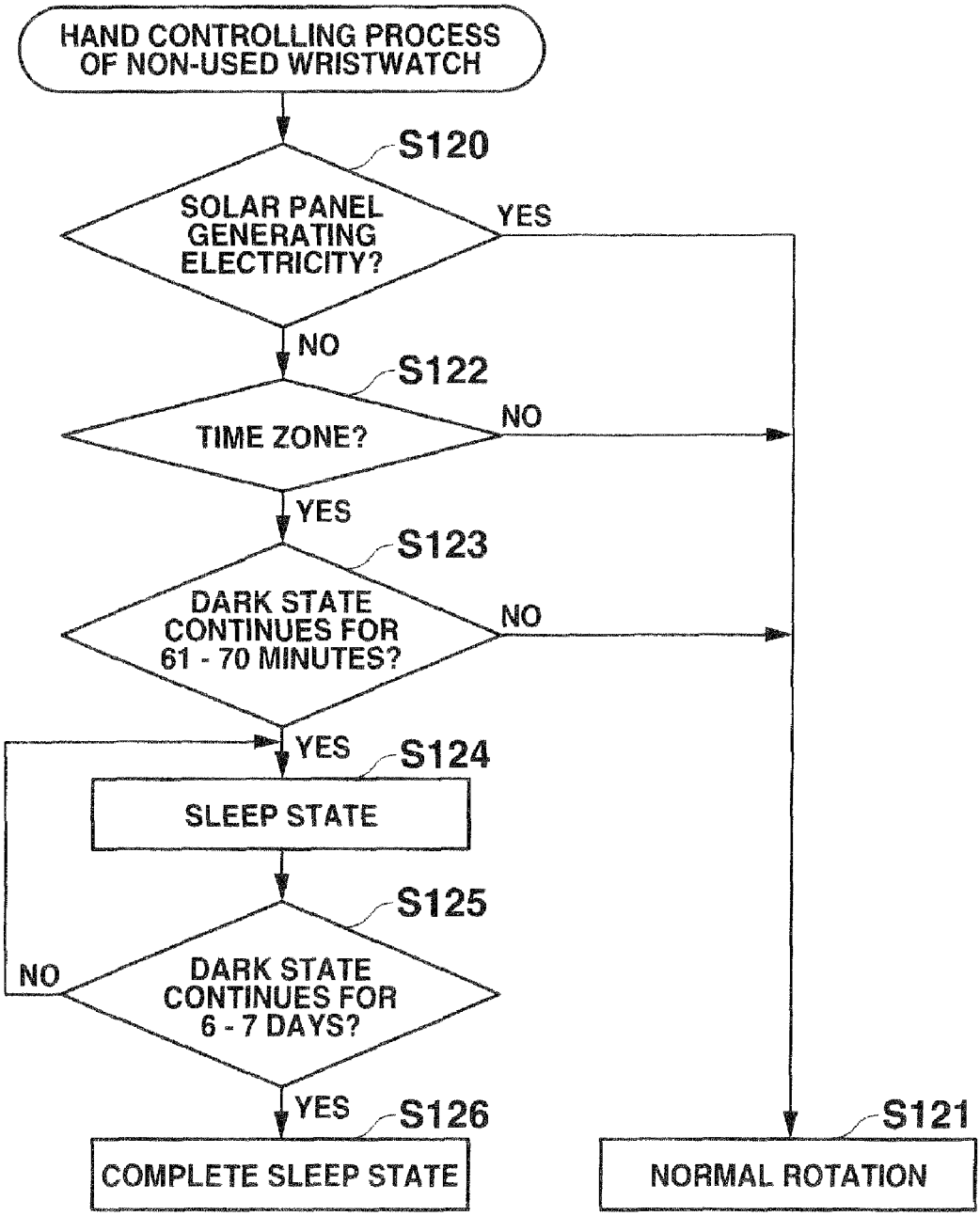
FIG. 28 is a flowchart of a hand controlling process when the wristwatch is not in use.

Next, referring to FIG. 28, description will be given on a hand controlling process for the case where the wristwatch 1 is in darkness and not in use.

When the hand controlling process is started, it is determined whether or not the solar panel 9 is detecting external light and generating electricity to determine whether the wristwatch 1 is in darkness or not (step S120). When the solar panel 9 is detecting external light and the wristwatch 1 is not in darkness, it is determined that the wristwatch 1 is in use and normal hand rotating operation is performed (step S121).

When the solar panel 9 is not detecting the external light and it is determined that the wristwatch 1 is in darkness, it is determined whether or not the current time is in a time zone between ten p.m. and five fifty a.m. (step S122). When the current time is not included in the time zone, it is determined that the wristwatch 1 is in use and normal hand rotating operation is performed (step S121). When the current time is included in the time zone, it is determined whether or not the solar panel 9 is detecting external light and generating electricity at predetermined time intervals e.g., at every ten minutes, to determine whether or not the wristwatch 1 has been in darkness for a predetermined time period, for example, about 61-70 minutes (step S123).

When the wristwatch 1 has not been in darkness for the predetermined time period, it is determined that the wristwatch 1 is in use and the normal hand rotating operation is performed (step S121). When the wristwatch 1 has been in darkness for the predetermined time period, it is then determined that the wristwatch 1 is not in use and in a sleep state (step S124). In the sleep state, only the seconds hand 2 rotates to the reference position (00-second position) and stopped, and the center and hour hands 3 and 4 rotate normally. Then, it is determined whether or not the solar panel 9 has never detected external light for 6 or 7 days and the wristwatch has been in darkness (step S125).

When the solar panel 9 has detected external light once or more in the 6 or 7 days and the wristwatch 1 has not always been in darkness, it is determined that the wristwatch is set in the sleep state. The flow returns to step S124 and processing of steps S124 and S125 is repeated. When the solar panel has not detected external light for 6 or 7 days and the wristwatch 1 has always been in darkness, it is determined that the wristwatch 1 has not been used for a long time. Thus, it is determined that the wristwatch 1 is in a complete sleep state in which rotation of the hands is stopped until use of the wristwatch 1 is started (step S126). In the complete sleep state, the seconds, center and hour hands 2, 3 and 4 rotate to the reference position (0-o'clock 00-minute 00-second position) and stopped.

Figure 29:
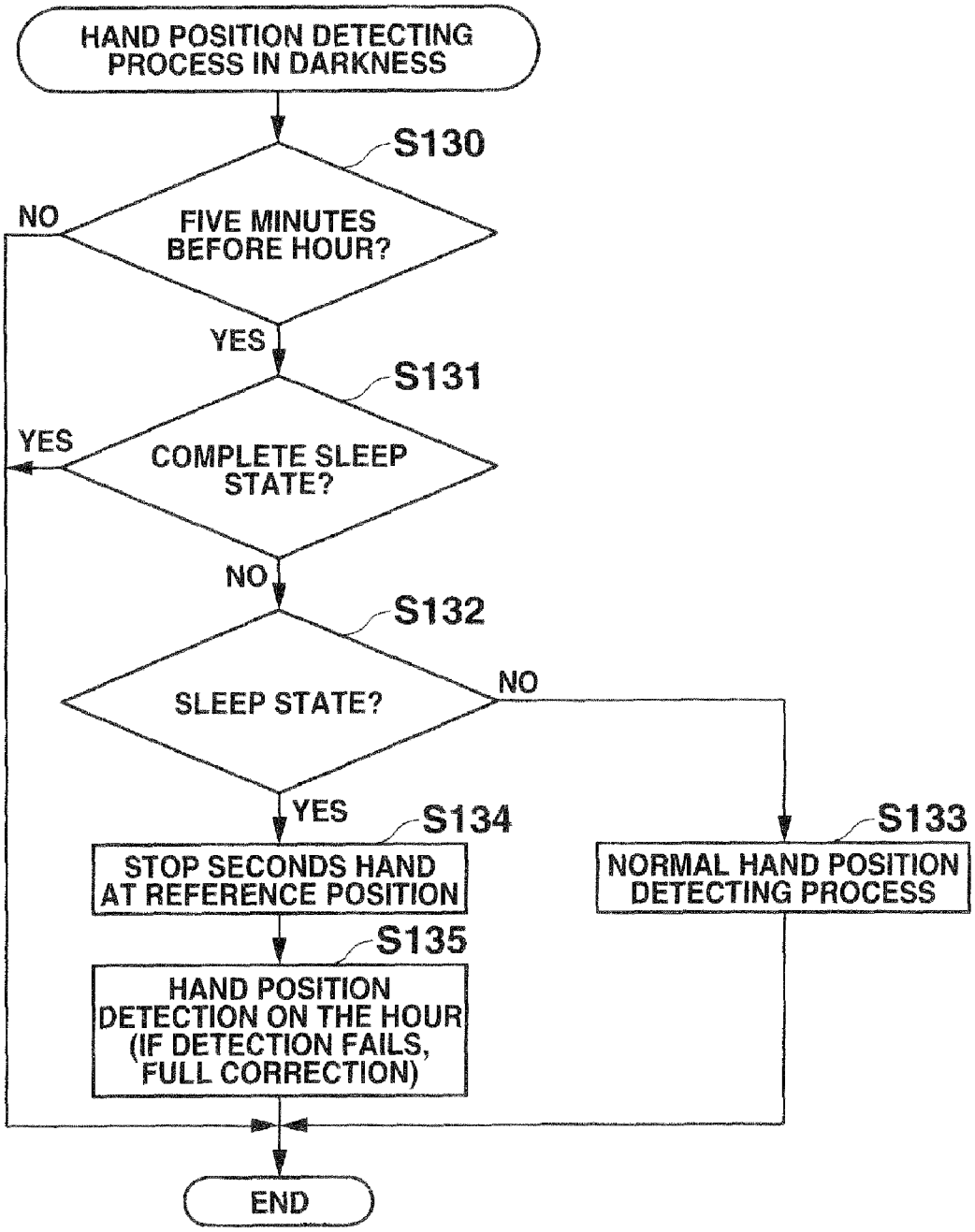
FIG. 29 is a flowchart of hand position detecting process executed every hour on the hour in darkness.

Next, referring to FIG. 29, description will be given on a hand position detecting process to be executed when the wristwatch 1 is in darkness.

When the hand position detecting process is started, it is determined whether or not it is five minutes before the hour (step S130). When it is not five minutes before the hour, the hand position detecting process is not executed and the flow is terminated. When it is five minutes before the hour, it is determined whether or not the wristwatch 1 is in the complete sleep state in which the wristwatch 1 has been in darkness for a long time (step S131).

When the wristwatch 1 is in the complete sleep state, the hand position detecting process is not executed and the flow is terminated. When the wristwatch 1 is not in the complete sleep state, it is further determined whether or not the wristwatch 1 is in the sleep state in which the wristwatch 1 has been in darkness for about 61 to 70 minutes in the time zone between ten p.m. and five fifty a.m. (step S132). When it is determined in step S132 that the wristwatch 1 is not in the sleep state, the wristwatch 1 is considered to be in the normal hand rotating operation. Then, the hard position detecting operation of FIG. 25 is executed at every five minutes before the hour (step S33), and the flow is terminated.

When it is determined in step S132 that the wristwatch 1 is in the sleep state, the seconds hand 2 is rotated to the reference position (00-second position) and stopped (step S134). Then, when it is five minutes before the hour, the hand position detecting is performed by rotating the center and hour hands 3 and 4 (step S135). In step S135, since the seconds hand 2 is stopped at the reference position (00-second position), the hand posit on detection is performed be rotating only the center and hour hands 3 and 4. When the hands are positioned correctly, the flow is terminated. When the hands cannot be positioned correctly, a full correction operation is executed, and then, the flow is terminated.

Figure 30:
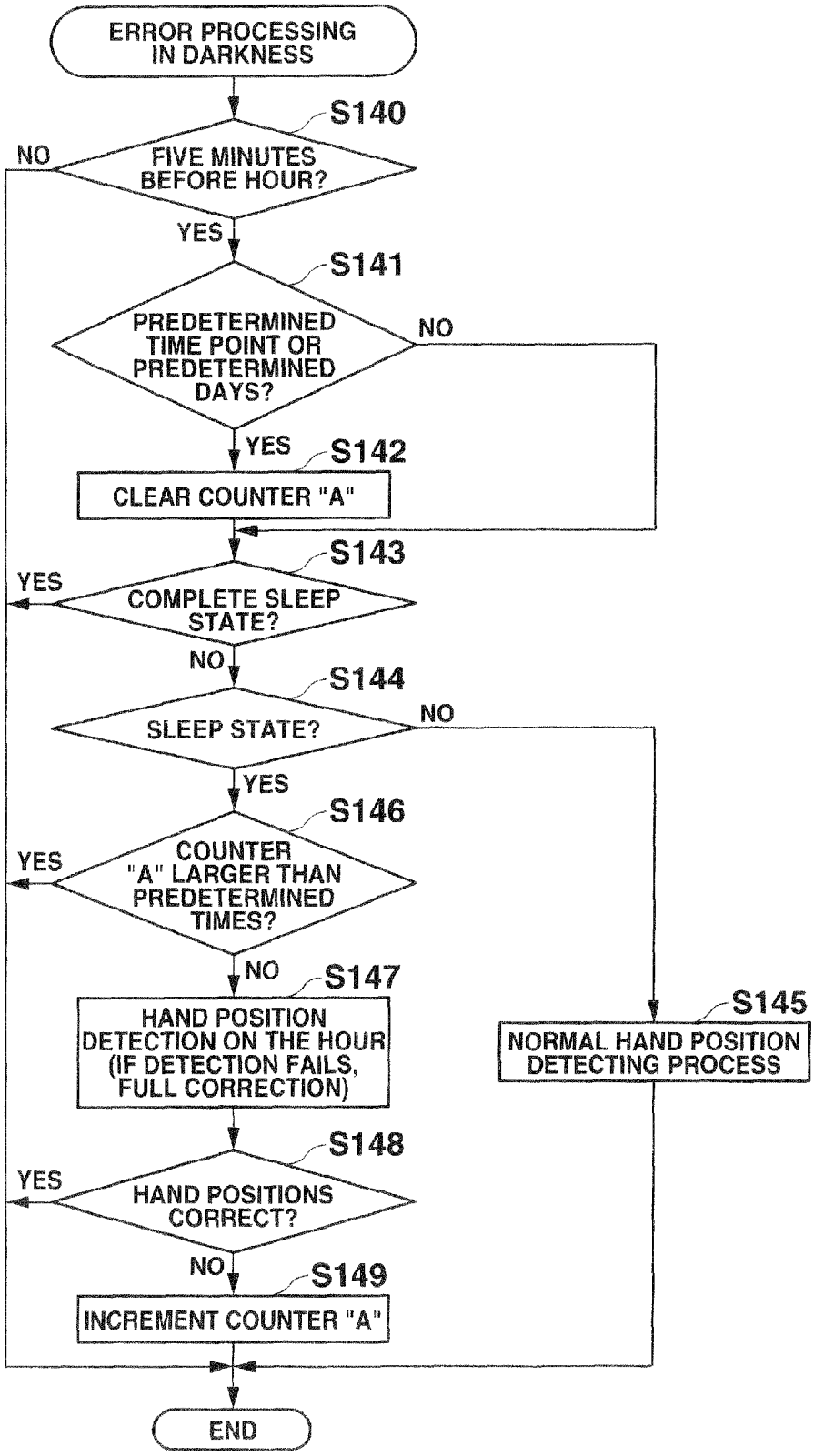
FIG. 30 is a flowchart of error processing executed in darkness when a hand position detection error is occurred.

Next, referring to FIG. 30, description will be given on error processing executed when the wristwatch 1 is in darkness.

When the error processing is started, it is determined whether or not the current time is five minutes before the hour (step S140). When it is not five minutes before the hour, the hand position detection is not performed and the flow is terminated. When it is five minutes before the hour, it is determined whether it is predetermined time or the wristwatch 1 has been in darkness for predetermined days (step S141).

That is, in step S141, it is determined whether or not it is the predetermined time, i.e., ten fifty-five a.m. or p.m. or it is determined whether or not the wristwatch 1 has beer in darkness for predetermined days, i.e., three or seven days. When it is ten fifty-five a.m. or p.m. or when the wristwatch 1 has been in darkness for three or seven days, an error counter A is cleared (step S142). Then, it is determined whether or not the wristwatch 1 has been in darkness for a long period and in the complete sleep state (step S143). When it is determined in step S141 that it is not ten fifty-five a.m. or p.m. and the wristwatch 1 has not been in darkness for three or seven days, the flow goes to step S143 to determine whether or not the wristwatch 1 is in the complete sleep state.

When it is determined that the solar panel 9 has not received external light for about six or seven days and the wristwatch 1 has been in darkness for a long period, it is determined that the wristwatch 1 is not in use and in the complete sleep state in step S143. The seconds, center and hour hands 2, 3 and 4 rotate to the reference position (0-o'lock 00-minute 50-second position) and stopped. Then, the flow is terminated. When it is determined that the solar panel 9 has received external light in six or seven days, it is determined that the wristwatch 1 is not in the complete sleep state in step S143. Then, it is determined whether or not the wristwatch 1 is in the sleep state (step S144).

In step S144, it is determined at every ten minutes, in the time zone between ten p.m. and five fifty a.m., whether or not the solar panel 9 has received external light for about 61 to 70 minutes. If the solar panel has received external light, it is determined that the wristwatch 1 is in use, the normal hand position detecting operation shown in FIG. 25 is executed (step S145), and the flow is terminated. When the wristwatch 1 has been in darkness for 61 to 70 minutes, it is determined that the wristwatch 1 is in the sleep state. Only the seconds hand 2 is rotated to the reference position (00-second position) and stopped; and the center and hour hands 3 and 4 are normally rotated. Then, it is determined whether or not a value of the error counter A is equal to or larger than a predetermined number of times (e.g., three times) (step S146).

In step S146, when the value of the error counter is equal to or larger than the predetermined number of times, the seconds, center and hour hands 2, 3 and 4 rotate to the reference position and stopped, and the flow is terminated without executing the hand position detecting process. When it is determined that the value of the error counter A is smaller than the predetermined number of times, the seconds, center and hour hands rotate, and the hand position detecting process (FIG. 25) is executed at every five minutes before the hour (step S147). When the positions of the hands cannot be detected, the full correction is executed in step S147 and it is determined whether the hands are positioned wrongly or not (step S148). When it is determined in step S148 that the hands are positioned correctly, the flow is terminated. When the positions of the hands cannot be detected in step S148, it is determined that a hand position detection error is occurred. The value of the error counter A is incremented be "1" (step S149), and the flow is terminated.

The hand position detecting device includes the solar panel 9 and the push-button switches SWs which trigger cancellation of the sleep and complete sleep states. When the solar panel 9 receives external light to generate electricity, it is determined that the wristwatch 1 is not left in darkness, and the sleep or complete sleep state is cancelled. When the push-button switches SWs are operated, it is determined that the wristwatch 1 is in use and the sleep or complete sleep state is cancelled.

As described, according to the hand position detecting device of the hand type wristwatch 1, the solar panel 9 which functions as darkness detector, allows making determination whether or not the wristwatch 1 is in darkness. When the wristwatch 1 has been in darkness for a predetermined time period, e.g., 61 to 70 minutes, a dark state determining section (CPU 35; steps S100 to S124) determines that the wristwatch 1 is not in use and set in the sleep state. In the sleep state, a hand rotation controlling section (CPU 35; steps S124 to S135) rotates at least seconds hand 2 from the seconds, center and hours hands 2, 3 and 4 to the reference position (00-second position) and stops the seconds hand 2. A hand position detecting section (CPU 35; steps S35 to S81) detects positions of the center and hour hands 3 and 4. Therefore, when the wristwatch 1 is not in use, the hand position detection is simplified and battery drain can be prevented.

In the state where the seconds hand 2 is stopped at the reference position (00-second position) under the control of the hand rotation controlling section (CPU 35; steps S124 to S135), the hand position detecting section (CPU 35; steps S35 to S87) detects the positions of the center and hour hands 3 and 4 at five minutes before the hour, and even in the sleep state in which the wristwatch 1 is not in use, the center and hour hands 3 and 4 can be rotated correctly. Therefore, when the sleep state is cancelled, the seconds hand 2 is immediately rotated to a position of the current time to correctly indicate the current time.

The hard position detecting device includes a detection stopping section (CPU 35; steps S140- to S149). The detection stopping section stops the hand position detection by the hand position detecting section until a predetermined time point, e.g., ten fifty-five a.m. or ten fifty-five p.m. or stops the detection for a predetermined time period, e.g., three or seven days, when the hand position detecting section cannot detect the positions of the seconds, center and hour hands 2, 3 and 4 successively a predetermined number of times, e.g., three times, in the state where the seconds hand 2 is stopped at the reference position under the control of the hand rotation controller (CPU 33; steps S124 to S135). Therefore, detection of the hand positions is not repeated unnecessarily when the hand position cannot be detected and battery drain can be prevented.

The hand position detecting device includes a hand rotation stopping section (CPU 35; steps S140 to S149). After the dark state determining section determines that the wristwatch 1 is in darkness, when the dark state has been continued for a few days, e.g., six or seven days, it is determined that the wristwatch 1 is not in use. Thus, the hand rotation stopping section rotates the seconds, center and hour hands 2, 3 and 4 to the reference position (0-o'clock 00-minute 00-second position) and stops the hands. Therefore, battery drain can be prevented in the case where the wristwatch 1 is not used for a long period.

The solar panel 9 and the push-button switches SWs trigger releasing stoppage of the hands. When the seconds hand 2 is stopped under the control of the hand rotation controlling section (CPU 35; steps S124 to S135), the stoppage of the seconds hand 2 is released in response to the trigger. When the seconds, center and hour hands 2, 3 and 4 are stopped under the control of the hand rotation stopping section (CPU 35; steps S140 to S149), the stoppage of the seconds, center and hour hands 2, 3 and 4 is released in response to the trigger. Thus, the stoppage of the hands can be readily released when starting usage of the wristwatch 1.

For example, when a user wears the wristwatch 1 and carries the wristwatch 1 to a place where external light can be received, the solar panel 9 receives the external light and generates electricity. It is determined that the wristwatch 1 is in use, and the stoppage of the seconds, center and hour hands 2, 3 and 4 is immediately released to rotate the hands. When the push-button switches SWs are operated, it is determined that the wristwatch 1 is in use. The stoppage of the seconds, center and hour hands 2, 3 and 41 is immediately released to rotate the hands.

First Modification

In the above embodiment, the center hand position detecting process is executed as follows. That is, the center hand 25 rotates by one step at a time; one of the second light-passing apertures 28 and one of the fourth light-passing apertures 30 are aligned together at the detection position P and the detection unit 13 succeeds in light detection; the center hand 25 is reversed 20 steps from the position where the detection unit 13 succeeds in light detection; the center wheel 25 is fast rotated six steps from the reversed position, that is, the center wheel 25 is reversed 14 steps from the position where the detection unit 13 succeeds in light detection; then, the center wheel 25 is again rotated by one step at a time; and the reference position is determined when the detection unit 13 first succeeds in light detection. However, the invention is not limited to the embodiment. For example, the center hand position detecting process shown in FIG. 31 may be executed, according to the first modification.

Figure 31:
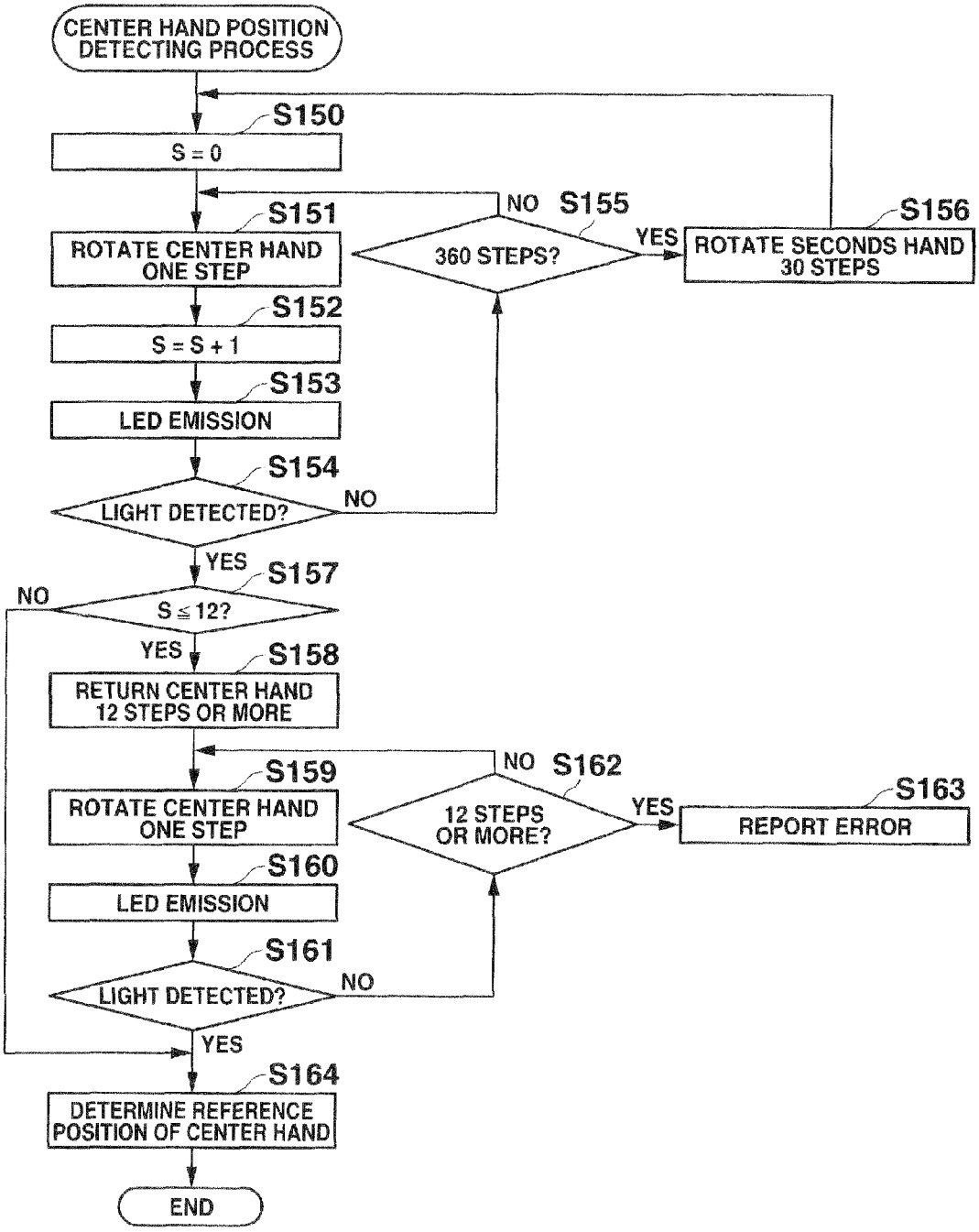
FIG. 31 is a flowchart of a first modification of the center hand position detecting process.

As shown in FIG. 31, when the center hand position detecting process is started, the number of steps which the center wheel 25 has rotated and which is counted by a counter S (not shown) is cleared, and a value of the counter S is set to "0" (S=0) (step S150). The center wheel 25 rotates one step (one degree) (step S151). The number of steps the center wheel has rotated is counted incrementing the value of the counter S (S=S+1) (step S152). The light emission element 31 of the detection unit 13 emits light (step S153), and it is determined whether or not the light from the light emission element 31 is received by the photo detection element 32, namely, whether or not the detection unit 13 succeeds in light detection (step S154). If not, the processing of steps S151 to S154 is repeated until the center wheel 25 rotates 360 degrees (one hour) in total (step S155).

Even after the center wheel 25 rotates 360 degrees (one hour), when the detection unit 13 detects no light, it is determined that the first light-passing apertures 21 are out of the detection position P. The seconds hand 20 is rotated 30 steps (180 degrees) to set one of the first light-passing apertures 21 at the detection position P (step S156). Then, the flow returns to step S150 and the counter S is cleared to be "0". Then, the processing of steps S151 to S155 is repeated.

When the detection unit 13 succeeds in detecting light in step S154, it is determined that the center wheel 25 is positioned at the reference position (00-minute position), and the value of the counter S is stored in the RAM 17. Then, it is determined whether or not the stored value of the counter S is equal to or smaller than a predetermined number of steps, e.g., 12 steps (S≦12) (step S157). That is, when the center wheel 25 rotates 12 steps, the second light-passing aperture 28 is supposed to be completely away from the detection position P. However, the detection unit 13 may erroneously detects light due to a manufacturing error occurred during assembly.

Therefore, when the value of the counter S, i.e., the number of steps which the center wheel 25 has rotated is equal to or smaller than 12 steps when the detection unit 13 detects light at step S154, it is required to confirm whether or not the center wheel 25 is correctly set at the reference position. Thus, the center wheel 25 is reversed 12 steps (12 degrees) or more from the position where the detection unit 13 succeeds in light detection in step S154 (step S158) to move the second light-passing aperture 28 almost completely away from the detection position P. The center wheel 25 is rotated again one step (step S159), and the light emission element 31 emits light (step S160). It is determined whether or not the light from the light emission element 31 is received by the photo detection element 32, namely, whether or not the detection unit succeeds in light detection (step S161).

If not, the processing of steps S158 to S161 is repeated until the center wheel 25 rotates 12 steps or more (step S162). It is assumed that the detection unit 13 necessarily detects light in step S161 until the center wheel rotates 12 steps. However, if the detection unit 13 fails in detecting light, a hand position detection error is reported by means of a stop position of the seconds hand 2 or buzzer sound (step S163). When the detection unit 13 succeeds in detecting light in step S161, it is determined the center wheel 25 is set at the reference position (00-minute position) (step S164), and the process is terminated.

When it is determined in step S157 that the number of rotated steps of the center wheel 25 is larger than the predetermined number of steps, i.e., 12 steps, it is understood that the second and fourth light-passing apertures 28 and 30 are aligned together at the detection position P after the center wheel 23 rotates 360 degrees or more and the second light-passing aperture 28 rotates 12 degrees or more. Therefore, the state of the center wheel 25 is changed from that of FIG. 11A to that of FIG. 11M, and the light detection is not affected by the manufacturing error. Thus, the processing of steps S158 to S163 to confirm the center hand position is omitted. The position where the detection unit 13 succeeds in light detection in step S114 is determined as the reference position (00-minute position) in step S164, and the process is terminated.

As described, according to the first modification, the hand position detecting device includes a counting section (CPU 35; step S152) to count the number of rotated steps of the center wheel 25, a memory (RAM 27) to store the number of steps counted by the counting section when the detection unit 13 detects light passing through the apertures, and a resetting section (CPU 35; step S150) to reset the number of steps counted by the counting section when the detection unit 13 detects no light even after the center wheel 25 rotates 360 degrees. When the detection unit 13 detects no light since the seconds wheel 20 blocks the detection position P, the counted number of steps is cleared and reset by the resetting section. Therefore, the counting section can count the number of rotated steps of the center wheel 25 correctly. The counted number of steps is stored in the memory; therefore, it can be determined whether or not the stored number of steps is equal to the predetermined number of steps.

When the number of steps stored in the memory 37 is larger than the predetermined number of steps (12 steps) the processing of reversing the center wheel 25 and confirming the center hand position is omitted, and a center hand position determining section (CPU 35; step S157) determines that the position where the detection unit 13 succeeds in light detection is the reference position. Therefore, when it is determined that the number of rotated steps of the center wheel 25 is larger than the predetermined number of steps, i.e., 12 steps, it is understood that the second and fourth light passing apertures 28 and 30 are aligned together at the detection position P after the center wheel 23 rotates 360 degrees or more and the second light-passing aperture 28 rotates 12 degrees or more. Thus, even when the processing of returning the center wheel 25 and confirming the center hand position (steps S158 to S163) is omitted, the reference position of the center wheel 25 can be determined correctly.

Second Modification

Figure 32:
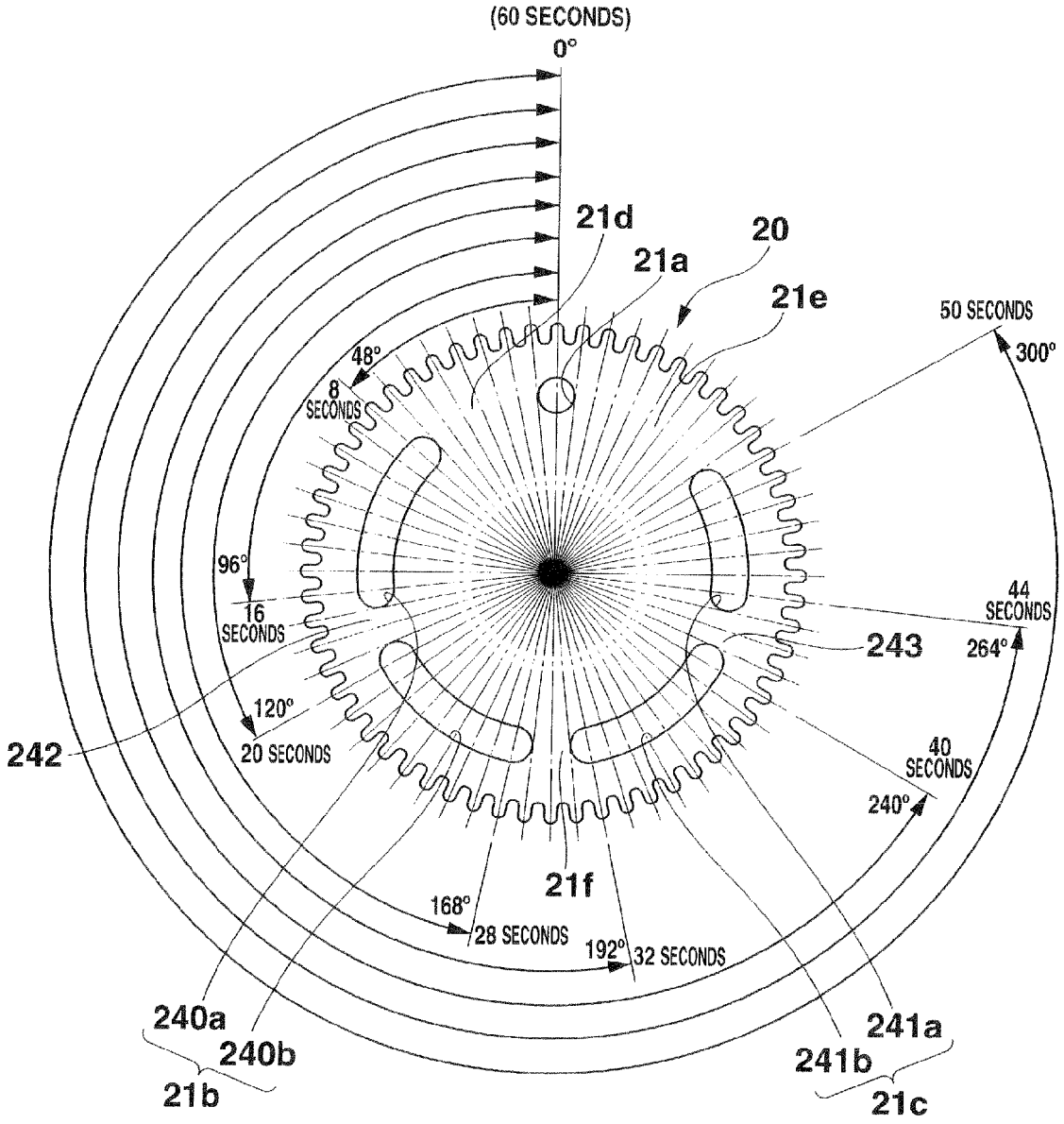
FIG. 32 is an enlarged plan view of the seconds wheel according to a second modification of the embodiment.

In the above embodiment, the first light-passing apertures 21 in the seconds wheel 20 include the first and second arcuate apertures 21*b* and 21*c*. However, the invention is not limited to the embodiment. The apertures may be configured as shown in FIG. 32.

According to the second modification, the first arcuate aperture 21*b* is divided into two arcuate apertures 240*a* and 240*b*, and the second arcuate aperture 21*c* is divided into two arcuate apertures 241*a* and 241*b*.

The arcuate aperture 240*a* which is next to the circular aperture 21*a* is formed between 48 and 96 degrees from the center of the circular aperture 21*a*. The arcuate aperture 240*a* has a width corresponding to 60 degrees that is five times longer than the diameter of the circular aperture 21*a*. The arcuate aperture 240*b* is formed between 120 and 168 degrees from the center of the circular aperture 21*a*. The arcuate aperture 240*b* has a width corresponding to 60 degrees that is five times longer than the diameter of the circular aperture 21*a*. A fifth light blocking area 242 is formed between the arcuate apertures 240*a* and 240*b*. The fifth light blocking area 242 is diametrically opposed to a part of the arcuate aperture 241*a*.

The arcuate aperture 241*a* which is next to the circular aperture 21*a* is formed between 60 and 96 degrees from the center of the circular aperture 21*a*. The arcuate aperture 241*a* has a width corresponding to 48 degrees that is four times longer than the diameter of the circular aperture 21*a*. The arcuate aperture 241*b* is formed between 120 degrees and 168 degrees from the center of the circular aperture 21*a*. The arcuate aperture 240*b* has a width corresponding to 60 degrees that is five times longer than the diameter of the circular aperture 21*a*. A sixth light blocking area 243 is formed between the arcuate apertures 241*a* and 241*b*. The sixth light blocking area 243 is diametrically opposed to a part of the arcuate aperture 240*a*.

In the same manner as the embodiment, the arcuate aperture 240*a* is spaced from the circular aperture 21*a* by the first light blocking area 21*d*. The arcuate aperture 241*a* is also spaced from the circular aperture 21*a* by the second light blocking area 21*e*. The third light blocking area 21*f* is formed between the arcuate apertures 240*b* and 241*b* and diametrically opposed to the circular aperture 21*a*.

The first light blocking area 21*d* is formed between 0 and 48 degrees from the center of the circular aperture 21*a*. The first light blocking area 21*d* has a width corresponding to 36 degrees that is three times longer than the diameter of the circular aperture 21*a*. The first light blocking area 21*d* is diametrically opposed to the arcuate aperture 241*b*. The second light blocking area 21*e* is formed between 0 and 60 degrees from the center of the circular aperture 21*a*. The second light blocking area 21*e* has a width corresponding to 48 degrees that is four times longer than the diameter of the circular aperture 21*a*. The second light blocking area 21*e* is diametrically opposed to the arcuate aperture 240*b*. The third, fifth and sixth light blocking areas 21*f*, 242 and 243 have the almost same size as the circular aperture 21*a*. The third, fifth and sixth light blocking areas 21*f*, 242 and 243 are diametrically opposed to the circular aperture 21*a* and arcuate apertures 241*a* and 240*b*.

According to thus configured seconds wheel 20, in the case where one of the first to third, fifth and sixth light blocking areas 21*d* to 21*f*, 242 and 243 is positioned at the detection position P of the detection unit 13, when the seconds wheel 20 rotates 30 steps (180 degrees), one of the circular aperture 21*a* and the arcuate apertures 240*a*, 240*b*, 241*a* and 241*b* is necessarily located to the detection position P, similarly to the above described embodiment. In addition, the first arcuate aperture 21*b* is divided by the fifth light blocking area 242 into the arcuate apertures 240*a* and 240*b*, and the second arcuate aperture 21*c* is divided by the sixth light blocking area 243 into the arcuate apertures 241*a* and 241*b*. Therefore, strength of the seconds wheel 20 is improved in comparison with the above embodiment.

Third Modification

Figure 33:
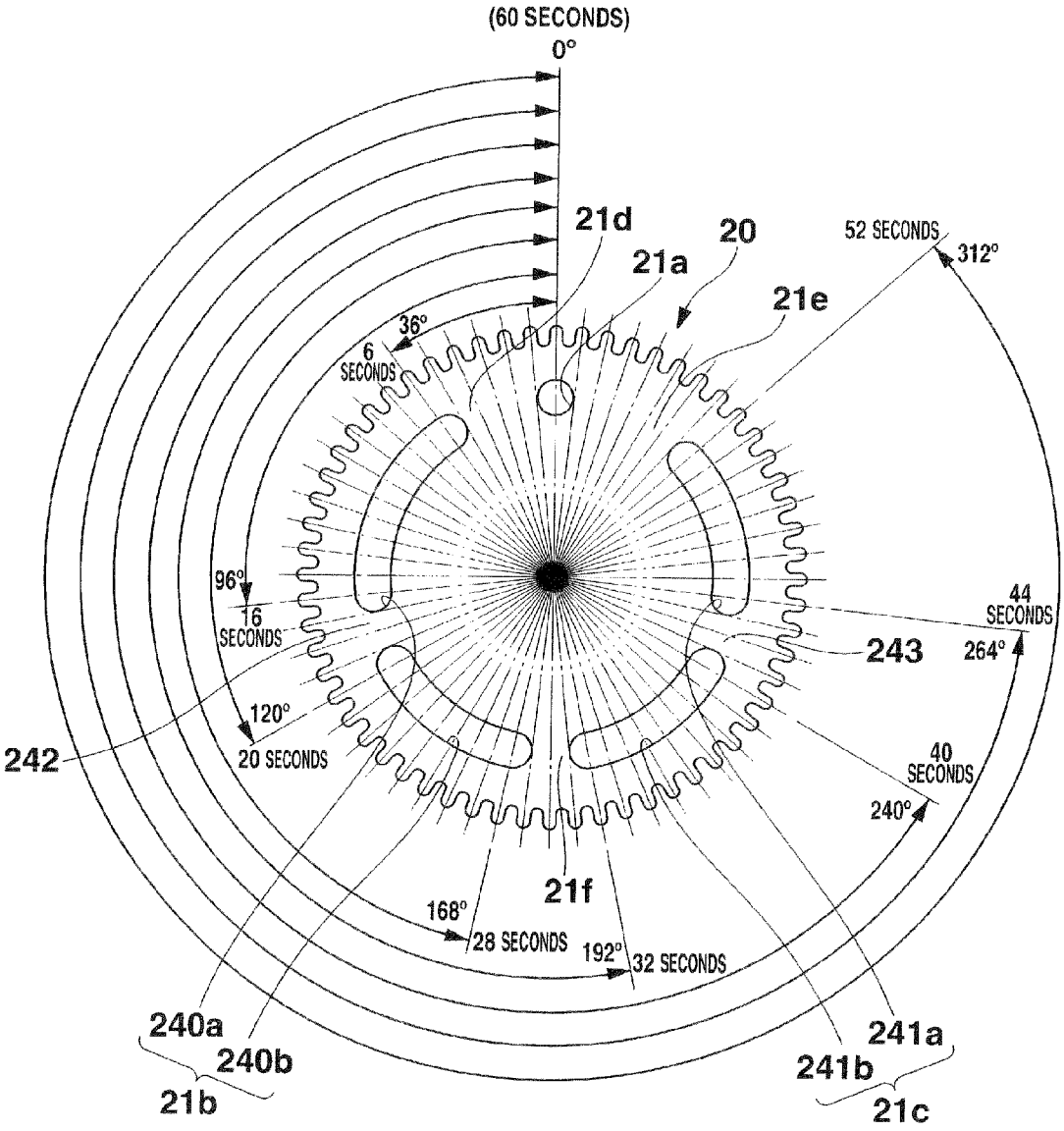
FIG. 33 is an enlarged plan view showing the seconds wheel according to a third modification of the embodiment.

In the above described embodiment and the second modification, the first light blocking area 21*d* is formed between the circular aperture 21*a* and the first arcuate aperture 21*b* (or arcuate aperture 240*a*) and has the width that is three times longer than the diameter of the circular aperture 21*a*, and the second light blocking area 21*e* is formed between the circular aperture 21*a* and the second arcuate aperture 21*c* (or arcuate aperture 241*a*) and has the width that is four times longer than the diameter of the circular aperture 21*a*. The invention is not limited to the above configuration. The apertures may be configured as shown in FIG. 33.

According to the third modification, the first light blocking area 21*d* is formed between 0 and 36 degrees from the center of the center of the circular aperture 21*a*. The first light flocking area 21*d* has a width corresponding to 24 degrees that is two times longer than the diameter of the circular aperture 21*a*. The second light blocking area 21*e* is formed between 0 and 48 degrees from the center of the circular aperture 21*a*. The second light blocking area 21*e* has a width corresponding to 36 degrees that is three times longer than the diameter of the circular aperture 21*a*.

Similarly to the second modification, the first arcuate aperture 21*b* is divided into two arcuate apertures 240*a* and 240*b*. The fifth light blocking area 242 is formed between the arcuate apertures 240*a* and 240*b*. The arcuate aperture 240*a* which is next to the circular aperture 21*a* is formed between 36 and 96 degrees from the center of the circular aperture 21*a*. The arcuate aperture 240*a* has a width that is expended toward the circular aperture 21*a* by the diameter of the circular aperture 21*a* in comparison with the second modification.

Similarly to the second modification, the second arcuate aperture 21*c* is divided into two arcuate apertures 241*a* and 241*b*. The sixth light blocking area 243 is formed between the arcuate apertures 241*a* and 241*b*. The arcuate aperture 241*a* which is next to the circular aperture 21*a* is formed between 264 and 312 degrees from the center of the circular aperture 21*a*. The arcuate aperture 241*a* has a width that is expended toward the first circular aperture by the diameter of the circular aperture 21*a* in comparison with the second modification.

The first light blocking area 21*d* is diametrically opposed to the arcuate aperture 241*b*. The second light blocking area 21*e* is diametrically opposed to the arcuate aperture 240*b*. The third, fifth and sixth light blocking areas 21*f*, 242 and 243 are diametrically opposed to the circular aperture 21*a* and the arcuate apertures 241*a* and 240*a*, respectively.

According to thus configured seconds wheel 20, in the case where one of the first to third, fifth and sixth light blocking areas 21*d* to 21*f*, 242 and 243 is positioned at the detection position P of the detection unit 13, when the seconds wheel 20 rotates 30 steps (180 degrees), one of the circular aperture 21*a* and the arcuate apertures 240*a*, 240*b*, 241*a* and 241*b* is necessarily located at the detection position P, similarly to the above described embodiment and the second modification.

In addition, since the first light blocking area 21*d* has the width that is two times longer than the diameter of the circular aperture 21*a* and the seconds wheel 20 rotates by one step (six degrees) at a time, when the seconds wheel 20 rotates four steps (24 degrees), the first light blocking area 21*d* passes over the detection position P. Then, when the seconds wheel 20 rotates further two steps (six seconds in total); a part of the arcuate aperture 40*a* comes to the detection position P. Thus, the rotational position of the seconds wheel 20 can be detected in six seconds. Therefore, when deviation of the position of the seconds hand is within one hour, it can be confirmed in a shorter period of time whether the position of the seconds hand 2 is correctly set or not.

In addition, the second light blocking area 21*e* has the width that is three times longer than the diameter of the circular aperture 21*a*. When counting the number of times of detection failure due to the second light blocking area 21*e*, when the detection unit 13 detects the circular aperture 21*a* after the number of times of detection failure comes to three, the position where the detection unit detects light is determined to be the reference position (00-second position) of the seconds wheel 20. Therefore, the reference position of the seconds wheel 20 can be detected in a shorter period of time in comparison with above embodiment, and detection speed is improved.

In the above embodiment, and first to third modifications, the hand position detection for the seconds, center and hour hands 2, 3 and 4 is stopped from the time point when three hand position detection errors are successively detected to a few minute before the specific time point (ten fifty-five). However, the invention is not limited to the above configuration. The hand position detection for the second, center and hour hands 2, 3 and 4 may be stopped from the time point when a predetermined numbers of hand position detection errors (i.e., three errors) are successively detected to a time point when the wristwatch 1 is set in the sleep state in which the wristwatch 1 is not used for a long period. Such configuration can prevent large consumption of the battery.

In the above embodiment and modifications, the hand-position detecting process is executed every five minutes before the hour. However, execution of the process is not limited to five minutes before the hour. The process may be executed 1-10 minutes before the hour.

In the above embodiment and modifications, the circular aperture 21*a*, second and third light-passing apertures 28 and 29 are formed in a circular shape. However, the shape of the apertures is not limited to the circular shape. The apertures may be formed in a square, trapezoidal or polygonal shape.

In the above embodiment and modifications, the hand position detection device is applied to the hand type wristwatch 1. However, the hand position detection device may be employed by various types of hand type timepiece such as a travel watch, alarm watch, standing clock, and wall clock.

While the description above refers to particular embodiments and modifications of the present invention, it will be understood that many modifications may be made without departing from the spirit thereof. The accompanying claims are intended to cover such modifications as would fall within the true scope and spirit of the present invention. The presently disclosed embodiments and modifications are therefore to be considered in all respects as illustrative and not restrictive, the scope of the invention being indicated by the appended claims, rather than the foregoing description, and all changes that come within the meaning and range of equivalency of the claims are therefore intended to be embraced therein. For example, the present invention can be practiced as a computer readable recording medium in which a program for allowing the computer to function as predetermined means, allowing the computer to realize a predetermined function, or allowing the computer to conduct predetermined means.

What is claimed is:

1. A hand position detecting device comprising:

an optical detection unit configured to detect whether or not light passes through light-passing apertures provided in hand wheels having hands;

a hand position detecting unit configured to detect positions of the hands based on passage or non-passage of light detected by the optical detection unit;

a darkness detector configured to detect whether or not the hand position detecting device is in darkness;

a dark state determining unit configured to determine, when the darkness detector detects that the hand position detecting device is in darkness, whether or not the hand position detecting device has been in darkness for a predetermined time period; and a hand rotation stop controlling unit configured to, when the dark state determining unit determines that the hand position detecting device has been in darkness for the predetermined time period, rotate at least one of the hands to a reference position, stop the one of the hands, and control the hand position detection unit to detect positions of remaining hands at predetermined time intervals.

2. The hand position detecting device according to claim 1, further comprising a hand position detection stopping unit configured to, when the hand position detecting unit fails to detect the positions of the hands successively a predetermined number of times in a state in which the one of the hands is stopped at the reference position under control of the hand rotation stop controlling unit, stop hand position detection by the hand position detecting unit until a predetermined time point.

3. The hand position detecting device according to claim 2, further comprising a hand rotation long period stop controlling unit configured to rotate the hands to the reference position and stop the hands, when the dark state determining unit determines that the hand position detecting device has been in darkness for a period that is longer than the predetermined time period.

4. The hand position detecting device according to claim 1, further comprising a hand rotation long period stop controlling unit configured to rotate the hands to the reference position and stop the hands, when the dark state determining unit determines that the hand position detecting device has been in darkness for a period that is longer than the predetermined time period.

5. The hand position detecting device according to claim 4, wherein the hands include a seconds hand, a center hand, and an hour hand, and the hand wheels include a seconds wheel having the seconds hand, a center wheel having the center hand, and an hour wheel having the hour hand;

wherein when the dark state determining unit determines that the hand position detecting device has been in darkness for the predetermined time period, the hand rotation stop controlling unit rotates the seconds hand to the reference position and stops the seconds hand; and wherein when the dark state determining unit determines that the hand position detecting device has been in darkness for the period that is longer than the predetermined time period, the hand rotation long period stop controlling unit rotates the seconds, center, and hour hands to the reference position and stops the seconds, center, and hour hands.

6. The hand position detecting device according to claim 4, further comprising a release unit configured to release stoppage of the one of the hands stopped under control of the hand rotation stop controlling unit or release stoppage of the hands stopped under a control of the hand rotation long period stop controlling unit.

7. A hand position control method for a hand position detecting device comprising an optical detection unit configured to detect whether or not light passes through light-passing apertures provided in hand wheels having hands, and a hand position detecting unit configured to detect positions of the hands based on passage or non-passage of light detected by the optical detection unit, the method comprising:

detecting whether or not the hand position detecting device is in darkness;

determining whether or not the hand position detecting device has been in darkness for a predetermined time period when it is detected that the hand position detecting device is in darkness; and when it is determined that the hand position detecting device has been in darkness for the predetermined time period, rotating at least one of the hands to a reference position, stopping the one of the hands, and controlling positions of remaining hands to be detected at predetermined time intervals.

8. The hand position control method according to claim 7, further comprising, when the positions of the hands cannot be detected successively a predetermined number of times in a state in which the one of the hands is stopped at the reference position, stopping hand position detection until a predetermined time point.

9. The hand position control method according to claim 8, further comprising rotating the hands to the reference position and stopping the hands, when it is determined that the hand position detecting device has been in darkness for a period that is longer than the predetermined time period.

10. The hand position control method according to claim 7, further comprising rotating the hands to the reference position and stopping the hands, when it is determined that the hand position detecting device has been in darkness for a period that is longer than the predetermined time period.

11. The hand position control method according to claim 10, wherein the hands include a seconds hand, a center hand, and an hour hand, and the hand wheels include a seconds wheel having the seconds hand, a center wheel having the center hand, and an hour wheel having the hour hand;

wherein when it is determined that the hand position detecting device has been in darkness for the predetermined time period, the seconds hand is rotated to the reference position and stopped; and wherein when it is determined that the hand position detecting device has been in darkness for the period that is longer than the predetermined time period, the seconds, center, and hour hands are rotated to the reference position and stopped.

12. The hand position control method according to claim 10, further comprising releasing stoppage of the stopped one of the hands or releasing stoppage of the stopped hands.

* * * * *